US006261750B1

(12) United States Patent
Ishii et al.

(10) Patent No.: US 6,261,750 B1
(45) Date of Patent: Jul. 17, 2001

(54) SILVER HALIDE COLOR LIGHT-SENSITIVE MATERIAL

(75) Inventors: Yoshio Ishii; Takayuki Ito; Fumitaka Ueda; Hiroyuki Yoneyama, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/540,949

(22) Filed: Mar. 31, 2000

(30) Foreign Application Priority Data

Mar. 31, 1999 (JP) ..... 11-092845
Aug. 17, 1999 (JP) ..... 11-230894

(51) Int. Cl.[7] ..... G03C 1/34; G03C 1/43; G03C 7/305; G03C 1/49

(52) U.S. Cl. ..... 430/510; 430/504; 430/505; 430/507; 430/509; 430/543; 430/544; 430/596; 430/955; 430/956; 430/957; 430/959

(58) Field of Search ..... 430/217, 226, 430/509, 596, 597, 955, 956, 957, 959, 507, 510, 543, 544, 504, 505

(56) References Cited

U.S. PATENT DOCUMENTS 3,227,551 * 1/1966 Barr et al. ..... 430/226
3,364,022 * 1/1968 Barr et al. ..... 436/226
4,015,989 * 4/1977 Oishi et al. ..... 430/217
4,023,970 * 5/1977 Hellmig et al. ..... 430/509
4,052,214 * 10/1977 Oishi et al. ..... 430/217
5,318,879 * 6/1994 Begley et al. ..... 430/226
5,561,031 10/1996 Bowne ..... 430/955

FOREIGN PATENT DOCUMENTS 63-175850 7/1988 (JP) .
2-5042 1/1990 (JP) .

* cited by examiner

*Primary Examiner*—Richard L. Schilling
(74) *Attorney, Agent, or Firm*—Birch, Stewart, Kolasch & Birch, LLP

(57) ABSTRACT

A silver halide color light-sensitive material contains at least one light-sensitive silver halide emulsion layer and at least one non-light-sensitive layer on a support, wherein at least one of the non-light-sensitive layers contains a silver halide emulsion having a previously fogged surface, and the non-light-sensitive layer containing the previously fogged emulsion and/or its adjacent layer contains a compound capable of releasing a photographically useful group or its precursor by a coupling reaction with the oxidized form of a developing agent, wherein the previously fogged emulsion is developed during color development to evenly form the oxidized form of a color developing agent, and the photographically useful group or its precursor is released non-imagewise by the coupling reaction.

14 Claims, No Drawings

SILVER HALIDE COLOR LIGHT-SENSITIVE MATERIAL

CROSS-REFERENCE TO RELATED APPLICATIONS

This application is based upon and claims the benefit of priority from the prior Japanese Patent Applications No. 11-092845, filed Mar. 31, 1999; and No. 11-230894, filed Aug. 17, 1999, the entire contents of which are incorporated herein by reference.

BACKGROUND OF THE INVENTION

The present invention relates to a silver halide color light-sensitive photographic material having high storage stability and capable of stably and rapidly releasing a photographically useful group during color development.

Various effects can be obtained in accordance with the types of photographically useful groups released during color development.

A photographically useful compound necessary during development is generally added to a developing solution (commonly, a compound is added to a replenisher to keep necessary concentration in running equilibrium).

When a photographically useful compound is added to a developing solution or to a replenisher, however, it sometimes loses its effect under the influence of long-term storage (storage or running of the replenisher).

To prevent this, it is possible to previously add a photographically useful compound to a light-sensitive material and achieve its effect during development. This method has the advantage that the effect can be achieved only in a necessary location, i.e., in a specific layer and its vicinity of a multilayered light-sensitive material. However, if a photographically useful compound is added in an active form to a light-sensitive material, the compound decomposes under the influence of heat, moisture, or oxygen when the light-sensitive material is stored before development. Consequently, no effect can be achieved during development. Furthermore, the decomposition product sometimes gives unpreferable photographic changes to the light-sensitive material. Therefore, this method is inapplicable depending on the type of compound.

One method of solving this problem is disclosed in Jpn. Pat. Appln. KOKOKU Publication No. (hereinafter referred to as JP-B-)4-73573. In this method, a photographically useful compound is added in a substantially inactive form (i.e., a photographically useful compound precursor) to a light-sensitive material by blocking its active group, and this precursor functions as an active photographically useful compound in a developing solution.

This JP-B-4-73573 achieves both rapid release of an active photographically useful compound from a precursor during development and high storage stability of a light-sensitive material. However, further improvements of the storage stability of a light-sensitive material are still being demanded. Additionally, the release of an active photographically useful compound uses a reaction with hydroxylamines in a developing solution. This results in large variations in the photographic properties due to variations in the concentration of the hydroxylamines.

Jpn. Pat. Appln. KOKAI Publication No. (hereinafter referred to as JP-A-)8-339058, whose corresponding U.S. application is now patented to U.S. Pat. No. 5,561,031, has disclosed a color reversal photographic element in which a non-light sensitive emulsion and a bleaching accelerator-releasing compound capable of releasing the bleaching accelerator by the reaction with the oxidized form of a developing agent, are added to a single same layer or a combined layers.

This is a superior method in that a bleaching accelerator (photographically useful compound) is released non-imagewise during color development. However, a nonsensitive emulsion is chemically fogged in a reversal bath (fogging step) before color development. Hence, the method cannot be used for a color negative light-sensitive material or color paper light-sensitive material using no reversal bath.

JP-A-63-175850 has disclosed a light-sensitive material which contains silver halide grains having fog nuclei on their surfaces or subsurfaces in a silver halide emulsion and also contains a bleaching accelerator (photographically useful compound) releasing coupler. This method is excellent in that it achieves both high aging stability and good desilvering characteristics of a light-sensitive material. However, silver halide grains having fog nuclei on their surfaces or subsurfaces coexist in a silver halide emulsion layer. This sometimes adversely affects the aging stability of a light-sensitive material depending on the type of silver halide emulsion.

Also, in this method silver halide grains having fog nuclei coexist in a silver halide emulsion layer, so a bleaching accelerator is released imagewise to some extent. Hence, the release amount and the like factor readily vary in accordance with property changes due to storage of the coexisting silver halide emulsion.

JP-A-2-5042 has disclosed a color reversal material containing a surface-fogged silver halide emulsion and a bleaching accelerator-releasing compound. Since this color reversal material is subjected to black-and-white development before color development, the fogged silver halide emulsion forms developed silver during color development, so no oxidized form of a developing agent can be formed. Consequently, no photographically useful group cannot be generated during color development.

BRIEF SUMMARY OF THE INVENTION

It is, therefore, an object of the present invention to provide a silver halide light-sensitive material having high storage stability and capable of stably and rapidly releasing a photographically useful group during color development.

The above object can be achieved by the following silver halide photographic materials. That is, (1) A silver halide color light-sensitive material comprising at least one light-sensitive silver halide emulsion layer and at least one non-light-sensitive layer on a support, wherein at least one of the non-light-sensitive layers contains a previously fogged silver halide emulsion containing grains each having a previously fogged surface, and the non-light-sensitive layer containing the previously fogged emulsion and/or its adjacent layer contains a compound capable of releasing a photographically useful group or its precursor by a coupling reaction with the oxidized form of a developing agent; and the previously fogged emulsion is developed during color development to evenly form the oxidized form of a color developing agent, and the photographically useful group or its precursor is released non-imagewise by the coupling reaction.

(2) The silver halide color light-sensitive material described in item (1) above, wherein the compound capable of releasing a photographically useful group or its precursor does not substantially form an image by the coupling reaction with the oxidized form of a developing agent.

(3) The silver halide color light-sensitive material described in item (2) above, wherein the compound capable of releasing a photographically useful group or its precursor is represented by formula (II) below:

COUP1-B1 (II)

wherein COUP1 represents a coupler moiety which releases B1 by the coupling reaction with the oxidized form of a developing agent and also forms a water-soluble or alkali-soluble compound, and B1 represents a photographically useful group or its precursor which connects at the coupling position of COUP1.

(4) The silver halide color light-sensitive material described in item (3) above, wherein the compound represented by formula (II) is a compound represented by formula (III) below:

COUP2-A-E-B2 (III)

wherein COUP2 represents a coupler moiety capable of coupling with the oxidized form of a developing agent; E represents an electrophilic portion; A represents a connecting group capable of releasing B2 with ring formation by an intramolecular nucleophilic substitution reaction of a nitrogen atom, which arises from the developing agent in the product of coupling between COUP2 and the oxidized form of the developing agent and which directly bonds to the coupling position, with the nucleophilic portion E; and B2 represents a photographically useful group or its precursor.

(5) The silver halide color light-sensitive material described in any one of items (1) to (4) above, wherein the previously fogged silver halide emulsion and the compound are contained in the same layer.

(6) The silver halide color light-sensitive material described in any one of items (1) to (5) above, wherein the non-light-sensitive layer containing the previously fogged silver halide emulsion contains black colloidal silver.

(7) The silver halide color light-sensitive material described in any one of items (1) to (5) above, wherein a layer adjacent to the non-light-sensitive layer containing the previously fogged silver halide emulsion contains black colloidal silver.

(8) The silver halide color light-sensitive material described in any one of items (1) to (7) above, wherein the photographically useful group is a bleaching accelerator.

(9) The silver halide color light-sensitive material described in any one of items (1) to (7) above, wherein the photographically useful group is a development inhibitor.

(10) The silver halide color light-sensitive material described in any one of items (1) to (9) above, wherein at least one of light-sensitive silver halide emulsions contained in the at least one light-sensitive silver halide emulsion layer is an emulsion having a silver chloride content of at least 10 mol%.

(11) The silver halide color light-sensitive material described in any one of items (1) to (10) above, wherein at least one of the previously fogged silver halide emulsions contained in the at least one non-light-sensitive layer is an emulsion having a silver chloride content of at least 10 mol%.

DETAILED DESCRIPTION OF THE INVENTION

The present invention will be described in more detail below.

A compound capable of releasing a photographically useful group or its precursor by a coupling reaction with the oxidized form of a developing agent used in the present invention will be described below.

This compound capable of releasing a photographically useful group or its precursor by a coupling reaction with the oxidized form of a developing agent is preferably a compound represented by A-B.

A represents a coupler moiety, and preferable examples are as follows.

Examples of the coupler moiety are yellow coupler moieties (e.g., open-chain ketomethylene coupler moieties such as acylacetoanilide and malondianilide), magenta coupler moieties (e.g., 5-pyrazolone type, pyrazolotriazole type, imidapyrazole type coupler moieties), cyan coupler moieties (e.g., a phenol type coupler moiety, a naphthol type coupler moiety, and imidazole type coupler moiety described in European Patent Publication No. 249,453, the disclosure of which is herein incorporated by reference and pyrazolopyrimidine type coupler moiety described in EP 304,001, the disclosure of which is herein incorporated by reference), and non-dye-forming coupler moieties (e.g., imidanone type and acetophenone type coupler moieties). It is also possible to use eterocyclic coupler moieties described in U.S. Pat. Nos. 4,315,070, 4,183,752, 4,174,969, 3,961,959, and 4,171,223, and JP-A-52-82423, all the disclosures of which are herein incorporated by reference.

More preferable examples are coupler moieties represented by formulas (Cp-1), (Cp-2), (Cp-3), (Cp-4), (Cp-5), (Cp-6), (Cp-7), (Cp-8), (Cp-9), (Cp-10), and (Cp-11) below. These couplers are preferable because of their high coupling rates.

(Cp-1)

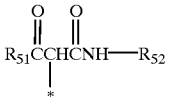

(Cp-2)

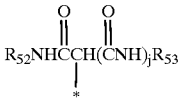

(Cp-3)

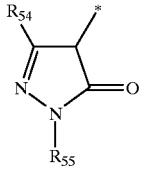

(Cp-4)

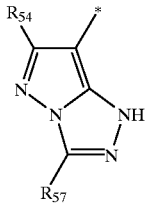

-continued (Cp-5)

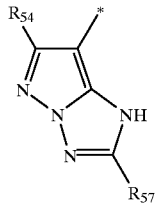

(Cp-6)

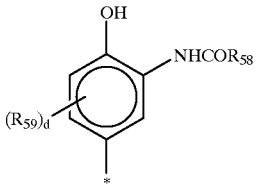

(Cp-7)

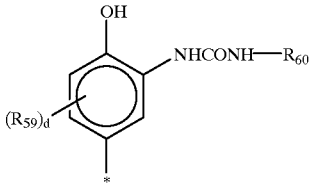

(Cp-8)

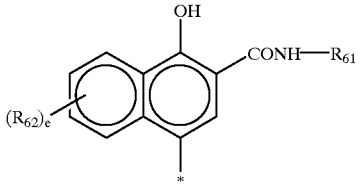

(Cp-9)

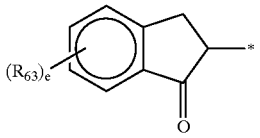

(Cp-10)

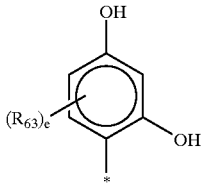

(Cp-11)

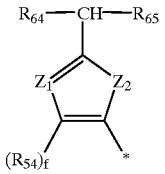

In the above formulas, a symbol * stemming from the coupling position represents a position where the coupler bonds to B in formula A-B.

In the above formulas, if $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, or $R_{65}$ contains a nondiffusing group, this nondiffusing group is so selected as to have a total number of carbon atoms of 8 to 40, preferably 10 to 30. In other cases, the total number of carbon atoms is preferably 15 or less.

Details of $R_{51}$ to $R_{65}$, $Z_1$, $Z_2$, j, d, e, and f will be described below. In the following description, $R_{41}$ represents an aliphatic group, aromatic group, or heterocyclic group. $R_{42}$ represents an aromatic group or heterocyclic group. Each of $R_{43}$, $R_{44}$, and $R_{45}$ represents a hydrogen atom, aliphatic group, aromatic group, or heterocyclic group.

$R_{51}$ represents the same meaning as $R_{41}$. Each of $R_{52}$ and $R_{53}$ represents the same meaning as $R_{42}$. j represents 0 or 1. $R_{54}$ represents a group having the same meaning as $R_{41}$, $R_{41}CON(R_{43})$— group, $R_{41}R_{43}N$— group, $R_{41}SO_2N(R_{43})$— group, $R_{41}S$— group, $R_{43}O$— group, $R_{45}N(R_{43})CON(R_{44})$— group, or :::C— group. $R_{55}$ represents a group having the same meaning as $R_{41}$. Each of $R_{56}$ and $R_{57}$ represents a group having the same meaning as $R_{43}$, $R_{41}S$— group, $R_{43}O$— group, $R_{41}CON(R_{43})$— group, or $R_{41}SO_2N(R_{43})$— group. $R_{58}$ represents a group having the same meaning as $R_{41}$. $R_{59}$ represents a group having the same meaning as $R_{41}$, $R_{41}CON(R_{43})$— group, $R_{41}OCON(R_{43})$— group, $R_{41}SO_2N(R_{43})$— group, $R_{43}R_{44}NCON(R_{45})$— group, $R_{41}O$— group, $R_{41}S$— group, halogen atom, or $R_{41}R_{43}N$— group.

d represents 0 to 3. If d is the plural number, a plurality of $R_{59}$'s represent the same substituent group or different substituent groups.

As an alternative, these $R_{59}$'s can connect with each other as divalent groups to form a cyclic structure. Examples of this cyclic structure are a pyridine ring and a pyrrole ring.

$R_{60}$ represents a group having the same meaning as $R_{41}$. $R_{61}$ represents a group having the same meaning as $R_{41}$. $R_{62}$ represents a group having the same meaning as $R_{41}$, $R_{41}OCONH$— group, $R_{41}SO_2NH$— group, $R_{43}R_{44}NCON(R_{45})$— group, $R_{43}R_{44}NSO_2N(R_{45})$— group, $R_{43}O$— group, $R_{41}S$— group, halogen atom, or $R_{41}R_{43}N$— group. $R_{63}$ represents a group having the same meaning as $R_{41}$, $R_{43}CON(R_{45})$— group, $R_{43}R_{44}NCO$— group, $R_{41}SO_2N(R_{44})$— group, $R_{43}R_{44}NSO_2$— group, $R_{41}SO_2$— group, $R_{43}OCO$— group, $R_{43}O$—$SO_2$— group, halogen atom, nitro group, cyano group, or $R_{43}CO$— group.

e represents an integer from 0 to 4. If a plurality of $R_{62}$'s or $R_{63}$'s are present, they represent the same group or different groups.

Each of $R_{64}$ and $R_{65}$ represents an $R_{43}R_{44}NCO$— group, $R_{41}CO$— group, $R_{43}R_{44}NSO_2$— group, $R_{41}OCO$— group, $R_{41}SO_2$— group, nitro group, or cyano group.

$Z_1$ represents a nitrogen atom or $=C(R_{66})$— group ($R_{66}$ represents a hydrogen atom or a group having the same meaning as $R_{63}$). $Z_2$ represents a sulfur atom or oxygen atom.

f represents 0 or 1.

In the above description, an aliphatic group is a 1- to 32-carbon, preferably 1- to 22-carbon, saturated or unsaturated, chainlike or cyclic, straight-chain or branched, substituted or nonsubstituted aliphatic hydrocarbon group. Representative examples are methyl, ethyl, propyl, isopropyl, butyl, (t)-butyl, (i)-butyl, (t)-amyl, hexyl, cyclohexyl, 2-ethylhexyl, octyl, 1,1,3,3-tetramethylbutyl, decyl, dodecyl, hexadecyl, or octadecyl.

An aromatic group is a 6- to 20-carbon, preferably substituted or nonsubstituted phenyl group, or substituted or nonsubstituted naphthyl group.

A heterocyclic group is a 1- to 20-carbon, preferably 1- to 7-carbon, preferably 3- to 8-membered, substituted or nonsubstituted heterocyclic group which contains a hetero-atom selected from a nitrogen atom, oxygen atom, and sulfur atom. Representative examples of this heterocyclic group are 2-pyridyl, 2-furyl, 2-imidazolyl, 1-indolyl, 2,4-dioxo-1, 3-imidazolidine-5-yl, 2-benzoxazolyl, 1,2,4-triazole-3-yl, and 4-pyrazolyl.

If any of these aliphatic hydrocarbon group, aromatic group, and heterocyclic group has a substituent, representative examples are a halogen atom, $R_{47}O$— group, $R_{46}S$— group, $R_{47}CON(R_{48})$— group, $R_{47}N(R_{48})CO$— group, $R_{46}OCON(R_{47})$— group, $R_{46}SO_2N(R_{47})$— group, $R_{47}R_{48}NSO_2$— group, $R_{46}SO_2$— group, $R_{47}OCO$— group, $R_{47}R_{48}NCON(R_{49})$— group, group having the same meaning as $R_{46}$, $R_{46}COO$— group, $R_{47}OSO_2$— group, cyano group, and nitro group. $R_{46}$ represents an aliphatic group, aromatic group, or heterocyclic group. Each of $R_{47}$, $R_{48}$, and $R_{49}$ represents an aliphatic group, aromatic group, heterocyclic group, or hydrogen atom. These aliphatic, aromatic, and heterocyclic groups have the same meanings as defined above.

Next, preferable ranges of $R_{51}$ to $R_{65}$, j, d, e, and f will be described below.

$R_{51}$ is preferably an aliphatic group or aromatic group. Each of $R_{52}$ and $R_{55}$ is preferably an aromatic group. $R_{53}$ is preferably an aromatic group or heterocyclic group.

In formula (Cp-3), $R_{54}$ is preferably an $R_{41}CONH$— group or $R_{41}R_{43}N$— group. Each of $R_{56}$ and $R_{57}$ is preferably an aliphatic group, aromatic group, $R_{41}O$— group, or $R_{41}S$— group. $R_{58}$ is preferably an aliphatic group or aromatic group. In formula (Cp-6), $R_{59}$ is preferably a chlorine atom, aliphatic group, or $R_{41}CONH$— group. d is preferably 1 or 2. $R_{60}$ is preferably an aromatic group. In formula (Cp-7), $R_{59}$ is preferably an $R_{41}CONH$— group. d is preferably 1. $R_{61}$ is preferably an aliphatic group or aromatic group. In formula (Cp-8), e is preferably 0 or 1. $R_{62}$ is preferably an $R_{41}OCONH$— group, $R_{41}CONH$— group, or $R_{41}SO_2NH$— group. The substitution position of these groups is preferably the (5) position of a naphthol ring. In formula (Cp-9), $R_{63}$ is preferably an $R_{41}CONH$— group, $R_{41}SO_2NH$— group, $R_{41}R_{43}NSO_2$— group, $R_{41}SO_2$— group, $R_{41}R_{43}NCO$— group, nitro group, or cyano group, and e is preferably 1 or 2. In formula (Cp-10), $R_{63}$ is preferably an $(R_{43})_2NCO$— group, $R_{43}OCO$— group, or $R_{43}CO$— group, and e is preferably 1 or 2. In formula (Cp-11), $R_{54}$ is preferably an aliphatic group, aromatic group, or $R_{41}CONH$— group, and f is preferably 1. Also, a coupler moiety represented by A preferably has a nondiffusing group.

A photographically useful group or its precursor represented by B is identical with B1 and B2 in the explanation of formulas (II) and (III) below.

Preferable examples of a compound represented by A-B are a development inhibitor-releasing coupler and a bleaching accelerator-releasing coupler. However, the compound is not limited to these examples.

Examples of the development inhibitor releasing coupler are described in JP-A-62-34158, JP-A-63-37346, U.S. Pat. No. 4,782,012, JP-A-60- 191241, and EP-252376, the disclosures of which are incorporated by reference.

Examples of the bleaching accelerator-releasing compound are described in JP-A-60-191241, JP-A-64-31159, JP-A-1-185631, JP-A-7-152122, JP-A-8-339058, and JP-A-61-201247, the disclosures of which are incorporated by reference.

These compound examples will be presented below. However, the present invention is not restricted to these examples.

A-1

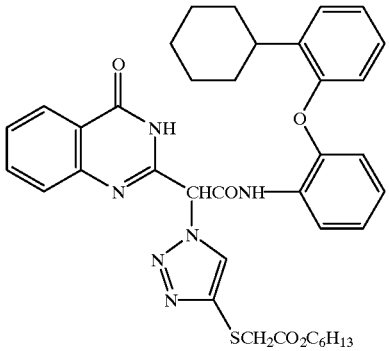

A-2

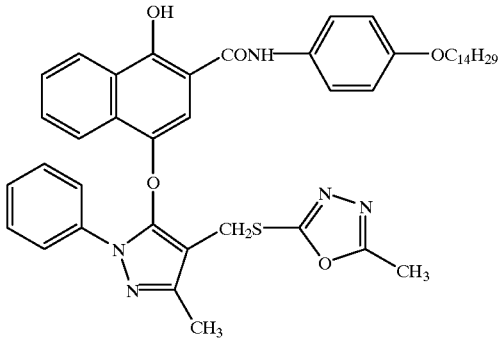

-continued
A-3
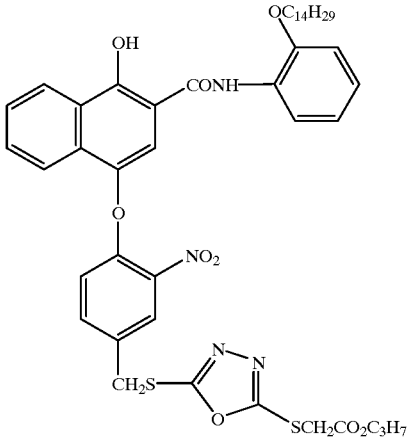
A-4
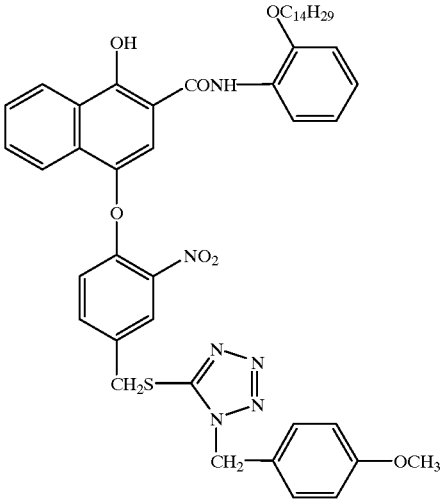
A-5
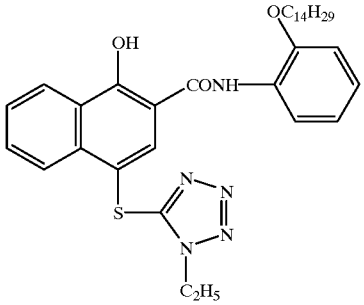
A-6
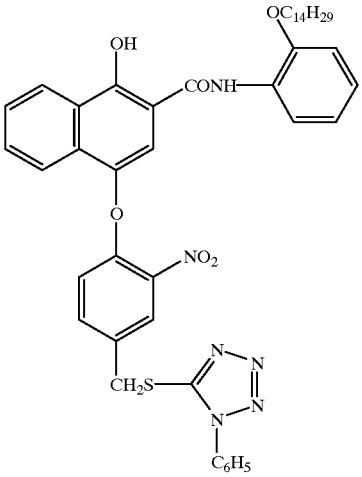
A-7
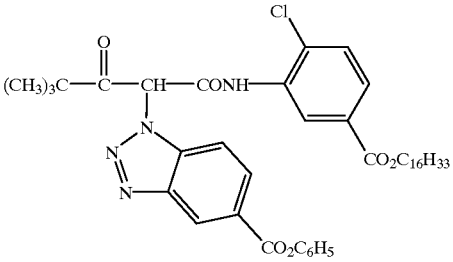
A-8
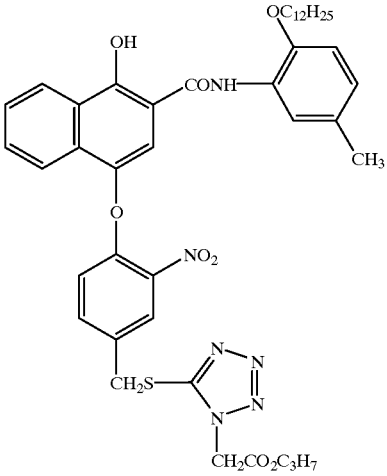

-continued
A-9
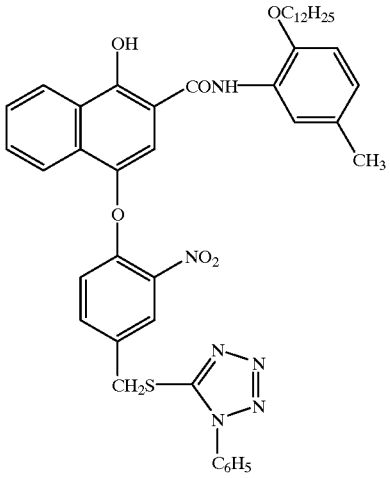
A-10
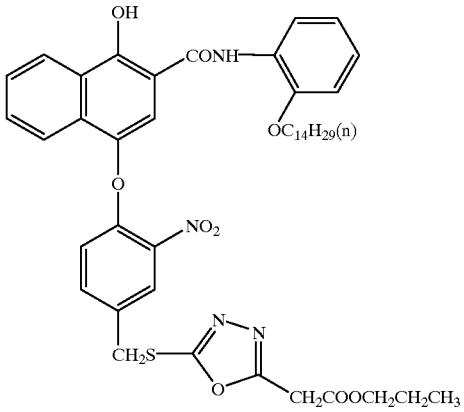
A-11
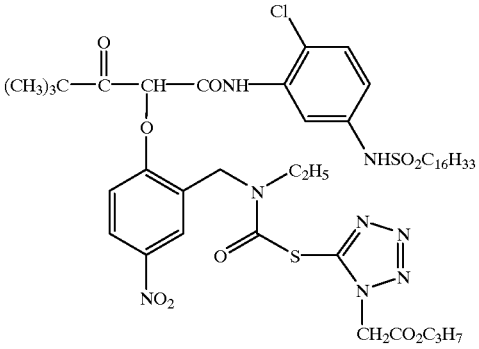
A-12
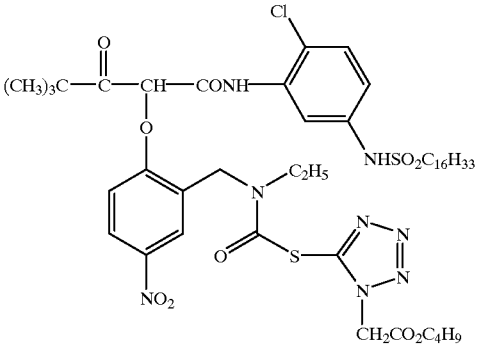
A-13
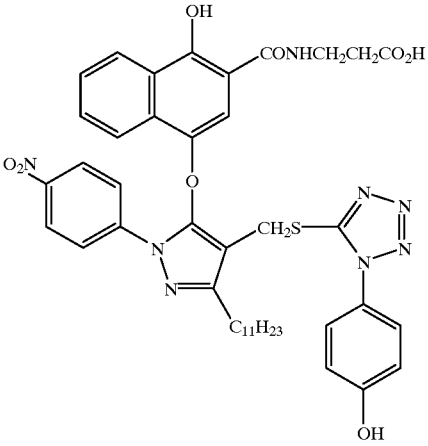
A-14
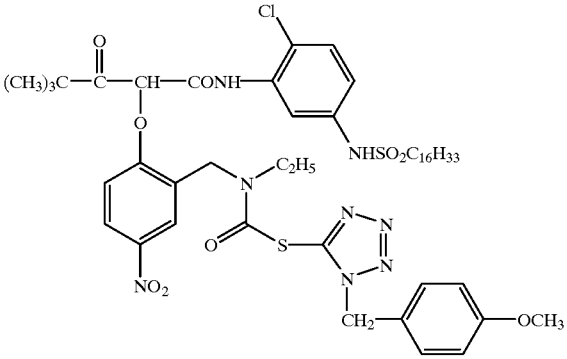
A-15
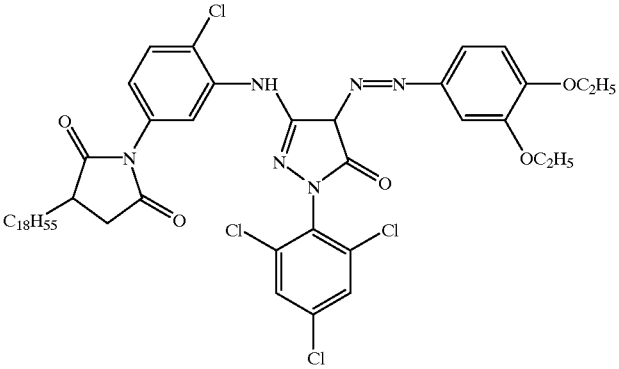

-continued
A-16
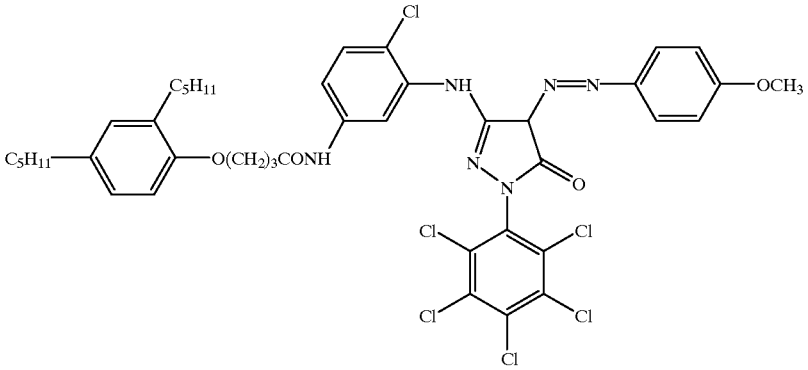
A-17
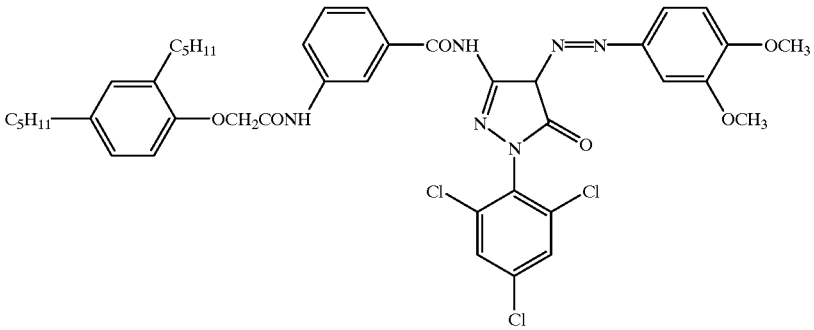
A-18
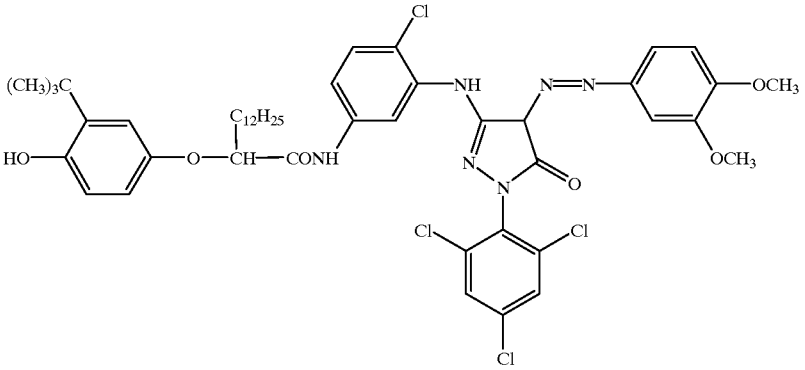
A-19
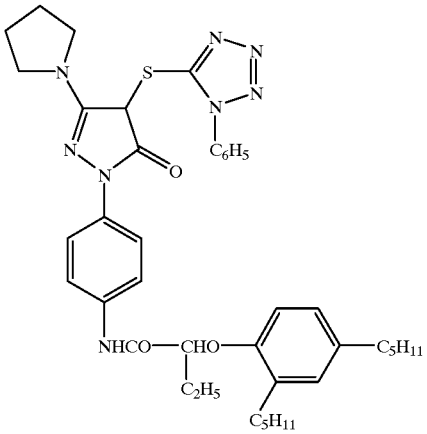
A-20
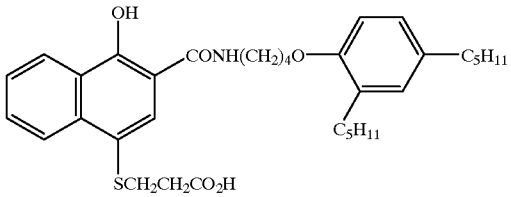

-continued

A-21

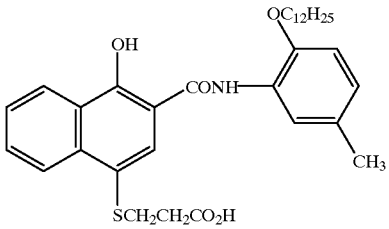

A-22

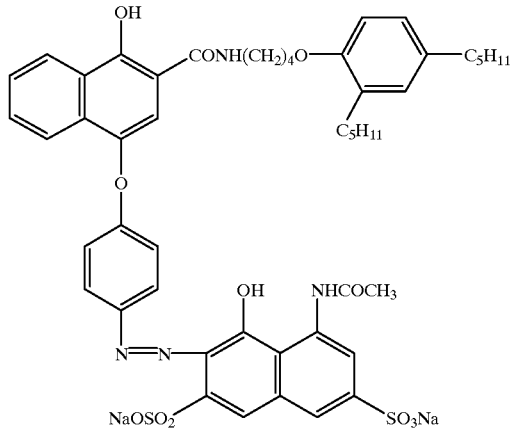

A-23

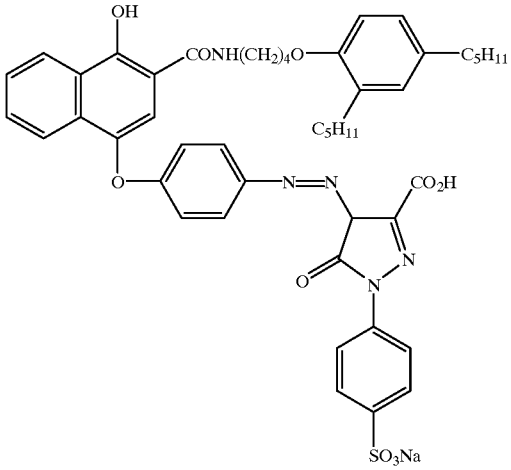

A-24

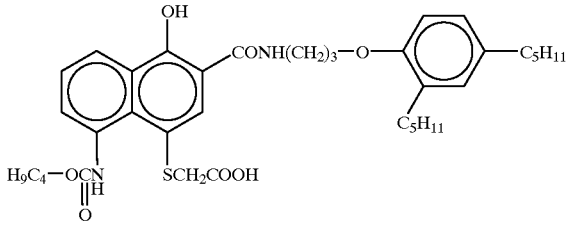

A-25

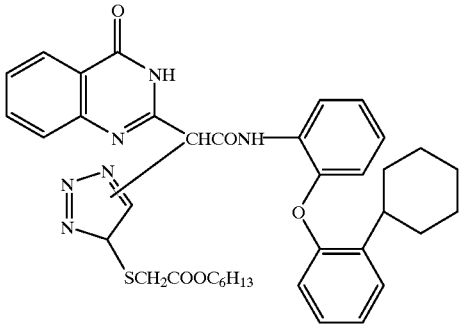

A photographically useful group-releasing compound represented by formula (II) will be described below.

COUP1-B1 (II)

(wherein COUP1 represents a coupler moiety which releases B1 by reacting with the oxidized form of a developing agent and also forms a water-soluble or alkali-soluble compound. Bi represents a photographically useful group or its precursor which connects at the coupling position of COUP1.

A photographically useful group-releasing compound represented by formula (II) will be described below.

More specifically, a photographically useful group-releasing compound represented by formula (II) is represented by formula (IIa) or (IIb) below:

COUP1-$(TIME)_m$-PUG (IIa)

COUP1-$(TIME)_i$-RED-PUG (IIb)

wherein COUP1 represents a coupler moiety which splits off $(TIME)_m$-PUG or $(TIME)_i$-RED-PUG by coupling with the oxidized form of a developing agent and forms a water-soluble or alkali-soluble compound, TIME represents a timing group which cleaves PUG or RED-PUG after splitting off from COUP1 by the coupling reaction, RED represents a group which reacts with the oxidized form of a developing agent after splitting off from COUP1 or TIME and cleaves PUG, PUG represents a photographically useful group, m represents an integer of 0 to 2, and i represents 0 or 1. If m is 2, two TIMEs represent the same group or different groups.

If COUP1 represents a yellow coupler moiety, examples of this coupler moiety are a pivaloylacetanilide type coupler moiety, benzoylacetanilide type coupler moiety, malondiester type coupler moiety, malondiamide type coupler moiety, dibenzoylmethane type coupler moiety, benzothiazolylacetamide type coupler moiety, malonestermonoamide type coupler moiety, benzoxazolylacetamide type coupler moiety, benzoimidazolylacetamide type coupler moiety, quinazoline-4-one-2-ylacetanilide type coupler moiety, and cycloalkanoylacetamide type coupler moiety.

If COUP1 represents a magenta coupler moiety, examples of this coupler moiety are a 5-pyrazolone type coupler moiety, pyrazolo[1,5-a]benzimidazole type coupler moiety, pyrazolo[1,5-b][1,2,4]triazole type coupler moiety, pyrazolo[5,1-c][1,2,4]triazole type coupler moiety, imidazo[1,2-b]pyrazole type coupler moiety, pyrrolo[1,2-b][1,2,4]triazole type coupler moiety, pyrazolo[1,5-b]pyrazole type coupler moiety, and cyanoacetophenone type coupler moiety.

If COUP1 represents a cyan coupler moiety, examples of this coupler moiety are a phenol type coupler moiety, naphthol type coupler moiety, pyrrolo[1,2-b][1,2,4]triazole type coupler moiety, pyrrolo[2,1-c][1,2,4]triazole type coupler moiety, and 2,4-diphenylimidazole type coupler moiety.

COUP1 can also be a coupler moiety which does not substantially leave any color image. Examples of a coupler moiety of this type are indanone type and acetophenone type coupler moieties.

Preferable examples of COUP1 are coupler moieties represented by formulas (Cp'-1), (Cp'-2), (Cp'-3), (Cp'-4), (Cp'-5), (Cp'-6), (Cp'-7), (Cp'-8), (Cp'-9), (Cp'-10), (Cp'-11), and (Cp'-12) below. These couplers are preferable because of their high coupling rates.

(Cp'-1)

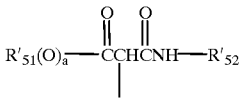

(Cp'-2)

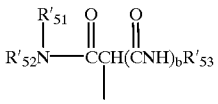

(Cp'-3)

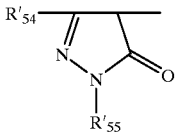

(Cp'-4)

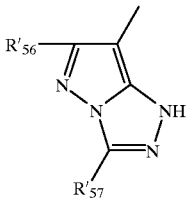

-continued (Cp'-5)

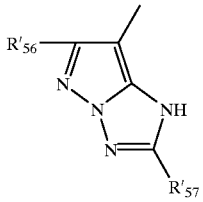

(Cp'-6)

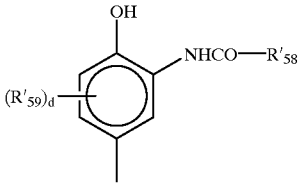

(Cp'-7)

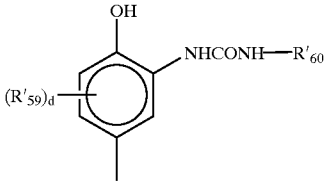

(Cp'-8)

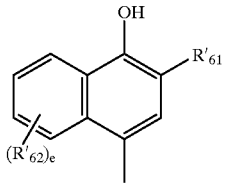

(Cp'-9)

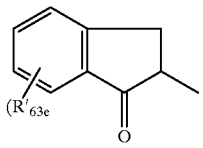

(Cp'-10)

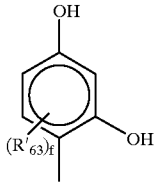

-continued (Cp'-11)

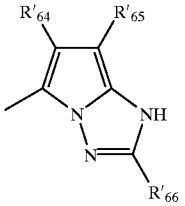

(Cp'-12)

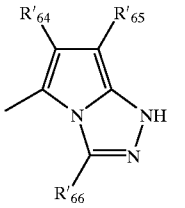

In the above formulas, a free bond hand stemming from the coupling position represents the bonding position of a coupling split-off group.

In the above formulas, the number of carbon atoms of each of $R'_{51}$, $R'_{52}$, $R'_{53}$, $R'_{54}$, $R'_{55}$, $R'_{56}$, $R'_{57}$, $R'_{58}$, $R'_{59}$, $R'_{60}$, $R'_{61}$, $R'_{62}$, $R'_{63}$, $R'_{64}$, $R'_{65}$, and $R'_{66}$ is preferably 10 or less.

A coupler moiety represented by COUP1 preferably has at least one substituent selected from an $R_{71}OCO$— group, $HOSO_2$— group, HO— group, $R_{72}NHCO$— group, and $R_{72}NHSO_2$— group. That is, at least one of $R'_{51}$ and $R'_{52}$ in formula (Cp'-1), at least one of $R'_{51}$, $R'_{52}$, and $R'_{53}$ in formula (Cp'-2), at least one of $R'_{54}$ and $R'_{55}$ in formula (Cp'-3), at least one of $R'_{56}$ and $R'_{57}$ in formulas (Cp'-4) and (Cp'-5), at least one of $R'_{58}$ and $R'_{59}$ in formula (Cp'-6), at least one of $R'_{59}$ and $R'_{60}$ in formula (Cp'-7), at least one of $R'_{61}$ and $R'_{62}$ in formula (Cp'-8), at least one $R'_{63}$ in formulas (Cp'-9) and (Cp'-10), and at least one of $R'_{64}$, $R'_{65}$, and $R'_{66}$ in formulas (Cp'-11) and (Cp'-12) preferably have at least one substituent selected from an $R_{71}OCO$— group, $HOSO_2$— group, HO— group, $R_{72}NHCO$— group, and $R_{72}NHSO_2$— group. $R_{71}$ represents a hydrogen atom, alkyl group (e.g., methyl, ethyl, propyl, isopropyl, butyl, and t-butyl) having 6 or less carbon atoms, or phenyl group. $R_{72}$ represents a group represented by $R_{71}$, $R_{74}CO$— group, $R_{74}N(R_{75})CO$— group, $R_{73}SO_2$— group, or $R_{74}N(R_{75})SO_2$— group. $R_{73}$ represents an alkyl group (e.g., methyl, ethyl, propyl, isopropyl, butyl, or t-butyl) having 6 or less carbon atoms, or phenyl group. Each of $R_{74}$ and $R_{75}$ represents a group represented by $R_{71}$. These groups can further have a substituent.

$R'_{51}$ to $R'_{66}$, a, b, d, e, and f will be described in detail below. In the following description, $R'_{41}$ represents an alkyl group, aryl group, or heterocyclic group. $R'_{42}$ represents an aryl group or heterocyclic group. Each of $R'_{43}$, $R'_{44}$, and $R'_{45}$ represents a hydrogen atom, alkyl group, aryl group, or heterocyclic group.

$R'_{51}$ represents the same meaning as $R'_{41}$. a represents 0 or 1. Each of $R'_{52}$ and $R'_{53}$ represents the same meaning as $R'_{43}$. If $R'_{52}$ is not a hydrogen atom in formula (Cp'-2), $R'_{52}$ and $R'_{51}$ can combine with each other to form a 5- to 7-membered ring. b represents 0 or 1.

$R'_{54}$ represents a group having the same meaning as $R'_{41}$, $R'_{41}CON(R'_{43})$— group, $R'_{41}SO_2N(R'_{43})$— group, $R'_{41}N(R'_{43})$— group, $R'_{41}S$— group, $R'_{43}O$— group, or $R'_{45}N(R'_{43})CON(R'_{44})$— group. $R'_{55}$ represents a group having the same meaning as $R'_{41}$.

Each of $R'_{56}$ and $R'_{57}$ independently represents a group having the same meaning as $R'_{43}$, $R'_{41}S$— group, $R'_{43}O$— group, $R'_{41}CON(R'_{43})$— group, $R'_{41}OCON(R'_{43})$— group, or $R'_{41}SO_2N(R'_{43})$— group.

$R'_{58}$ represents a group having the same meaning as $R'_{43}$. $R'_{59}$ represents a group having the same meaning as $R'_{41}$, $R'_{41}CON(R'_{43})$— group, $R'_{41}OCON(R'_{43})$— group, $R'_{41}SO_2N(R'_{43})$— group, $R'_{43}N(R'_{44})CON(R'_{45})$— group, $R'_{41}O$— group, $R'_{41}S$— group, halogen atom, or $R'_{41}N(R'_{43})$— group. d represents 0 to 3. If d is the plural number, a plurality of $R'_{59}$'s represent the same substituent or different substituents.

$R'_{60}$ represents a group having the same meaning as $R'_{43}$.

$R'_{61}$ represents a group having the same meaning as $R'_{43}$, $R'_{43}OSO_2$— group, $R'_{43}N(R'_{44})SO_2$— group, $R'_{43}OCO$— group, $R'_{43}N(R'_{44})CO$— group, cyano group, $R'_{41}SO_2N(R'_{43})CO$— group, $R'_{43}CON(R'_{44})CO$— group, $R'_{43}N(R'_{44})SO_2N(R'_{45})CO$— group, $R'_{43}N(R'_{44})CON(R'_{45})CO$— group, $R'_{43}N(R'_{44})SO_2N(R'_{45})SO_2$— group, or $R'_{43}N(R'_{44})CON(R'_{45})SO_2$— group.

$R'_{62}$ represents a group having the same meaning as $R'_{41}$, $R'_{41}CONH$— group, $R'_{41}OCONH$— group, $R'_{41}SO_2NH$— group, $R'_{43}N(R'_{44})CONH$— group, $R'_{43}N(R'_{44})SO_2NH$— group, $R'_{43}O$— group, $R'_{41}S$— group, halogen atom, or $R'_{41}N(R'_{43})$— group. In formula (Cp'-8), e represents an integer from 0 to 4. If e is 2 or more, a plurality of $R'_{62}$'s represent the same substituent or different substituents.

$R'_{63}$ represents a group having the same meaning as $R'_{41}$, $R'_{43}CON(R'_{44})$— group, $R'_{43}N(R'_{44})CO$— group, $R'_{41}SO_2N(R'_{43})$— group, $R'_{41}N(R'_{43})SO_2$— group, $R'_{41}SO_2$— group, $R'_{43}OCO$— group, $R'_{43}OSO_2$— group, halogen atom, nitro group, cyano group, or $R'_{43}CO$— group. In formula (Cp'-9), e represents an integer from 0 to 4. If e is 2 or more, a plurality of $R'_{63}$'s represent the same substituent or different substituents. In formula (Cp'-10), f represents an integer from 0 to 3. If f is 2 or more, a plurality of $R'_{63}$'s represent the same substituent or different substituents.

Each of $R'_{64}$, $R'_{65}$, and $R'_{66}$ independently represents a group having the same meaning as $R'_{43}$, $R'_{41}S$— group, $R'_{43}O$— group, $R'_{41}CON(R'_{43})$— group, $R'_{41}SO_2N(R'_{43})$— group, $R'_{41}OCO$— group, $R'_{41}OSO_2$— group, $R'_{41}SO_2$— group, $R'_{41}N(R'_{43})CO$— group, $R'_{41}N(R'_{43})SO_2$— group, nitro group, or cyano group.

In the above description, an aliphatic group represented by $R'_{41}$, $R'_{43}$, $R'_{44}$, or $R'_{45}$ is a 1- to 10-carbon, preferably 1- to 6-carbon, saturated or unsaturated, chainlike or cyclic, straight-chain or branched, substituted or nonsubstituted aliphatic group. Representative examples of this aliphatic group are methyl, 1-propenyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyl, and n-decyl.

An aryl group represented by $R'_{41}$, $R'_{42}$, $R'_{43}$, $R'_{44}$, or $R'_{45}$ is a 6- to 10-carbon aryl group, preferably substituted or nonsubstituted phenyl or substituted or nonsubstituted naphthyl.

A heterocyclic group represented by $R'_{41}$, $R'_{42}$, $R'_{43}$, $R'_{44}$, or $R'_{45}$ is a 1- to 10-carbon, preferably 1- to 6-carbon, preferably 3- to 8-membered, substituted or nonsubstituted heterocyclic group which contains a hetero-atom selected from a nitrogen atom, oxygen atom, and sulfur atom. Representative examples of this heterocyclic group are 2-pyridyl, 2-benzoxazolyl, 2-imidazolyl, 2-benzimidazolyl, 1-indolyl, 1,3,4-thiadiazole-2-yl, 1,2,4-triazole-2-yl, and 1-indolynyl.

If the aliphatic group, aryl group, and heterocyclic group described above have substituents, representative examples of the substituents are a halogen atom, $R'_{43}O$— group, $R'_{41}S$— group, $R'_{43}CON(R'_{44})$— group, $R'_{43}N(R'_{44})CO$— group, $R'_{41}OCON(R'_{43})$— group, $R'_{41}SO_2N(R'_{43})$— group, $R'_{43}N(R'_{44})SO_2$— group, $R'_{41}SO_2$— group, $R'_{43}OC$— group, $R'_{41}SO_2O$— group, group having the same meaning as $R'_{41}$, $R'_{43}N(R'_{44})$— group, $R'_{41}CO_2$— group, $R'_{41}OSO_2$— group, cyano group, and nitro group.

Preferable ranges of $R'_{51}$ to $R'_{66}$, a, b, d, e, and f will be described below.

$R'_{51}$ is preferably an aliphatic group or aryl group. a is most preferably 1. Each of $R'_{52}$ and $R'_{55}$ is preferably an aryl group. If b is 1, $R'_{53}$ is preferably an aryl group; if b is 0, $R'_{53}$ is preferably a heterocyclic group. $R'_{54}$ is preferably an $R'_{41}CON(R'_{43})$— group or $R'_{41}N(R'_{43})$— group. Each of $R'_{56}$ and $R'_{57}$ is preferably an aliphatic group, aryl group, $R'_{41}O$— group, or $R'_{41}S$— group. $R'_{58}$ is preferably an aliphatic group or aryl group.

In formula (Cp'-6), $R'_{59}$ is preferably a chlorine atom, aliphatic group, or $R'_{41}CON(R'_{43})$— group, and d is preferably 1 or 2. $R'_{60}$ is preferably an aryl group. In formula (Cp'-7), $R'_{59}$ is preferably an $R'_{41}CON(R'_{43})$— group, and d is preferably 1. $R'_{61}$ is preferably an $R'_{43}OSO_2$— group, $R'_{43}N(R'_{44})SO_2$— group, $R'_{43}OCO$— group, $R'_{43}N(R'_{44})CO$—, cyano group, $R'_{41}SO_2N(R'_{43})CO$— group, $R'_{43}CON(R'_{44})CO$— group, $R'_{43}N(R'_{44})SO_2N(R'_{45})CO$— group, or $R'_{43}N(R'_{44})CON(R'_{45})CO$— group.

In formula (Cp'-8), e is preferably 0 or 1. $R'_{62}$ is preferably an $R'_{41}OCON(R'_{43})$— group, $R'_{41}CON(R'_{43})$— group, or $R'_{41}SO_2N(R'_{43})$— group, and the substitution position of any of these substituents is preferably the (5) position of a naphthol ring.

In formula (Cp'-9), $R'_{63}$ is preferably an $R'_{41}CON(R'_{43})$— group, $R'_{41}SO_2N(R'_{43})$— group, $R'_{41}N(R'_{43})SO_2$— group, $R'_{41}SO_2$— group, $R'_{41}N(R'_{43})CO$— group, nitro group, or cyano group. e is preferably 1 or 2.

In formula (Cp'-10), $R'_{63}$ is preferably an $R'_{43}N(R'_{44})CO$— group, $R'_{43}OCO$— group, or $R'_{43}CO$— group. f is preferably 1 or 2.

In formulas (Cp'-11) and (Cp'-12), each of $R'_{64}$ and $R'_{65}$ is preferably an $R'_{41}OCO$— group, $R'_{41}OSO_2$— group, $R'_{41}SO_2$— group, $R'_{44}N(R'_{43})CO$— group, $R'_{44}N(R'_{43})SO_2$— group, or cyano group, and most preferably, an $R'_{41}OCO$— group, $R'_{44}N(R'_{43})CO$— group, or cyano group. $R'_{66}$ is preferably a group having the same meaning as $R'_{41}$. The total number of carbon atoms, including those of the substituent(s) that attaches thereto, of each of $R'_{51}$ to $R'_{66}$ is preferably 18 or less, and more preferably, 10 or less.

A photographically useful group represented by BI or PUG will be described below.

A photographically useful group represented by Bl or PUG can be any photographically useful group known to those skilled in the art.

Examples include development inhibitors, bleaching accelerators, dyes, bleaching inhibitors, couplers, developing agents, development auxiliaries, reducing agent, silver halide solvents, silver complex forming agents, fixers, image toner, stabilizers, film hardeners, tanning agents, fogging agents, ultraviolet absorbents, antifoggants, nucleating agents, chemical or spectral sensitizers, desensitizers, and brightening agents. However, PUG is not limited to these examples.

Preferable examples of B1 or PUG are development inhibitors (e.g., development inhibitors described in U.S. Pat. Nos. 3,227,554, 3,384,657, 3,615,506, 3,617,291, 3,733,201, and 5,200,306, and British Patent No. 1450479), bleaching accelerators (e.g., bleaching accelerators described in Research Disclosure 1973, Item No. 11449 and European Patent No. 193389, and those described in JP-A-61-201247, JP-A-4-350848, JP-A-4-350849, and JP-A-4-350853), development auxiliaries (e.g., development auxiliaries described in U.S. Pat. No. 4,859,578 and JP-A-10-48787), development accelerators (e.g., development accelerators described in U.S. Pat. No. 4,390,618 and JP-A-2-56543), reducing agents (e.g., reducing agents described in JP-A-63-109439 and JP-A-63-128342), and brightening agents (e.g., brightening agents described in U.S. Pat. Nos. 4,774,181 and 5,236,804, all the disclosures of which are herein incorporated by reference). The pKa of conjugate acid of B1 or PUG is preferably 13 or less, and more preferably, 11 or less.

B1 or PUG is more preferably a development inhibitor or a bleaching accelerator.

Preferable development inhibitors are a mercaptotetrazole derivative, a mercaptotriazole derivative, a mercaptothiadiazole derivative, a mercaptoxadiazole derivative, a mercaptoimidazole derivative, a mercaptobenzimidazole derivative, a mercaptobenzthiazole derivative, a mercaptobenzoxazole derivative, a tetrazole derivative, a 1,2,3-triazole derivative, a 1,2,4-triazole derivative, and a benzotriazole derivative.

More preferable development inhibitors are represented by formulas DI-1 to DI-6 below.

DI-1

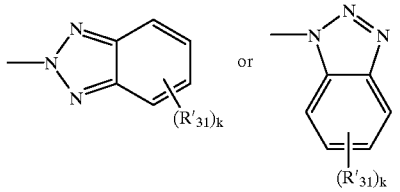

DI-2

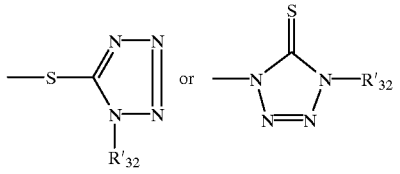

DI-3

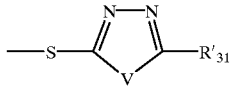

DI-4

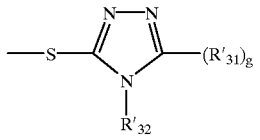

DI-5

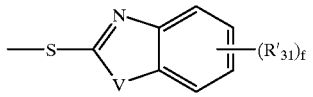

DI-6

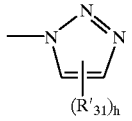

wherein $R'_{31}$ represents a halogen atom, $R'_{46}O$— group, $R'_{46}S$— group, $R'_{47}CON(R'_{48})$— group, $R'_{47}N(R'_{48})CO$— group, $R'_{46}0CON(R'_{47})$— group, $R'_{46}O_2(R'_{47})$— group, $R'_{47}N(R'_{48})SO_2$ group, $R'_{46}SO_2$— group, $R'_{47}OCO$— group, $R'_{47}N(R'_{48})CON(R'_{49})$— group, $R'_{47}CON(R'_{48})$ $SO_2$— group, $R'_{47}N(R'_{48})CON(R'_{49})SO_2$— group, group having the same meaning as $R'_{46}$, $R'_{47}N(R'_{48})$— group, $R'_{46}CO_2$— group, $R'_{47}OSO_2$— group, cyano group, or nitro group.

$R'_{46}$ represents an aliphatic group, aryl group, or heterocyclic group. Each of $R'_{47}$, $R'_{48}$, and $R'_{49}$ represents an aliphatic group, aryl group, heterocyclic group, or hydrogen atom. An aliphatic group represented by $R'_{46}$, $R'_{47}$, $R'_{48}$, or $R'_{49}$ is a 1- to 32-carbon, preferably 1- to 20-carbon, saturated or unsaturated, chainlike or cyclic, straight-chain or branched, substituted or nonsubstituted aliphatic group. Representative examples are methyl, cyclopropyl, isopropyl, isopropenyl, n-butyl, t-butyl, i-butyl, t-amyl, n-hexyl, cyclohexyl, 2-ethylhexyl, n-octyl, 1,1,3,3-tetramethylbutyl, and n-decyl.

An aryl group represented by $R'_{46}$, $R'_{47}$, $R'_{48}$, or $R'_{49}$ is a 6- to 32-carbon aryl group, preferably substituted or nonsubstituted phenyl or substituted or nonsubstituted naphthyl.

A heterocyclic group represented by $R'_{46}$, $R'_{47}$, $R'_{48}$, or $R'_{49}$ is a 1- to 32-carbon, preferably 1- to 20-carbon, preferably 3- to 8-membered, substituted or nonsubstituted heterocyclic group which contains a hetero-atom selected from a nitrogen atom, oxygen atom, and sulfur atom. Representative examples of this heterocyclic group are 2-pyridyl, 2-benzoxazolyl, 2-imidazolyl, 2-benzimidazolyl, 1-indolyl, 1,3,4-thiodiazole-2-yl, 1,2,4-triazole-2-yl, or 1-indolinyl.

$R'_{32}$ represents a group having the same meaning as $R'_{46}$.

k represents an integer from 1 to 4, g represents 0 or 1, and h represents 1 or 2.

V represents an oxygen atom, sulfur atom, or —$N(R'_{46})$—.

$R'_{31}$ and $R'_{32}$ can further have a substituent.

Preferable bleaching accelerators are as follows.

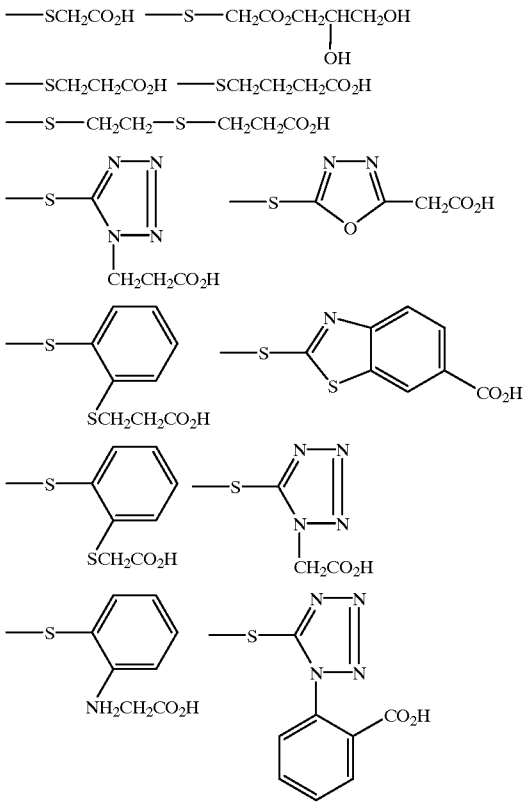

-continued

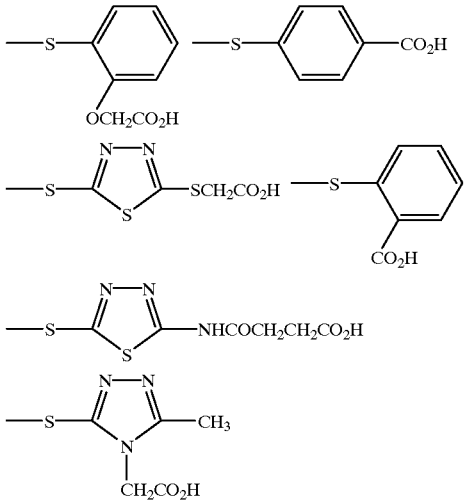

(The groups attach to COUP through free bonding)

A group represented by TIME will be described next.

A group represented by TIME can be any connecting group which can cleave PUG after being cleaved from COUP1 during development. Examples are a group described in U.S. Pat. Nos. 4,146,396, 4,652,516, or 4,698,297, which uses a cleavage reaction of hemiacetal; a timing group described in U.S. Pat. Nos. 4,248,962, 4,847,185, or 4,857,440, which causes a cleavage reaction by using an intramolecular nucleophilic substitution reaction; a timing group described in U.S. Pat. Nos. 4,409,323 or 4,421,845, which causes a cleavage reaction by using an electron transfer reaction; a group described in U.S. Pat. No. 4,546,073, which causes a cleavage reaction by using a hydrolytic reaction of iminoketal; and a group described in West German Patent 2626317, which causes a cleavage reaction by using a hydrolytic reaction of ester, all the disclosures of which are herein incorporated by reference. At a hetero-atom, preferably an oxygen atom, sulfur atom, or nitrogen atom contained in it, TIME bonds to COUPl in formula (IIa) or (IIb). Preferable examples of TIME are formulas (T-1), (T-2), and (T-3) below.

$$*—W—(X=Y)_j—C(R_{21})R_{22}—** \quad (T\text{-}1)$$

$$*—W—CO—** \quad (T\text{-}2)$$

$$*—W—LINK—E1—** \quad (T\text{-}3)$$

wherein * represents a position where TIME bonds to COUP1 in formula (IIa) or (IIb), ** represents a position where TIME bonds to PUG or another TIME (if m is the plural number), W represents an oxygen atom, a sulfur atom, or >N—$R_{23}$, each of X and Y represents methine or a nitrogen atom, j represents 0, 1, or 2, and each of $R_{21}$, $R_{22}$, and $R_{23}$ represents a hydrogen atom or a substituent. If X and Y represent substituted methine, this substituent and any two substituents of each of $R_{21}$, $R_{22}$, and $R_{23}$ can connect to form a cyclic structure (e.g., a benzene ring or a pyrazole ring). In formula (T-3), E1 represents an electrophilic group. LINK represents a connecting group which three-dimensionally relates W to El so as to allow an intramolecular nucleophilic substitution reaction.

Practical examples of TIME represented by formula (T-1) are as follows.

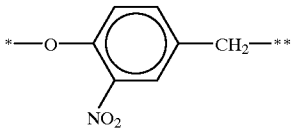
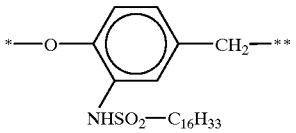
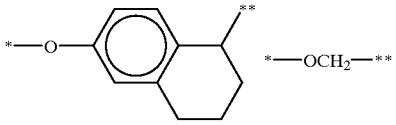
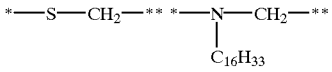
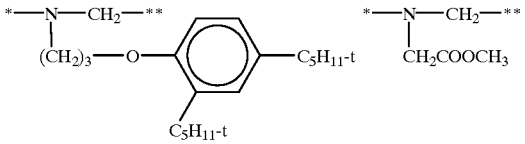
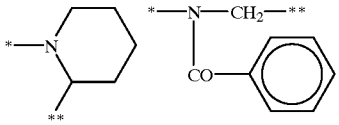
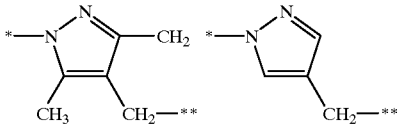
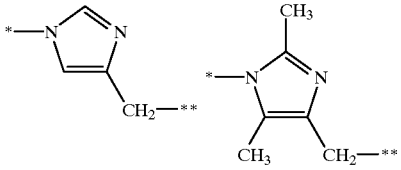
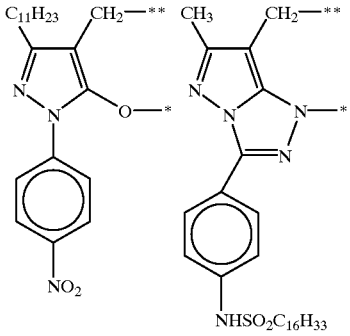
-continued
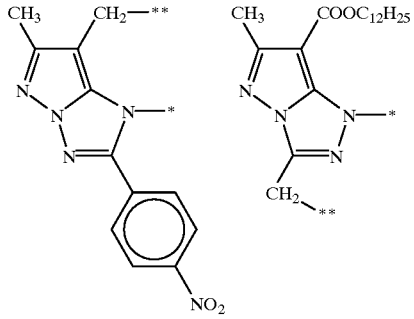
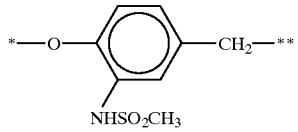
Practical examples of TIME represented by formula (T-2) are as follows.
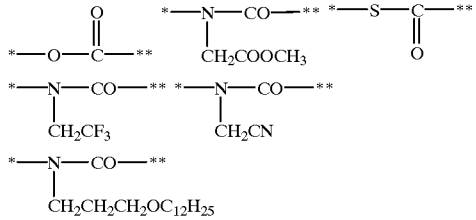
Practical examples of TIME represented by formula (T-3) are as follows.
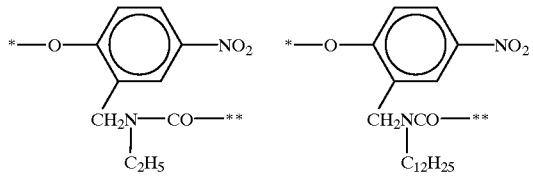
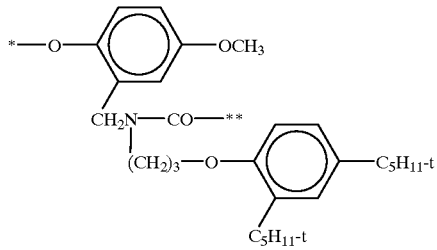
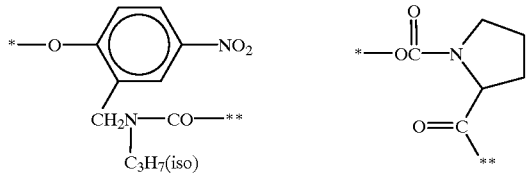
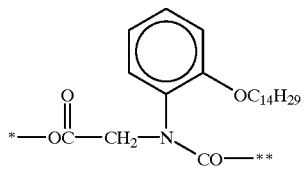

-continued

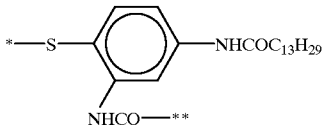

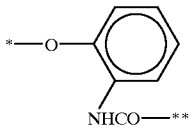

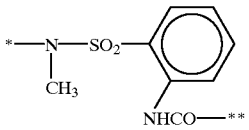

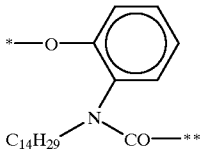

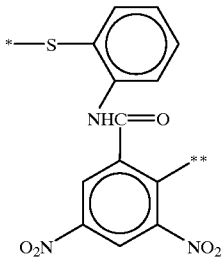

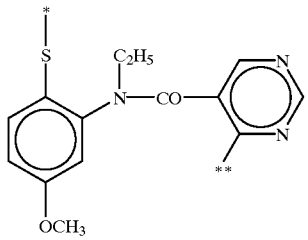

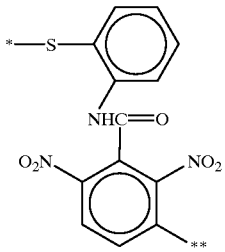

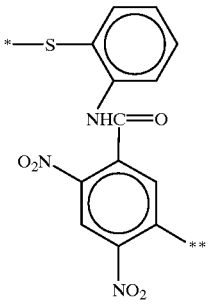

If m is 2 in formula (IIa), practical examples of $(TIME)_m$ are as follows.

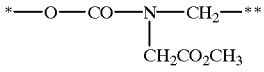

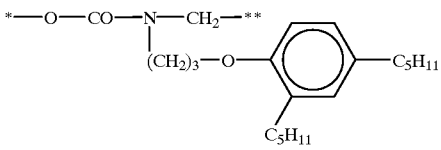

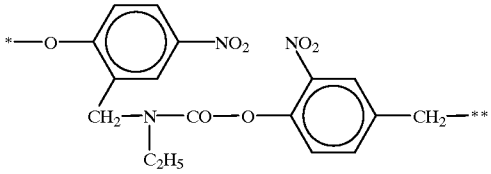

-continued

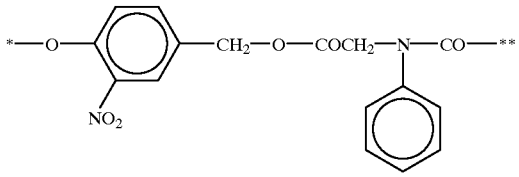

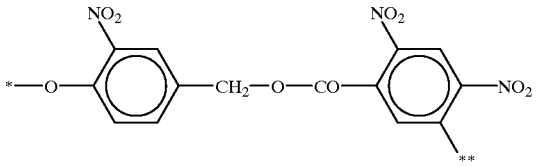

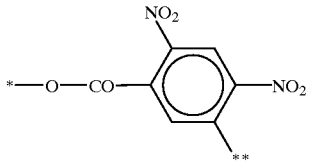

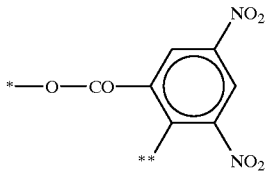

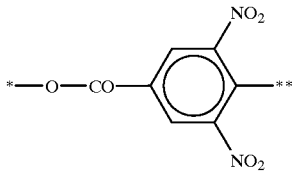

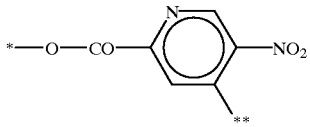

A group represented by RED in formula (IIb) will be described below. RED is a group which cleaves from COUP1 or TIME to form RED-PUG and can be cross-oxidized by an acidic substance, such as the oxidized form of a developing agent, present during development. RED-PUG can be any compound as long as it cleaves PUG when oxidized. Examples of RED are hydroquinones, catechols, pyrogallols, 1,4-naphthohydroquinones, 1,2-naphthohydroquinones, sulfonamidophenols, hydrazides, and sulfonamidonaphthols. Practical examples of these groups are described in JP-A-61-230135, JP-A-62-251746, JP-A-61-278852, U.S. Pat. Nos. 3,364,022, 3,379,529, 4,618,571, 3,639,417, and 4,684,604, and J. Org. Chem., Vol. 29, page 588 (1964), all the disclosures of which are herein incorporated by reference.

Of these compounds, preferable examples of RED are hydroquinones, 1,4-naphthohydroquinones, 2-(or 4-)sulfonamidophenols, pyrogallols, and hydrazides. Of these compounds, a redox group having a phenolic hydroxyl group combines with COUPl or TIME at an oxygen atom of the phenol group.

In order for a compound represented by formula (IIa) or (IIb) to be fixed to a photosensitive layer or a non-light-sensitive layer to which the compound is added before a silver halide light-sensitive material containing the compound represented by formula (IIa) or (IIb) is developed, a compound represented by formula (IIa) or (IIb) preferably has a nondiffusing group. Most preferably, this nondiffusing group is contained in TIME or RED. Preferable examples of the nondiffusing group are an 8- to 40-carbon, preferably 12- to 32-carbon alkyl group, and an 8- to 40-carbon, preferably 12- to 32-carbon aryl group having at least one alkyl group (having 3 to 20 carbon atoms), alkoxy group (having 3 to 20 carbon atoms), or aryl group (having 6 to 20 carbon atoms).

Methods of synthesizing compounds represented by formulas (IIa) and (IIb) are described in, e.g., the known patents and references cited to explain TIME, RED, and PUG, JP-A-61-156127, JP-A-58-160954, JP-A-58-162949, JP-A-61-249052, JP-A-63-37350, U.S. Pat. No. 5,026,628, and European Patent Publication Nos. 443530A2 and 444501A2, all the disclosures of which are herein incorporated by reference.

A photographically useful group-releasing compound represented by formula (III) will be described below.

COUP2-A-E-B2 (III)

wherein COUP2 represents a coupler moiety capable of coupling with the oxidized form of a developing agent, E represents an electrophilic portion, A represents a connecting group capable of releasing B2 with ring formation by an intramolecular nucleophilic substitution reaction of a nitrogen atom, which arises from the developing agent in the product of coupling between COUP2 and the oxidized form of the developing agent and which directly bonds to the coupling position, with the nucleophilic portion E, and B2 represents a photographically useful group or its precursor.

As a coupler moiety represented by COUP2, coupler moieties generally known as photographic couplers can be used. Examples are yellow coupler moieties (e.g., open-chain ketomethine type coupler moieties such as acylactanilide and malondianilide), magenta coupler moieties (e.g., 5-pyrazolon type and pyrazolotriazole type coupler moieties), and cyan coupler moieties (e.g., phenol type, naphthol type, and pyrrolotriazole type coupler moieties). It is also possible to use yellow, magenta, and cyan dye forming couplers having novel skeletons described in, e.g., U.S. Pat. No. 5,681,689, JP-A-7-128824, JP-A-7-128823, JP-A-6-222526, JP-A-9-258400, JP-A-9-258401, JP-A-9-269573, and JP-A-6-27612, the disclosures of which are herein incorporated by reference. Other coupler moieties can also be used (e.g., coupler moieties described in U.S. Pat. Nos. 3,632,345 and 3,928,041, which form a colorless substance by reacting with the oxidized form of an aromatic amine-based developing agent and coupler moieties described in U.S. Pat. Nos. 1,939,231 and 2,181,944, the disclosures of which are herein incorporated by reference, which form a black or intermediate-color substance by reacting with the oxidized form of an aromatic amine-based developing agent).

The bonding position of COUP2 and the connecting group A can be any position provided that after a coupler and the oxidized form of a developing agent couple with each other, B can be released with ring formation by an intramolecular nucleophilic substitution reaction of a nitrogen atom, which arises from the developing agent in the coupling product and directly bonds to the coupling position, with the electrophilic portion E. The position is preferably the coupling position of COUP2 or its nearby position (an atom adjacent to the coupling position or an atom adjacent to this atom adjacent to the coupling position), and more preferably, the nearby position (an atom adjacent to the coupling position or an atom adjacent to this atom adjacent to the coupling position) of the coupling position of COUP2.

When the connecting group A bonds to 1) the coupling position of a coupler moiety represented by COUP2, 2) an atom adjacent to the coupling position, and 3) an atom adjacent to the atom adjacent to the coupling position, a reaction between a coupler of the present invention and the oxidized form (Ar'═NH) of an aromatic amine-based developing agent represented by $ArNH_2$ can be represented by the following formulas.

1) The case where A bonds to the coupling position of COUP 2

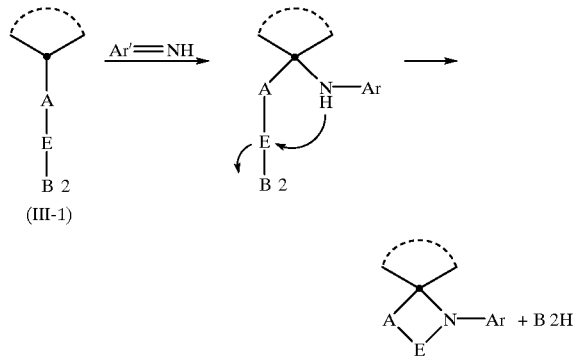

2) The case where A bonds to the atom adjacent to the coupling position of COUP 2

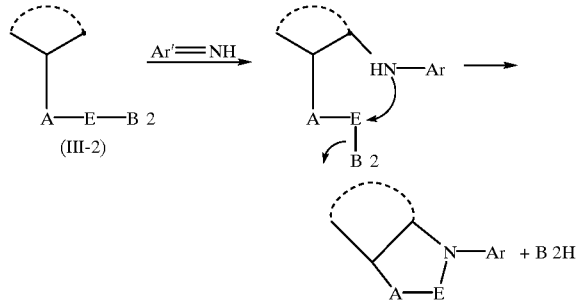

3) The case where A bonds to the atom adjacent to the adjacent atom of the coupling position of COUP 2

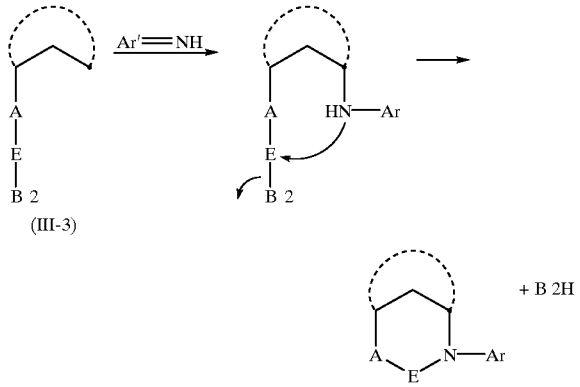

Each of

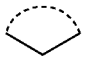

and

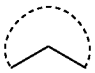

represents a coupler residue capable of coupling with a developer in an oxidized form, which is not necessarily a circular structure. The mark, •, represents the coupling position. The linear part, —, represents a bonding between non-metalic atoms.

Preferable examples of COUP2 of the present invention will be presented below, but COUP2 is not limited to these examples.

(III-1A)

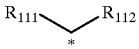

(III-2A)

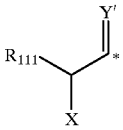

(III-1B)

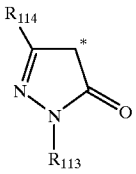

(III-2B)

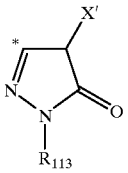

(III-1C)

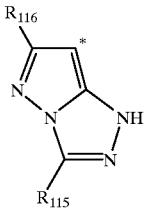

(III-2C)

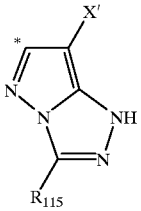

-continued (III-1D)

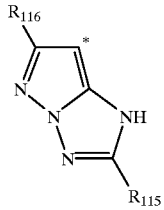

(III-2D)

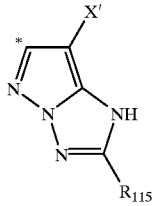

(III-1E)

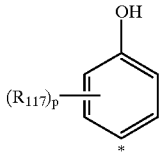

(III-2E)

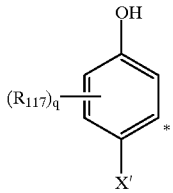

(III-1F)

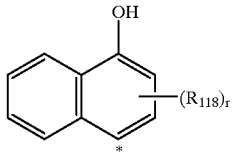

(III-2F)

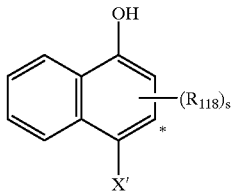

(III-3F)

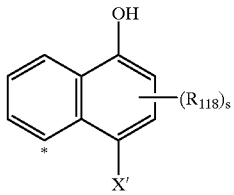

-continued (III-1G)

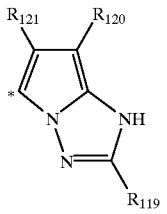

(III-2G)

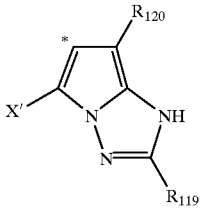

wherein *represents a position where COUP2 bonds to A, X' represents a hydrogen atom, a halogen atom (e.g., a fluorine atom, chlorine atom, bromine atom, or iodine atom), $R_{131}$—, $R_{131}O$—, $R_{131}S$—, $R_{131}OCOO$—, $R_{132}COO$—, $R_{132}(R_{133})NCOO$—, or $R_{132}CON(R_{133})$—, Y, represents an oxygen atom, sulfur atom, $R_{132}N$═, or $R_{132}ON$═.

$R_{131}$ represents an aliphatic group (an "aliphatic group" means a saturated or unsaturated, chainlike or cyclic, straight-chain or branched, substituted or nonsubstituted aliphatic hydrocarbon group, and an aliphatic group used in the following description has the same meaning), aryl group, or heterocyclic group.

An aliphatic group represented by $R_{131}$ is an aliphatic group having preferably 1 to 32 carbon atoms, and more preferably, 1 to 22 carbon atoms. Examples are methyl, ethyl, vinyl, ethynyl, propyl, isopropyl, 2-propenyl, 2-propynyl, butyl, isobutyl, t-butyl, t-amyl, hexyl, cyclohexyl, 2-ethylhexyl, octyl, 1,1,3,3-tetramethylbutyl, decyl, dodecyl, hexadecyl, and octadecyl. "The number of carbon atoms" is the total number of carbon atoms including carbon atoms of the substituent that attaches to the above mentioned aliphatic group. The number of carbon atoms of a group other than an aliphatic group also means the total number of carbon atoms including carbon atoms of a substituent.

An aryl group represented by $R_{131}$ is a substituted or nonsubstituted aryl group having preferably 6 to 32 carbon atoms, and more preferably, 6 to 22 carbon atoms. Examples are phenyl, tolyl, and naphthyl.

A heterocyclic group represented by $R_{131}$ is a substituted or nonsubstituted heterocyclic group having preferably 1 to 32 carbon atoms, and more preferably, 1 to 22 carbon atoms. Examples are 2-furyl, 2-pyrrolyl, 2-thienyl, 3-tetrahydrofuranyl 4-pyridyl, 2-pyrimidinyl, 2-(1,3,4-thiadiazolyl), 2-benzothiazolyl, 2-benzoxazolyl, 2-benzoimidazolyl, 2-benzoselenazolyl, 2-quinolyl, 2-oxazolyl, 2-thiazolyl, 2-selenazolyl, 5-tetrazolyl, 2-(1,3,4-oxadiazolyl), and 2-imidazolyl.

Each of $R_{132}$ and $R_{133}$ independently represents a hydrogen atom, aliphatic group, aryl group, or heterocyclic group. An aliphatic group, aryl group, and heterocyclic group represented by $R_{132}$ and $R_{133}$ have the same meanings as $R_{131}$.

Preferably, X' represents a hydrogen atom, aliphatic group, aliphatic oxy group, aliphatic thio group, or $R_{132}CON(R_{133})$—, and Y' represents an oxygen atom.

Examples of substituents suited to the groups described above and groups to be described below and examples of "substituents" to be described below are a halogen atom (e.g., a fluorine atom, chlorine atom, bromine atom, and iodine atom), hydroxyl group, carboxyl group, sulfo group, cyano group, nitro group, alkyl group (e.g., methyl, ethyl, and hexyl), fluoroalkyl group (e.g., trifluoromethyl), aryl group (e.g., phenyl, tolyl, and naphthyl), heterocyclic group (e.g., a heterocyclic group having the same meaning as $R_{131}$), alkoxy group (e.g., methoxy, ethoxy, and octyloxy), aryloxy group (e.g., phenoxy and naphthyloxy), alkylthio group (e.g., methylthio and butylthio), arylthio group (e.g., phenylthio), amino group (e.g., amino, N-methylamino, N,N-dimethylamino, and N-phenylamino), acyl group (e.g., acetyl, propionyl, and benzoyl), alkylsulfonyl or arylsulfonyl group (e.g., methylsulfonyl and phenylsulfonyl), acylamino group (e.g., acetylamino and benzoylamino), alkylsulfonylamino or arylsulfonylamino group (e.g., methanesulfonylamino and benzenesulfonylamino), carbamoyl group (e.g., carbamoyl, N-methylaminocarbonyl, N,N-dimethylaminocarbonyl, and N-phenylaminocarbonyl), sulfamoyl group (e.g., sulfamoyl, N-methylaminosulfonyl, N,N-dimethylaminosulfonyl, and N-phenylaminosulfonyl), alkoxycarbonyl group (e.g., methoxycarbonyl, ethoxycarbonyl, and octyloxycarbonyl), aryloxycarbonyl group (e.g., phenoxycarbonyl and naphthyloxycarbonyl), acyloxy group (e.g., acetyloxy and benzoyloxy), alkoxycarbonyloxy group (e.g., methoxycarbonyloxy and ethoxycarbonyloxy), aryloxycarbonyloxy group (e.g., phenoxycarbonyloxy), alkoxycarbonylamino group (e.g., methoxycarbonylamino and butoxycarbonylamino), aryloxycarbonylamino group (e.g., phenoxycarbonylamino), aminocarbonyloxy group (e.g., N-methylaminocarbonyloxy and N-phenylaminocarbonyloxy), aminocarbonylamino group (e.g., N-methylaminocarbonylamino and N-phenylaminocarbonylamino).

Each of $R_{111}$ and $R_{112}$ independently represents $R_{132}C$—, $R_{131}OCO$—, $R_{132}(R_{133})NCO$—, $R_{131}SO_n$—, $R_{132}(R_{133})NSO_2$—, or a cyano group. $R_{131}$, $R_{132}$, and $R_{133}$ have the same meanings as above. n represents 1 or 2.

$R_{113}$ represents a group having the same meaning as $R_{131}$.

$R_{114}$ represents $R_{132}$—, $R_{132}CON(R_{133})$—, $R_{132}(R_{133})N$—, $R_{131}SO_2N(R_{132})$—, $R_{131}S$—, $R_{131}O$—, $R_{131}OCON(R_{132})$—, $R_{132}(R_{133})NCON(R_{134})$—, $R_{131}OCO$—, $R_{132}(R_{133})NCO$—, or a cyano group. $R_{131}$, $R_{132}$, and $R_{133}$ have the same meanings as above. $R_{134}$ represents a group having the same meaning as $R_{132}$.

Each of $R_{115}$ and $R_{116}$ independently represents a substituent, preferably $R_{132}$—, $R_{132}CON(R_{133})$—, $R_{131}SO_2N(R_{132})$—, $R_{131}S$—, $R_{131}O$—, $R_{131}OCON(R_{132})$—, $R_{132}(R_{133})NCON(R_{134})$—, $R_{131}OCO$—, $R_{132}(R_{133})NCO$—, a halogen atom, or a cyano group, and more preferably, a group represented by $R_{131}$. $R_{131}$, $R_{132}$, $R_{133}$, and $R_{134}$ have the same meanings as above.

$R_{117}$ represents a substituent, p represents an integer from 0 to 4, and q represents an integer from 0 to 3. Preferable examples of a substituent represented by $R_{117}$ are $R_{131}$—, $R_{132}CON(R_{133})$—, $R_{131}OCON(R_{132})$—, $R_{131}SO_2N(R_{132})$—, $R_{132}(R_{133})NCON(R_{134})$—, $R_{131}S$—, $R_{131}O$—, and a halogen atom. $R_{131}$, $R_{132}$, $R_{133}$, and $R_{134}$ have the same meanings as above. If p and q are 2 or more, a plurality of $R_{117}$'s can be the same or different, and adjacent $R_{117}$'s can combine with each other to form a ring. In preferable forms of formulas (III-1E) and (III-2E), at least one ortho position of a hydroxyl group is substituted by $R_{132}CONH$—, $R_{131}OCONH$—, or $R_{132}(R_{133})NCONH$—.

$R_{118}$ represents a substituent, r presents an integer from 0 to 6, and s represents an integer from 0 to 5. Preferable examples of a substituent represented by $R_{118}$ are $R_{132}CON(R1_{133})$—, $R_{131}OCON(R_{132})$—, $R131SO_2N(R_{132})$—, $R_{132}(R_{133})NCON(R_{134})$—, $R_{131}S$—, $R_{131}O$—, $R_{132}(R_{133})NCO$—, $R_{132}(R_{133})NSO_2$—, $R_{131}OCO$—, a cyano group, and halogen atom. $R_{131}$, $R_{132}$, $R_{133}$, and $R_{134}$ have the same meanings as above. If r and s are 2 or more, a plurality of $R_{118}$'s can be the same or different, and adjacent $R_{118}$'s can combine with each other to form a ring. In preferable forms of formulas (III-1F), (III-2F), and (III-3F), an ortho position of a hydroxyl group is substituted by $R_{132}CONH$—, $R_{132}HNCONH$—, $R_{132}(R_{133})NSO_2$—, or $R_{132}NHCO$—.

$R_{119}$ represents a substituent, preferably $R_{132}$—, $R_{132}CON(R_{133})$—, $R_{131}SO_2N(R_{132})$—, $R_{131}S$—, $R_{131}O$—, $R_{131}OCON(R_{132})$—, $R_{132}(R_{133})NCON(R_{134})$—, $R_{131}OCO$—, $R_{132}(R_{133})NSO_2$—, $R_{132}(R_{133})NCO$—, a halogen atom, or a cyano group, and more preferably, a group represented by $R_{131}$. $R_{131}$, $R_{132}$, $R_{133}$, and $R_{134}$ have the same meanings as above.

Each of $R_{120}$ and $R_{121}$ independently represents a substituent, preferably $R_{132}$—, $R_{132}CON(R_{133})$—, $R_{131}SO_2N(R_{132})$—, $R_{131}S$—, $R_{131}O$—, $R_{131}OCON(R_{132})$—, $R_{132}(R_{133})NCON(R_{134})$—, $R_{132}(R_{133})NCO$—, $R_{132}(R_{133})NSO_2$—, $R_{13}OCO$—, a halogen atom, or a cyano group, and more preferably, $R_{132}(R_{133})NCO$—, $R_{132}(R_{133})NSO_2$—, a trifluoromethyl group, $R_{131}OCO$—, or a cyano group. $R_{131}$, $R_{132}$, $R_{133}$, and $R_{134}$ have the same meanings as above.

E represents an electrophilic group such as —CO—, —CS—, —COCO—, —SO—, —$SO_2$—, —P(=O)($R_{151}$)—, or —P(=S)($R_{151}$)— {wherein $R_{151}$ represents an aliphatic group, aryl group, aliphatic oxy group, aryloxy group, aliphatic thio group, or arylthio group}, and preferably —CO—.

A represents a connecting group capable of releasing B2, with the formation of a ring (preferably a 3- to 7-membered ring, and more preferably, a 5- or 6-membered ring), by an intramolecular nucleophilic substitution reaction of a nitrogen atom, which arises from a developing agent in the product of coupling between COUP2 and the oxidized form of the developing agent and which directly bonds to the coupling position, with the electrophilic portion E. A preferable form of A can be represented by formula (IV) below.

(IV)

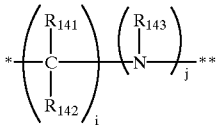

wherein * represents a portion connecting with COUP2, and ** represents a portion connecting with E. Each of $R_{141}$, $R_{142}$, $R_{143}$ independently represents a group having the same meaning as $R_{132}$. i represents an integer from 0 to 3, and j represents an integer from 0 to 2. $R_{141}$ or $R_{142}$ can combine with COUP2 or $R_{143}$ to form a ring, or $R_{141}$ and $R_{142}$ can combine with each other to form a spiro ring. If i is 2 or 3, a plurality of $R_{141}$'s or $R_{142}$'s can be the same or different, and adjacent $R_{141}$'s or $R_{142}$'s can combine with each other to form a ring. Each of $R_{141}$ and $R_{142}$ is preferably a hydrogen atom or a (1- to 20-carbon, preferably 1- to 10-carbon) aliphatic group, and more preferably, a hydrogen atom. $R_{143}$ is preferably a 1- to 32-carbon aliphatic group, and more preferably, a 1- to 22-carbon aliphatic group, and can combine with COUP2 to form a ring. If j is 2, two $R_{143}$'s can be the same or different, and adjacent $R_{143}$'s can form a ring. j is preferably 1. i is preferably 1 or 2 in formula (III-1) {(III-1A), (III-1B), (III-1C), (III-1D), (III-1E), (III-1F), and (III-1G)}. i is preferably 0 or 1 in formula (III-2) {(III-2A), (III-2B), (III-2C), (III-2D), (III-2E), (III-2F), and (III-2G). i is preferably 0 in formula (III-3) {(III-3F)}.

B2 represents a photographically useful group or its precursor. A preferable form of B2 is represented by formula (V) below.

$$\#\text{-}(T)_k\text{-PUG} \qquad (V)$$

wherein # represents a portion connecting with E, T represents a timing group capable of releasing PUG after being released from E, k represents an integer from 0 to 2, preferably 0 or 1, and PUG represents a photographically useful group.

Examples of a timing group represented by T are a group described in U.S. Pat. No. 4,146,396, 4,652,516, or 4,698,297, the disclosures of which are herein incorporated by reference which releases PUG by using a cleavage reaction of hemiacetal; a group described in JP-A-9-114058 or U.S. Pat. Nos. 4,248,962, 5,719,017, or 5,709,987, which releases PUG by using an intramolecular ring closure reaction; a group described in JP-B-54-39727, JP-A-57-136640, JP-A-57-154234, JP-A-4-261530, JP-A-4-211246, JP-A-6-324439, JP-A-9-114058, or U.S. Pat. Nos. 4,409,323 or 4,421,845, which releases PUG by using electron transfer via X electrons; a group described in JP-A-57-179842, JP-A-4-261530, or JP-A-5-313322, which releases PUG by generating carbon dioxide; a group described in U.S. Pat. No. 4,546,073, which releases PUG by using a hydrolytic reaction of iminoketal; a group described in West German Patent Publication 26261317, which releases PUG by using a hydrolytic reaction of ester; and a group described in European Patent 572084, which releases PUG by using a reaction with sulfurous acid ions, the disclosures of which are herein incorporated by reference.

Preferable examples of a timing group represented by T of the present invention are as follows. However, T is not limited to these examples.

(T1)

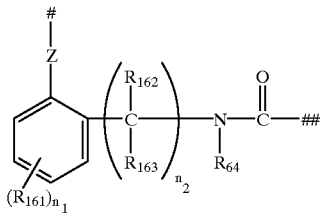

(T2)

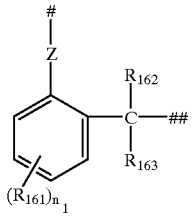

-continued (T3)

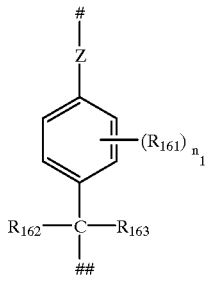

(T4)

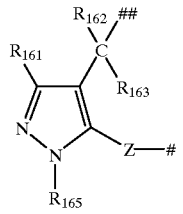

wherein # represents a portion where T bonds to the electrophilic portion E or ##, when k is 2, and ## represents a position where T bonds to PUG or #, when k is 2. Z represents an oxygen atom or a sulfur atom, preferably an oxygen atom. $R_{161}$ represents a substituent, preferably $R_{131}$—, $R_{132}CON(R_{133})$—, $R_{131}SO_2N(R_{132})$—, $R_{131}S$—, $R_{131}O$—, $R_{131}OCON(R_{132})$—, $R_{132}(R_{133})NCON(R_{134})$—, $R_{132}(R_{133})NCO$—, $R_{132}(R_{133})NSO_2$—, $R_{131}OCO$—, a halogen atom, nitro group, or cyano group. $R_{131}$, $R_{132}$, $R_{133}$, and $R_{134}$ have the same meanings as above. $R_{161}$ can combine with any of $R_{162}$, $R_{163}$, and $R_{164}$ to form a ring. $n_1$ represents an integer from 0 to 4. If $n_1$ represents 2 or more, a plurality of $R_{161}$'s can be the same or different and can combine with each other to form a ring.

Each of $R_{162}$, $R_{163}$, and $R_{164}$ represents a group having the same meaning as $R_{132}$. $n_2$ represents 0 or 1. $R_{162}$ and $R_{163}$ can combine with each other to form a spiro ring. Each of $R_{162}$ and $R_{163}$ is preferably a hydrogen atom or a (1- to 20-, preferably 1- to 10-carbon) aliphatic group, and more preferably, a hydrogen atom. $R_{164}$ is preferably a (1- to 20-carbon, preferably 1- to 10-carbon) aliphatic group or a (6- to 20-carbon, preferably 6- to 10-carbon) aryl group. $R_{165}$ represents $R_{132}$—, $R_{132}(R_{133})NCO$—, $R_{132}(R_{133})NSO_2$—, $R_{131}OCO$—, or $R_{132}CO$—. $R_{131}$, $R_{132}$, and $R_{133}$ have the same meanings as above. $R_{165}$ represents preferably $R_{132}$, and more preferably, a 6- to 20-carbon aryl group.

A photographically useful group represented by PUG has the same meaning as above.

A preferable form of couplers used in the present invention is formula (III-2) (wherein A bonds at an atom adjacent to the coupling position of COUP) or formula (III-3) (wherein A bonds at an atom adjacent to the atom adjacent to the coupling position of COUP), and the most preferable form is formula (III-3). Formula (III-3) is preferably represented by formula (III-3a), more preferably, formula (III-3b), and most preferably, formula (III-3c). The structure of a cyclized form obtained by a reaction of formula (III-3c) with the oxidized form (Ar'=NH) of an aromatic amine-based developing agent represented by $ArNH_2$ can be represented by formula (VI) below.

(III-3a)

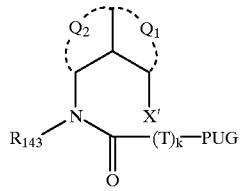

(III-3b)

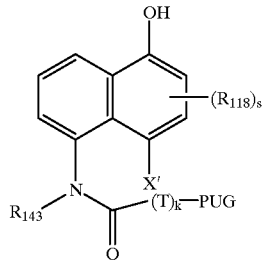

(III-3c)

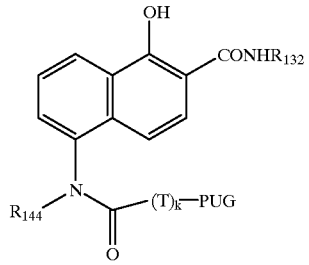

(IV)

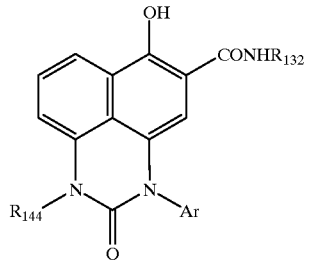

wherein each of $Q_1$ and $Q_2$ represents a nonmetallic atom group required to form a 5- or 6-membered ring and to bring about a coupling reaction with the oxidized form of a developing agent in an atom at the root of X', each of X', T, k, PUG, $R_{118}$, s, $R_{132}$, and $R_{143}$ has the same meaning as above, and $R_{144}$ represents a 1- to 32-carbon, substituted or nonsubstituted aliphatic group.

Practical examples of couplers used in light-sensitive materials of the present invention will be presented below. However, couplers are not limited to these examples.

No.
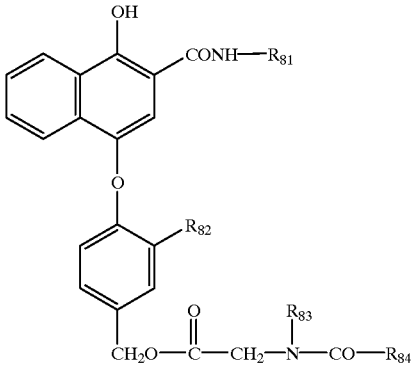
| | $R_{81}$ | $R_{82}$ | $R_{83}$ | $R_{84}$ |
|---|---|---|---|---|
| (1) | $—CH_3$ | $—NHSO_2C_{16}H_{33}(n)$ | $—C_6H_5$ | 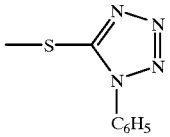 |
| (2) | $—CH_3$ | $—NHSO_2C_{16}H_{33}(n)$ | $—C_6H_5$ | 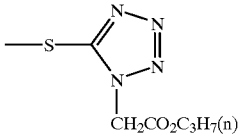 |
| (3) | $—CH_3$ | $—NHSO_2C_{16}H_{33}(n)$ | $—C_6H_5$ | 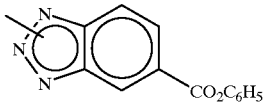 |
| (4) | $—CH_2CH_2OCH_3$ | $—NHSO_2C_{16}H_{33}(n)$ | $—C_6H_5$ | $—SCH_2CH_2CO_2H$ |
| (5) | 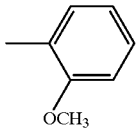 | $—NHSO_2C_{16}H_{33}(n)$ | $—C_6H_5$ | 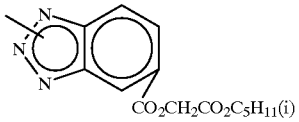 |
| (6) | $—CH_3$ | $—NHSO_2C_{16}H_{33}(n)$ | 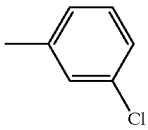 | 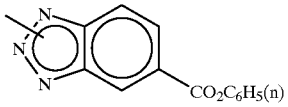 |

-continued
| No. | | | | |
|---|---|---|---|---|
| | 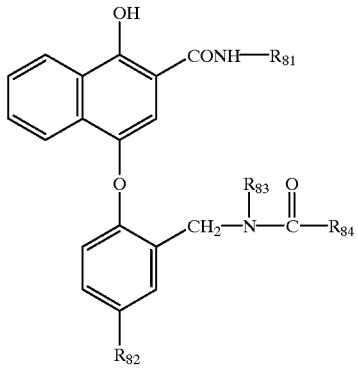 | | | |
| (7) | $—(CH_2)_2CO_2C_2H_5$ | $—NO_2$ | $—C_{12}H_{25}(n)$ | 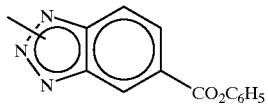 |
| (8) | $CH_3$ | $—NO_2$ | $—C_{12}H_{25}(n)$ | 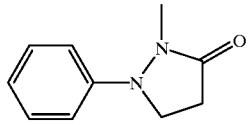 |
| (9) | H | $—NHSO_2C_{16}H_{33}(n)$ | $—C_6H_5$ | 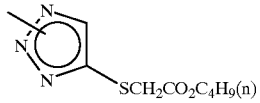 |
| (10) | 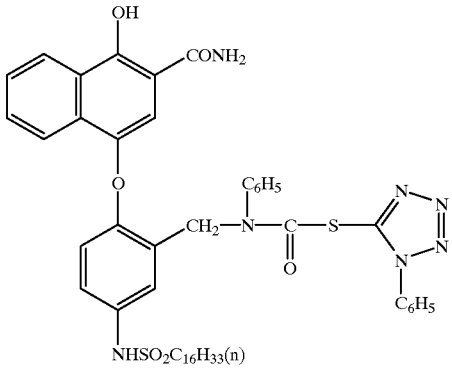 | | | |

-continued
No.
(11)
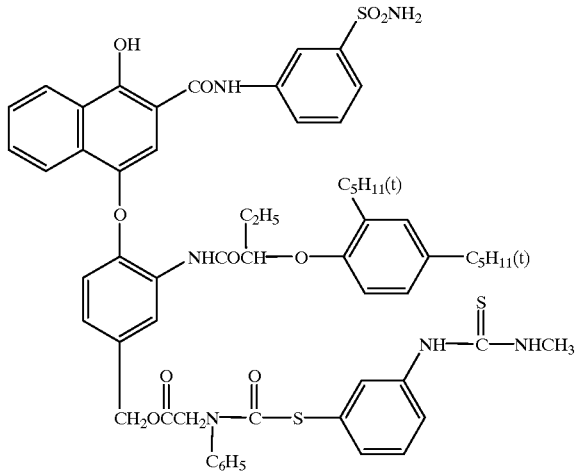
(12)
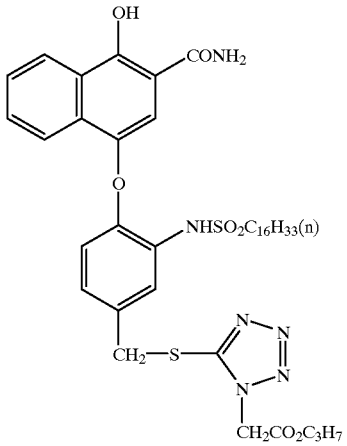
(13)
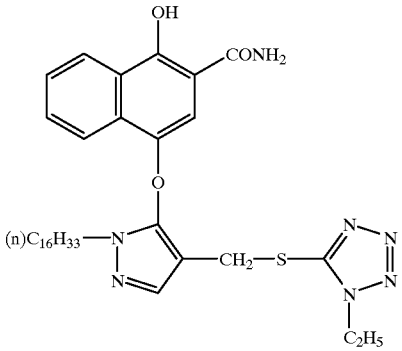

-continued
| No. | |
|---|---|
| (14) | 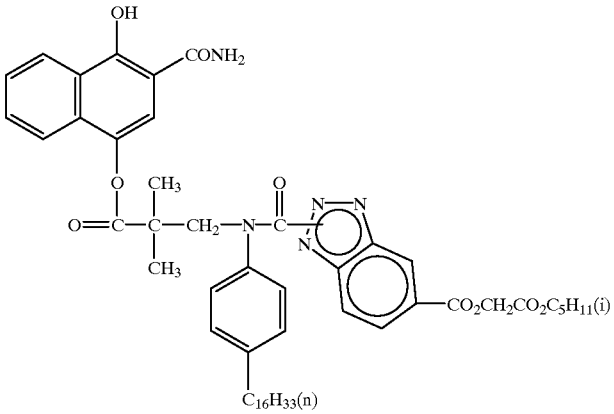 |
| (15) | 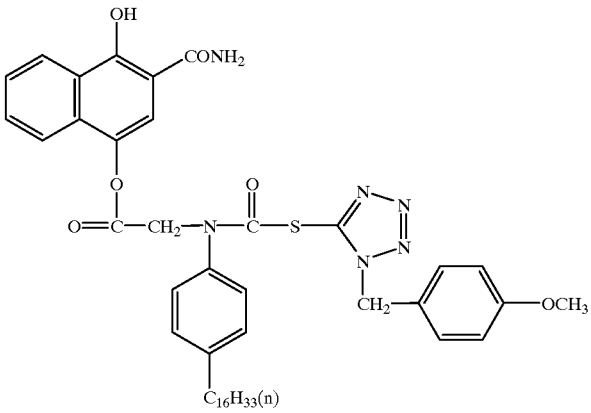 |
| (16) | 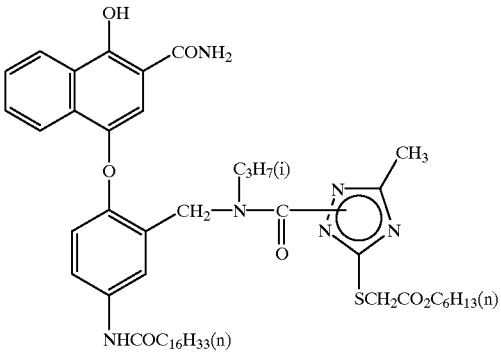 |
| (17) | 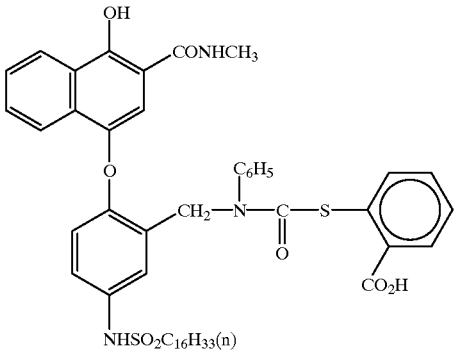 |

-continued
No.
(18)
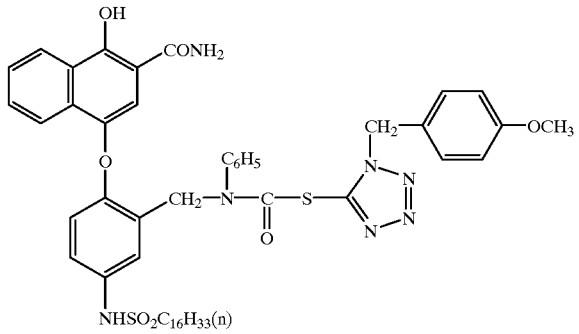
(19)
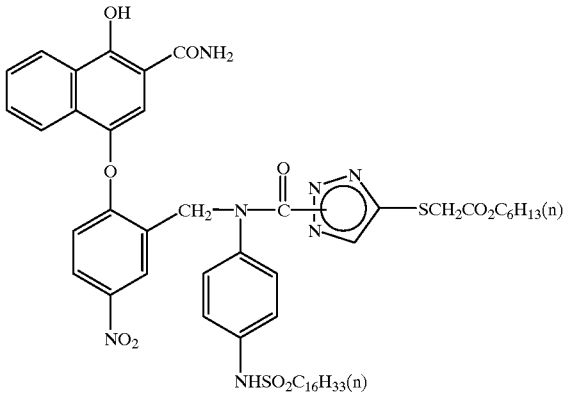
(20)
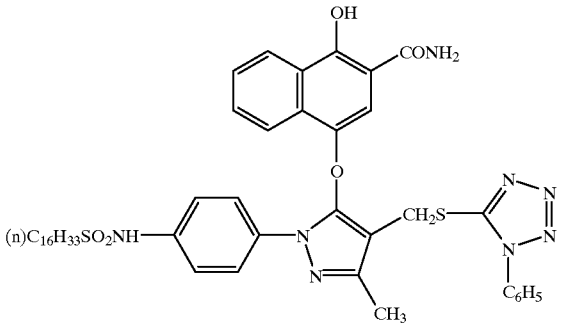
(21)
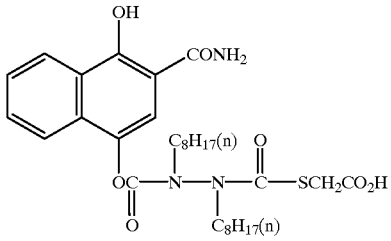

-continued
No.
(22)
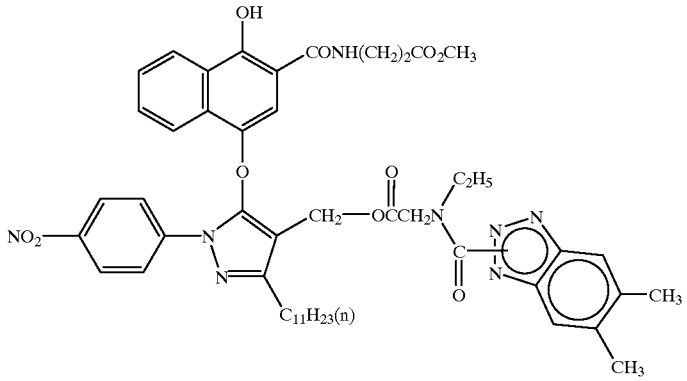
(23)
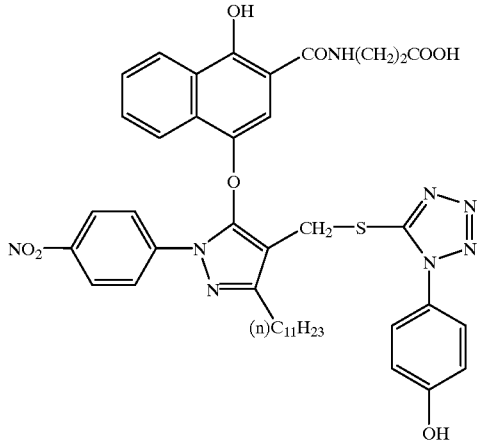
(24)
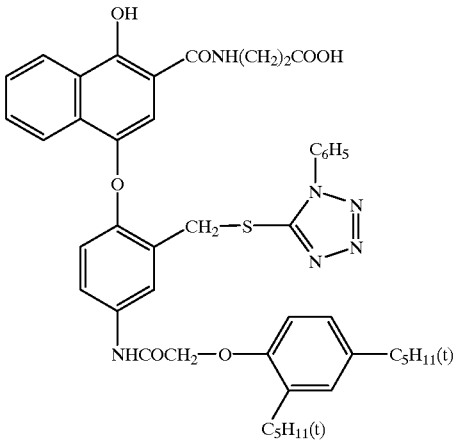

-continued
No.
(25)
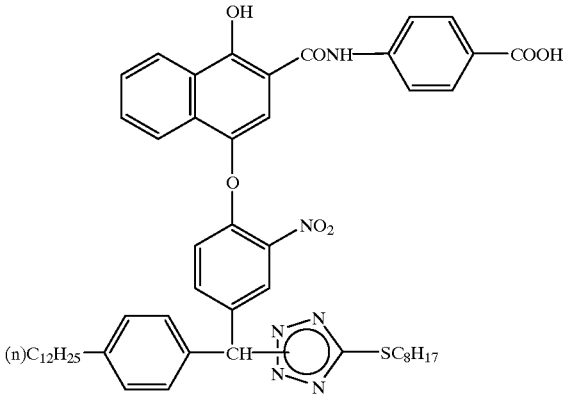
(26)
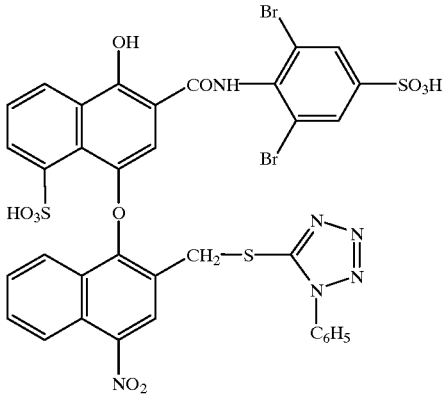
(27)
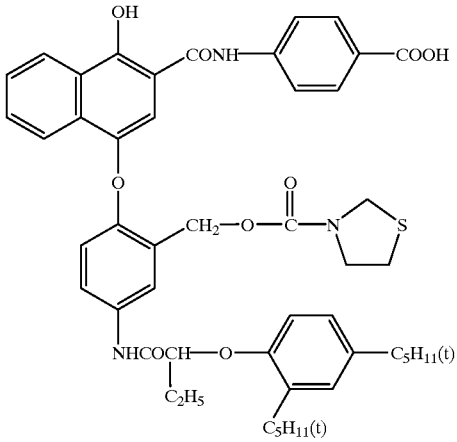

-continued
| No. | |
|---|---|
| (28) | 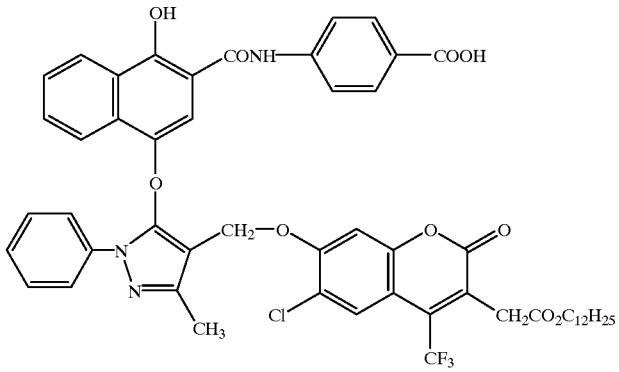 |
| | 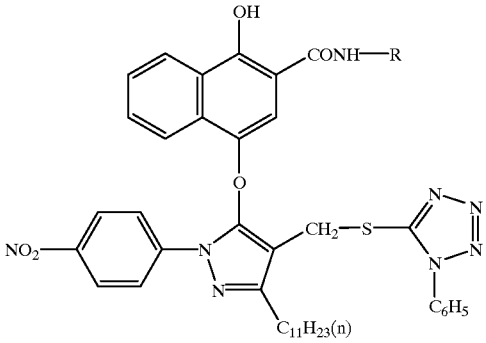 |
| | R |
| (29) | $-(CH_2)_2CO_2CH_3$ |
| (30) | $-(CH_2)_2CO_2C_4H_9(n)$ |
| (31) | $-CH(CH_3)C_2H_5$ <br> $CHCO_2CH_3$ |
| (32) | $-(CH_2)_4CO_2CH_3$ |
| (33) | 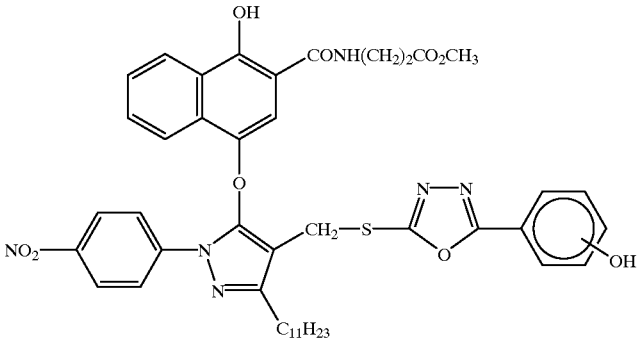 |

-continued
No.
(34)
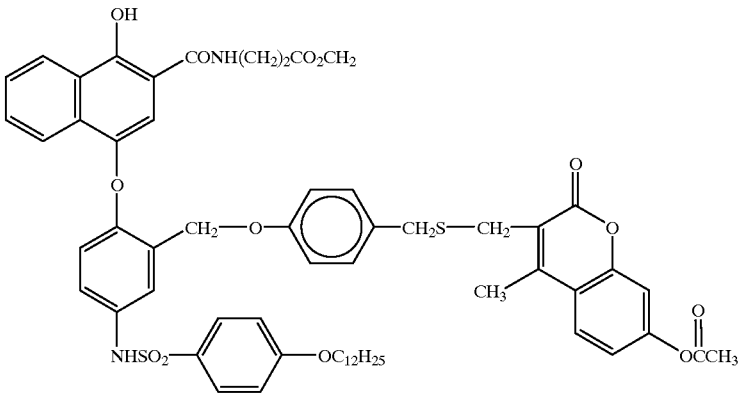
(35)
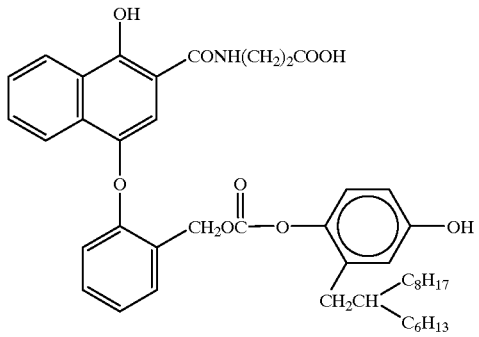
(36)
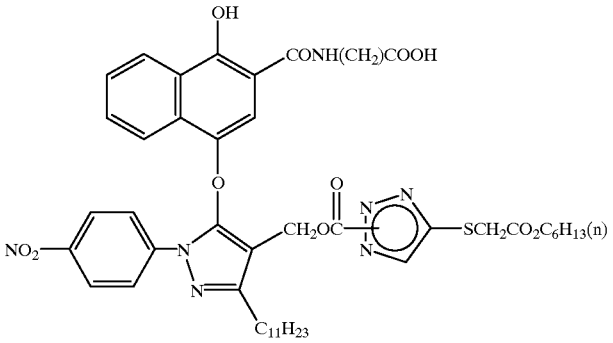
(37)
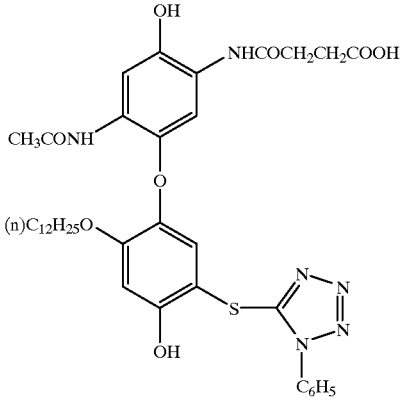

-continued
No.
(38)
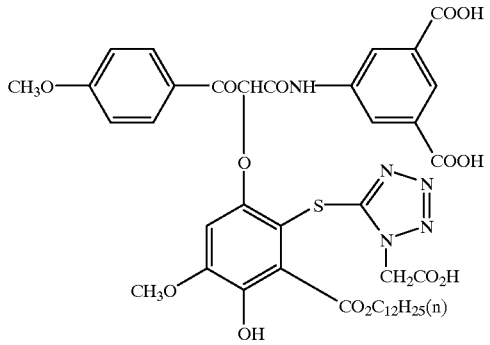
(39)
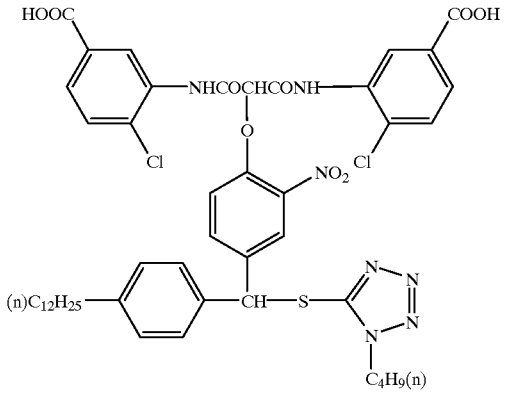
(40)
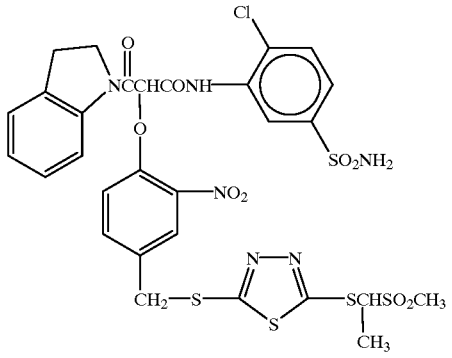
(41)
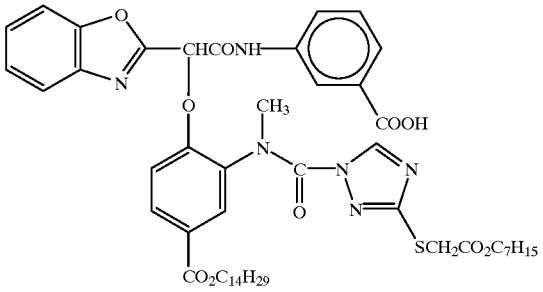

-continued
No.
(42)
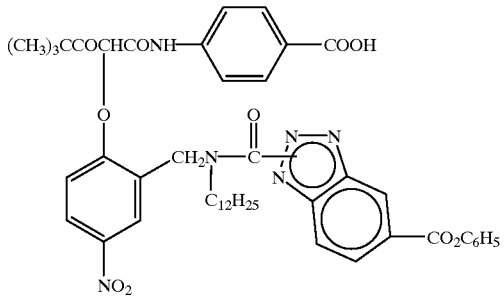
(43)
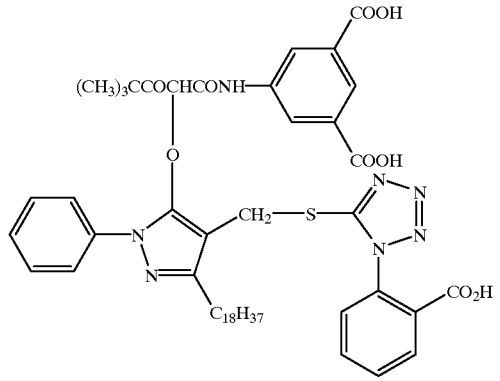
(44)
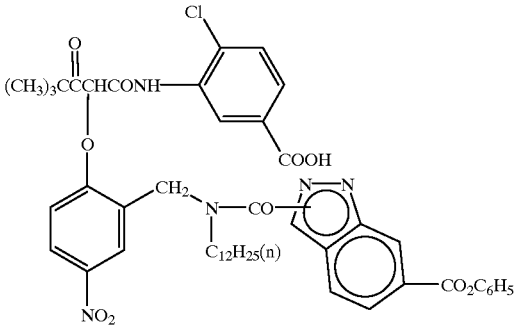
(45)
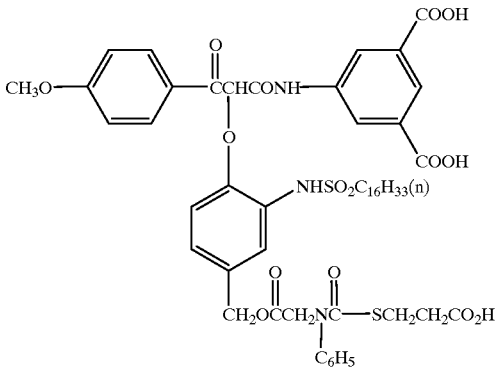

-continued
| No. | |
|---|---|
| (46) | 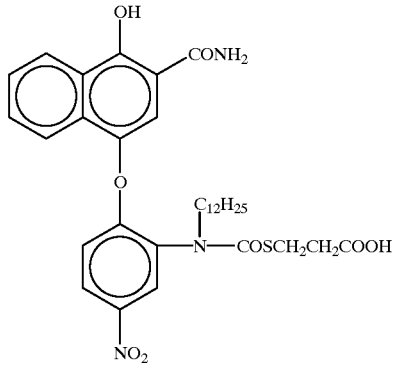 |
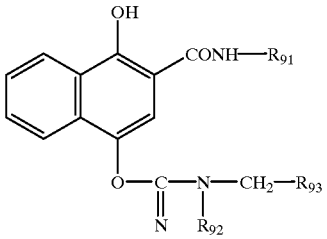
| | $R_{91}$ | $R_{92}$ | $R_{93}$ |
|---|---|---|---|
| (47) | H | $—CH_2CO_2C_{10}H_{21}(n)$ | 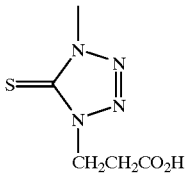 |
| (48) | H | 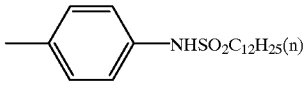 | 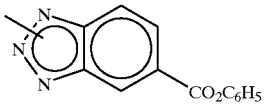 |
| (49) | $—CH_3$ | $—CH_2CO_2C_{12}H_{25}(n)$ | 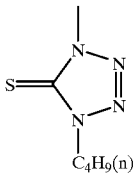 |
| (50) | $—CH_3$ | $—C_8H_{17}(n)$ | 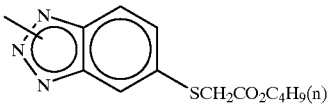 |
| (51) | $—(CH_2)_2OCH_3$ | $—CH_2CO_2C_{10}H_{21}(n)$ | 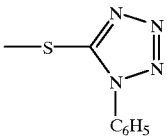 |

-continued
| No. | | | |
|---|---|---|---|
| (52) | $—(CH_2)_2COOH$ | 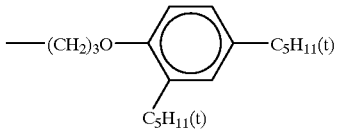 | 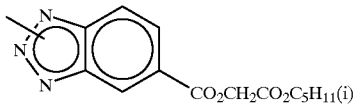 |
| (53) | $—(CH_2)_2COOH$ | 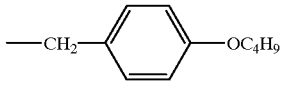 | 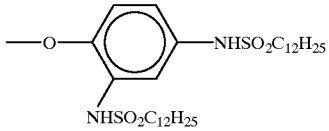 |
| (54) | $—SO_2CH_3$ | $—CH_2CO_2C_{10}H_{21}(n)$ | 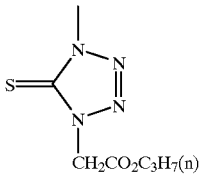 |
| (55) | $—COCH_3$ | $—C_{12}H_{25}(n)$ | 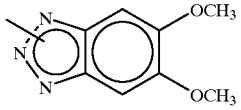 |
| (56) | 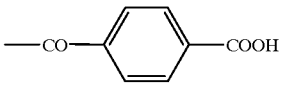 | $—C_{10}H_{21}(n)$ | 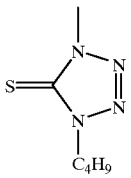 |
| (57) | $—SO_2C_4H_9(n)$ | $—CO_2C_{12}H_{25}(n)$ | 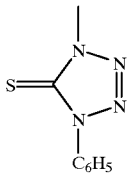 |
| (58) | H | 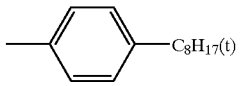 | 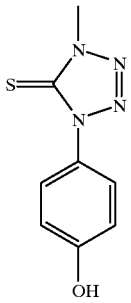 |
| (59) | $—(CH_2)_2CO_2CH_3$ | $—CO_2C_{10}H_{21}(n)$ | 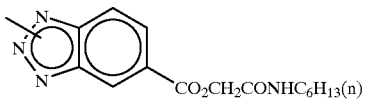 |

-continued
| No. | |
|---|---|
| (60) | 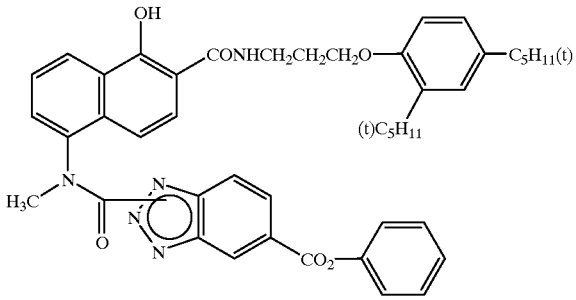 |
| (61) | 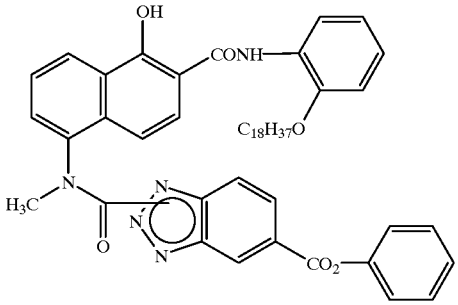 |
| (62) | 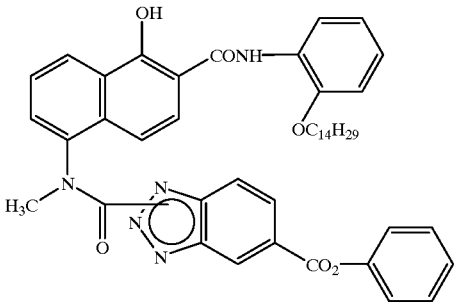 |
| (63) | 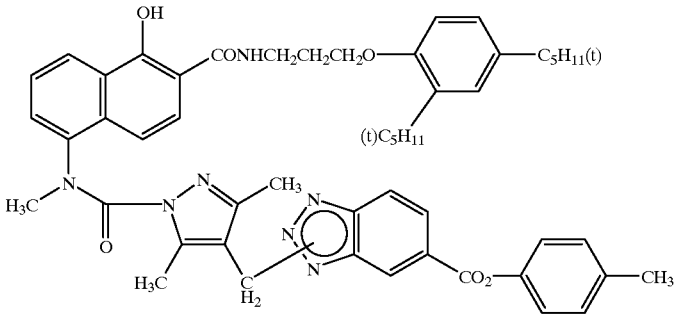 |

-continued
| No. | |
|---|---|
| (64) | 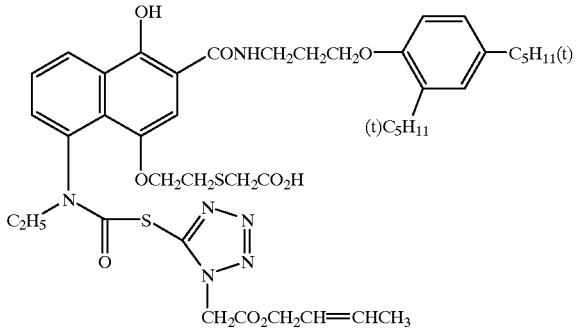 |
| (65) | 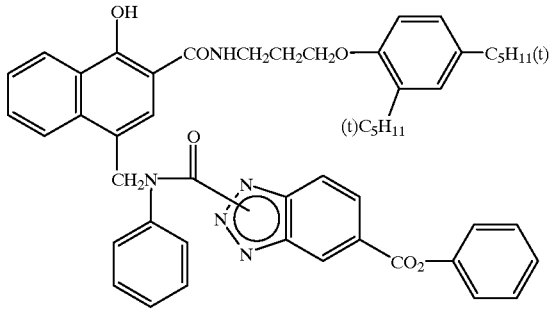 |
| (66) | 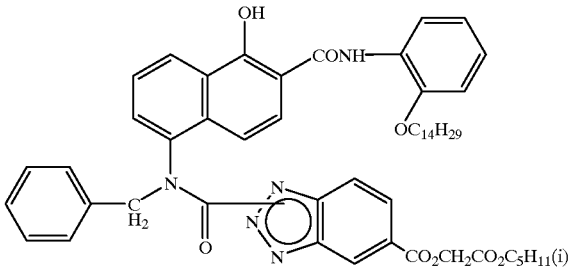 |
| (67) | 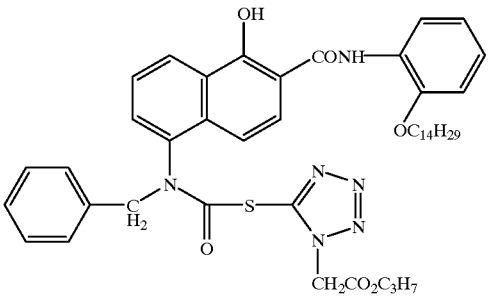 |

-continued
No.
(68)
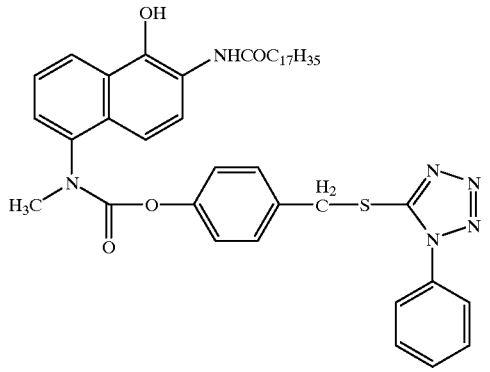
(69)
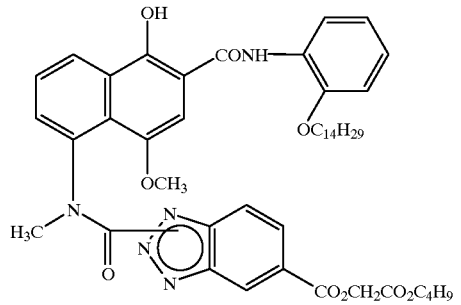
(70)
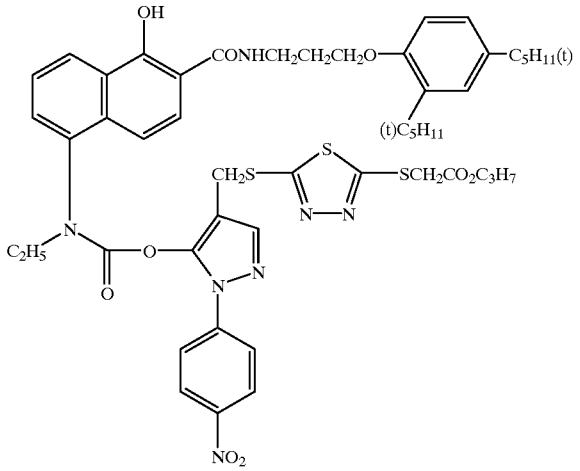

-continued
| No. | |
|---|---|
| (71) | 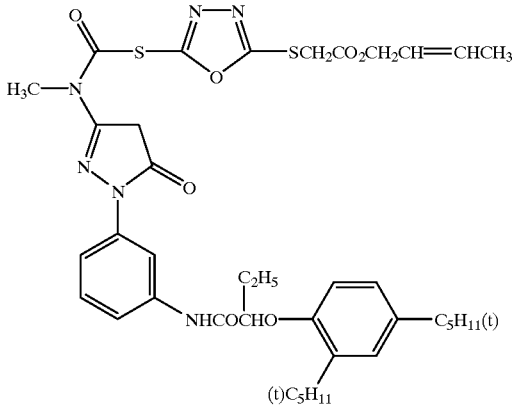 |
| (72) | 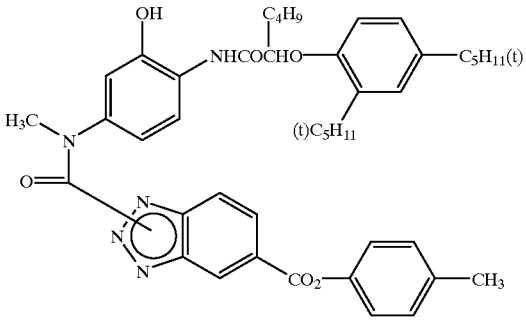 |
| (73) | 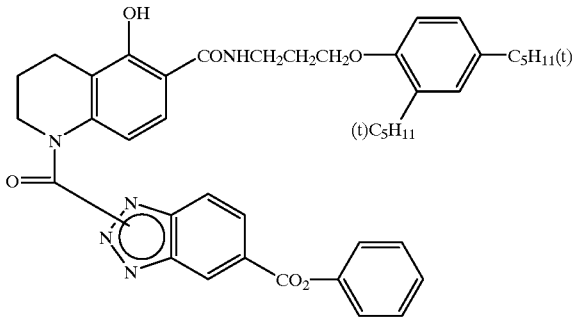 |
| (74) | 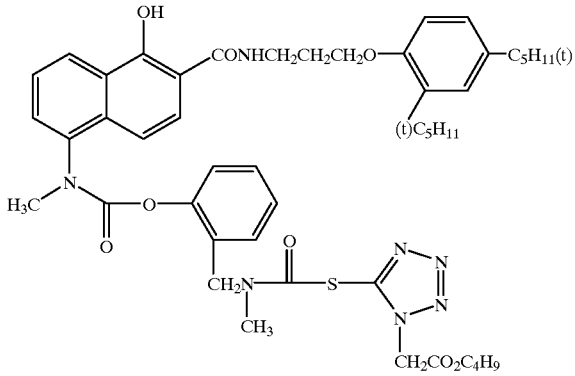 |

-continued
No.
(75)
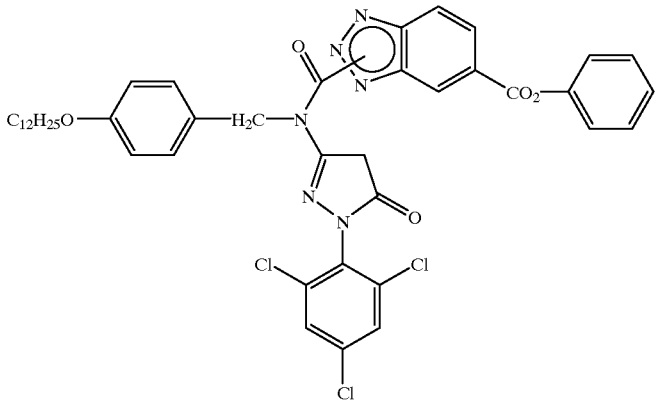
(76)
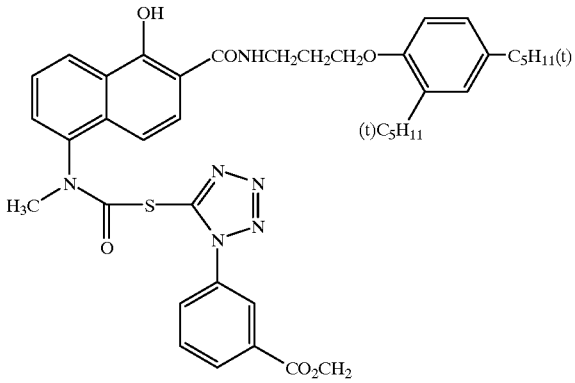
(77)
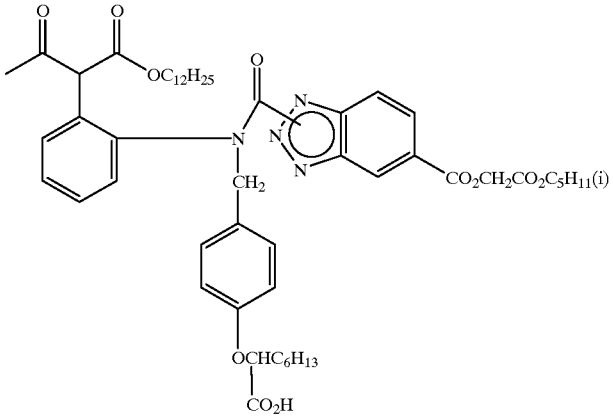

-continued
| No. | |
|---|---|
| (78) | 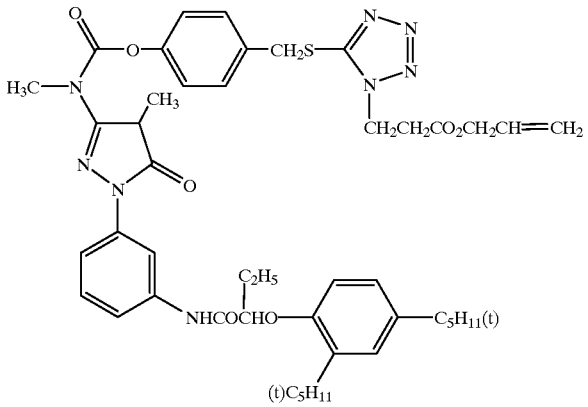 |
| (79) | 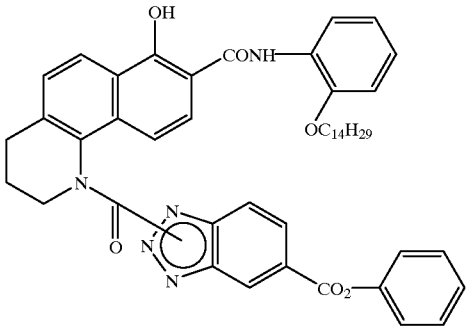 |
| (80) | 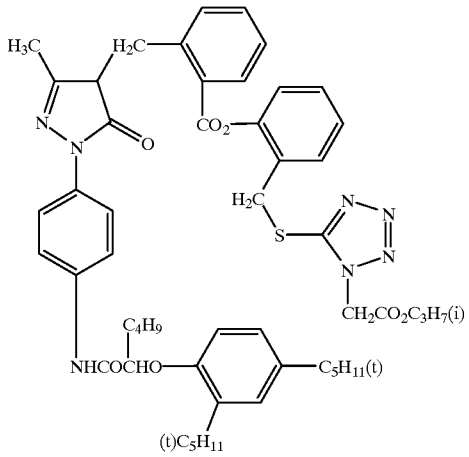 |

-continued
| No. | |
|---|---|
| (81) | 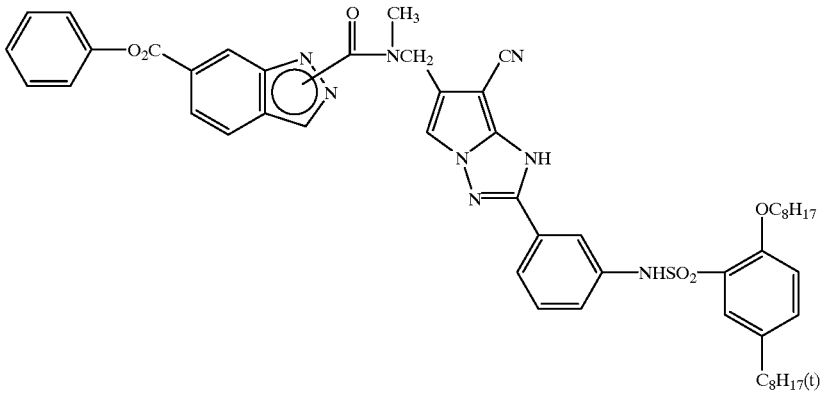 |
| (82) | 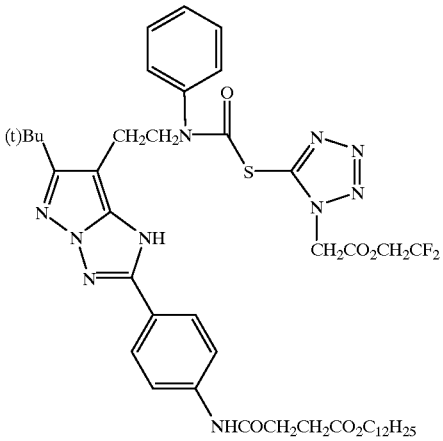 |
| (83) | 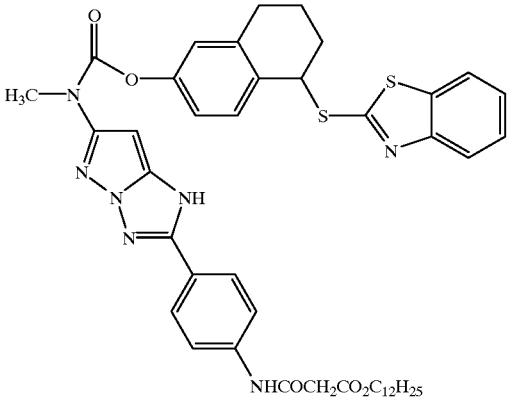 |

-continued
| No. | |
|---|---|
| (84) | 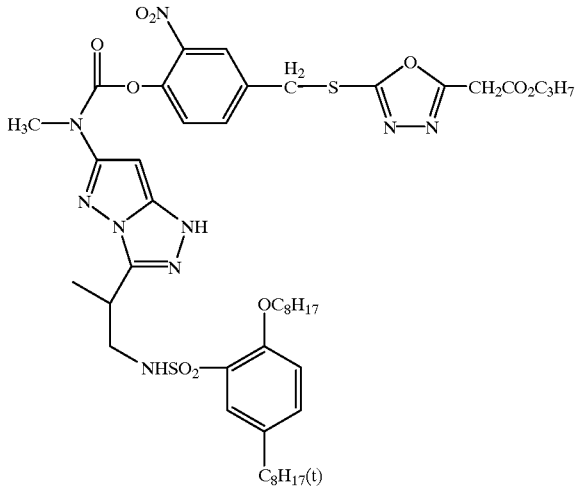 |
| (85) | 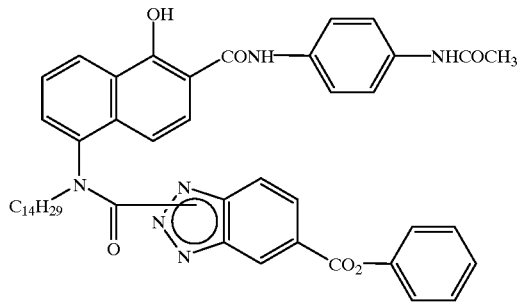 |
| (86) | 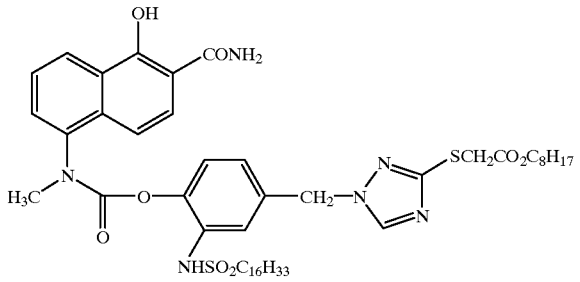 |

-continued
No.
(87)
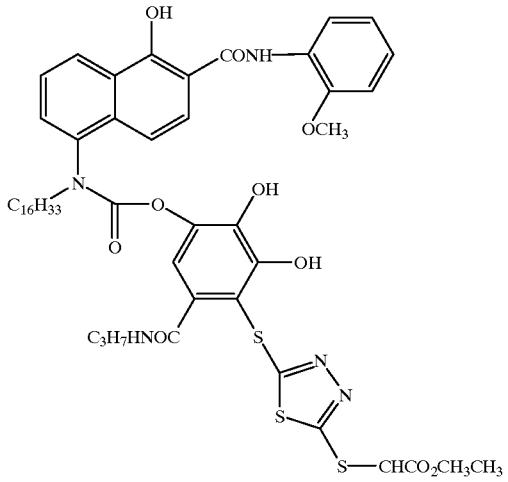
(88)
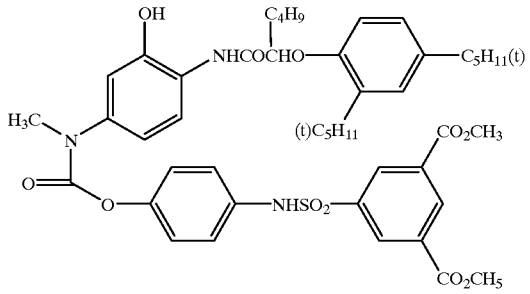
(89)
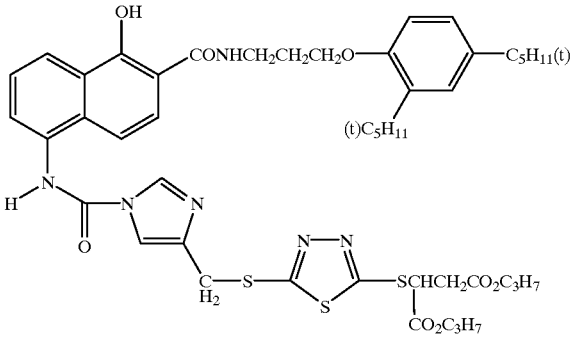
(90)
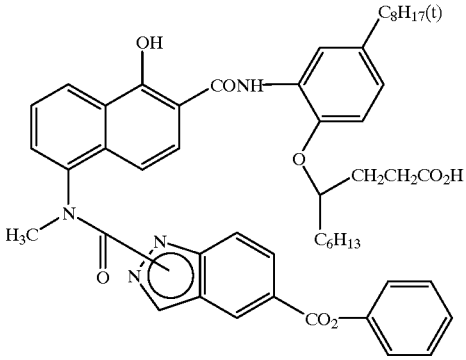

-continued
| No. | |
|---|---|
| (91) | 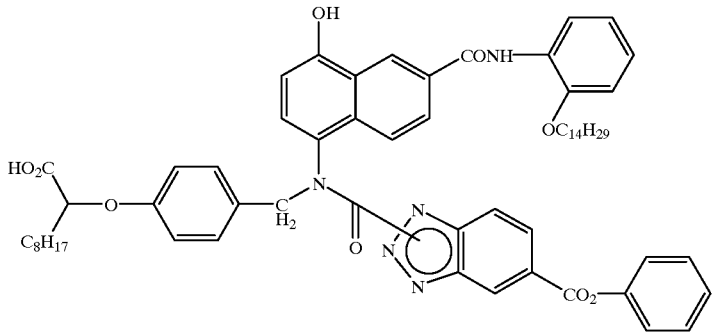 |
| (92) | 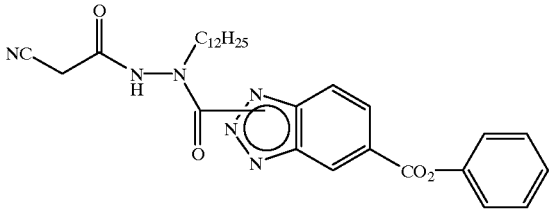 |
| (93) | 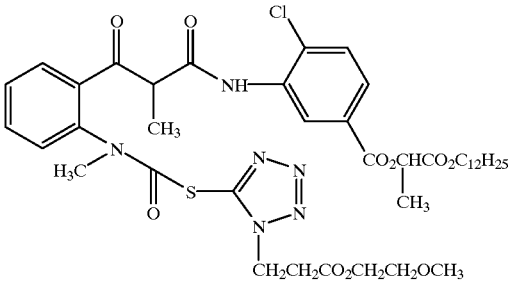 |
| (94) | 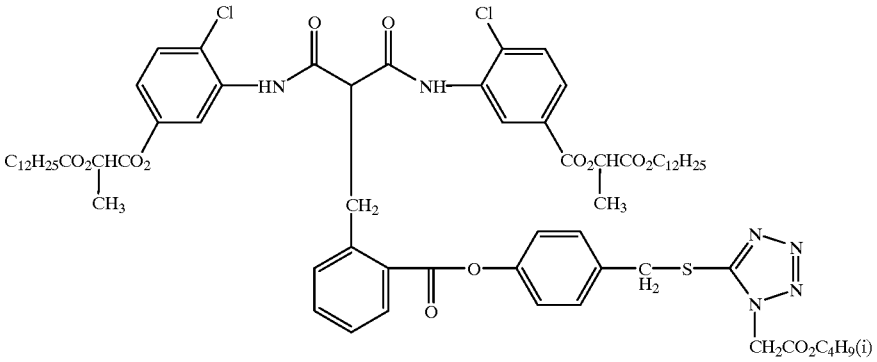 |

-continued
No.
(95)
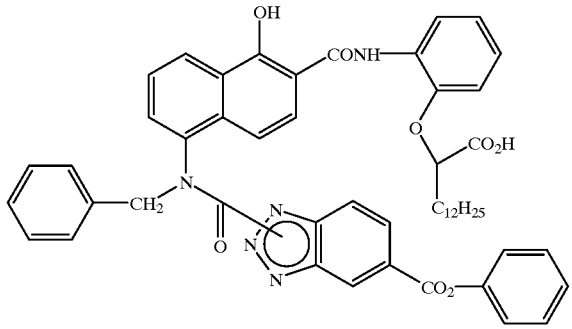
(96)
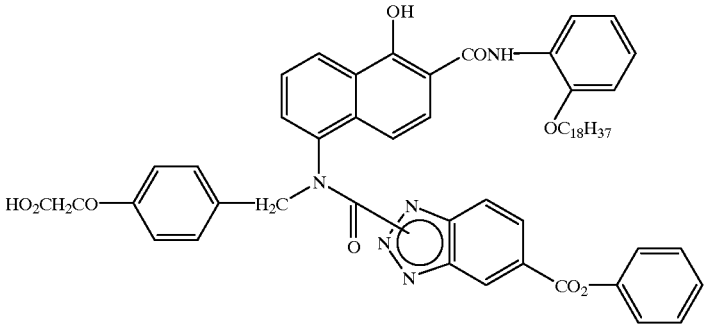
(97)
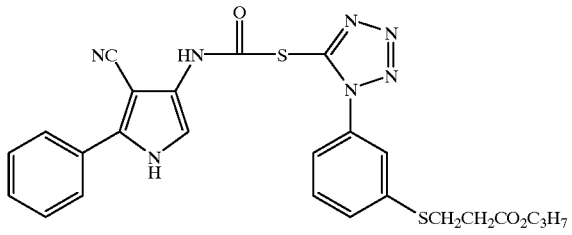
(98)
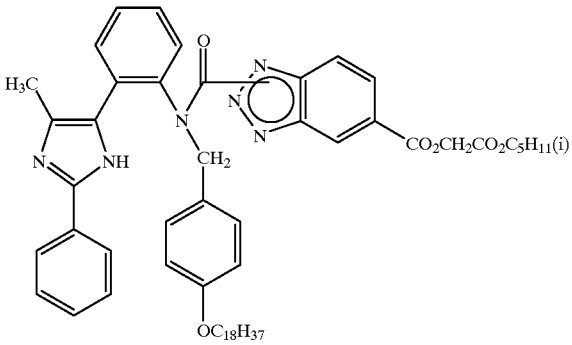

-continued
No.
(99)
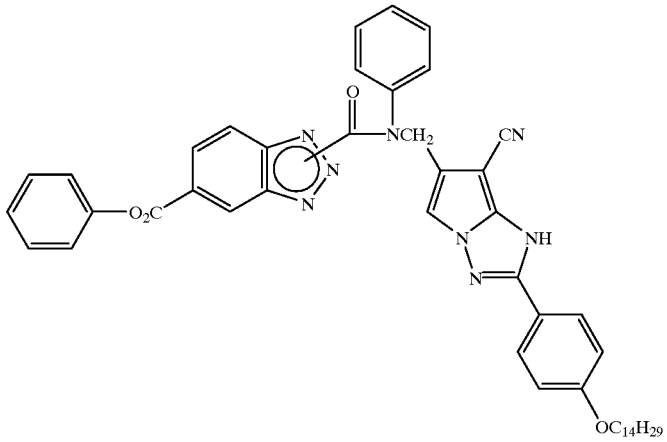
(100)
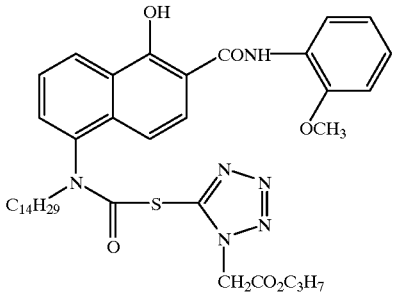
(101)
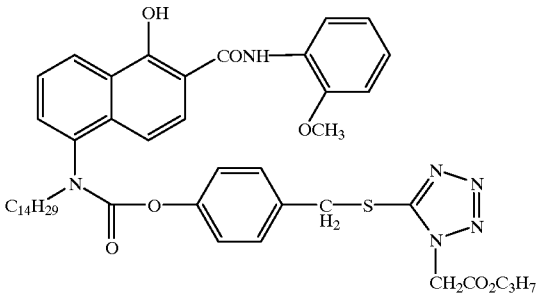
(102)
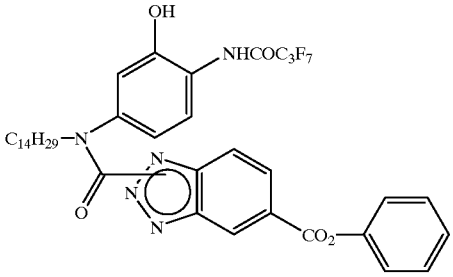

-continued
| No. | |
|---|---|
| (103) | 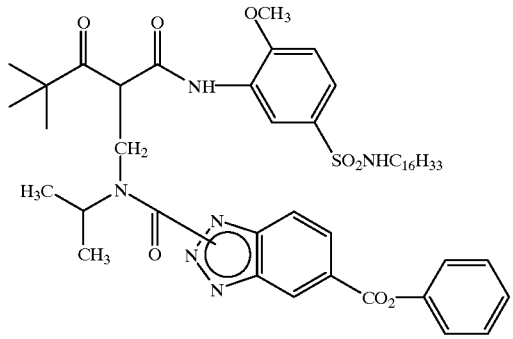 |
| (104) | 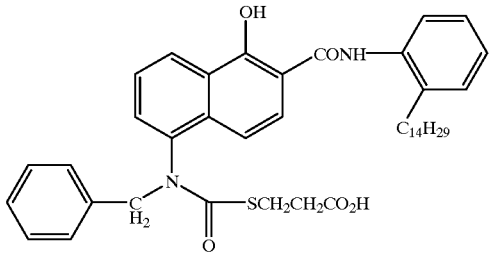 |
| (105) | 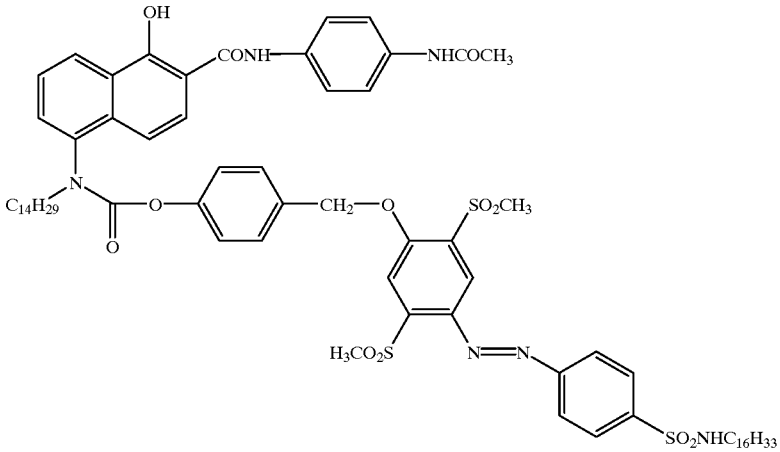 |
| (106) | 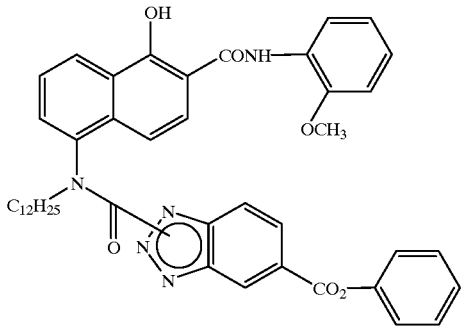 |

-continued
No.
(107)
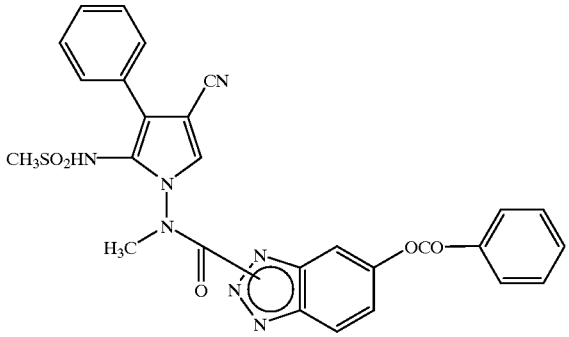
(108)
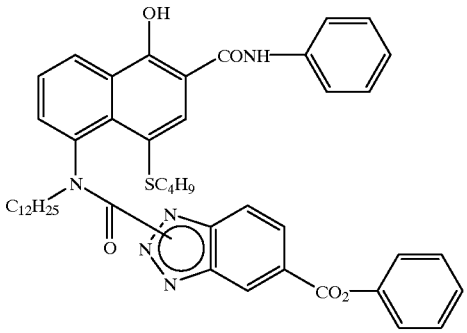
(109)
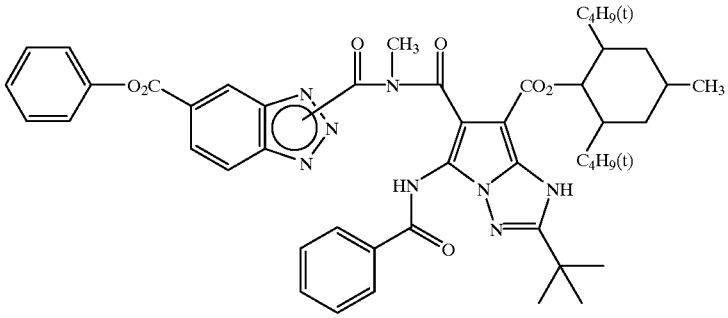
(110)
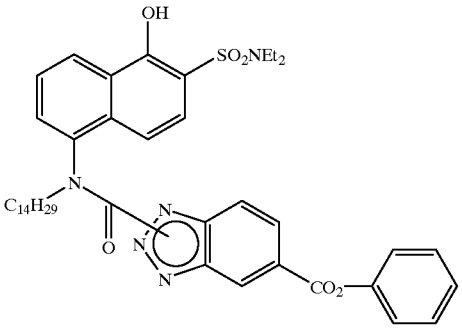

-continued
No.
(111)
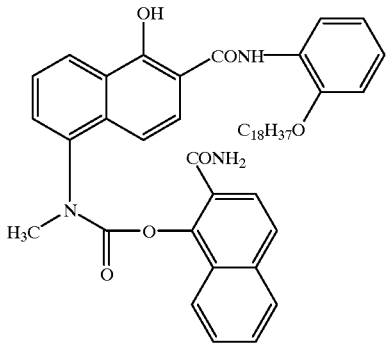
(112)
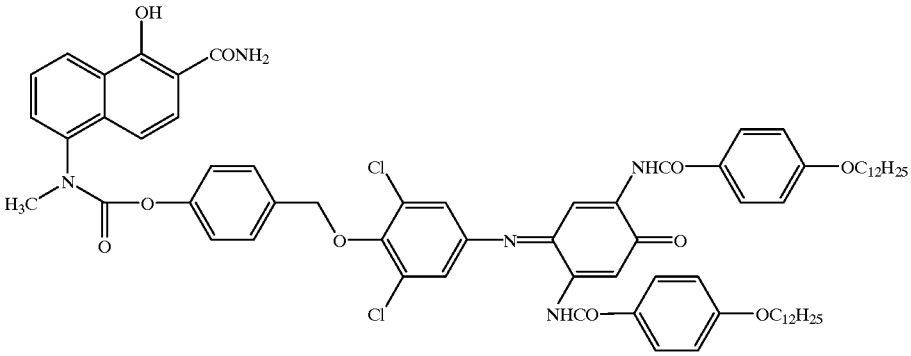
(113)
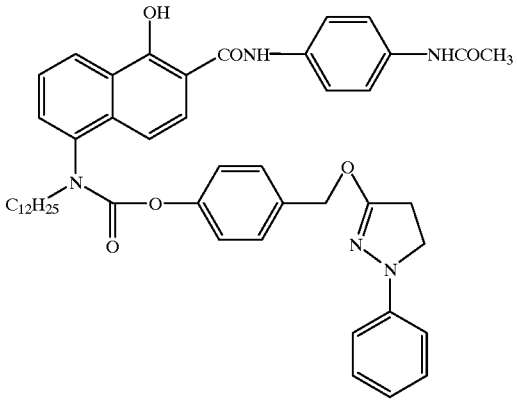
(114)
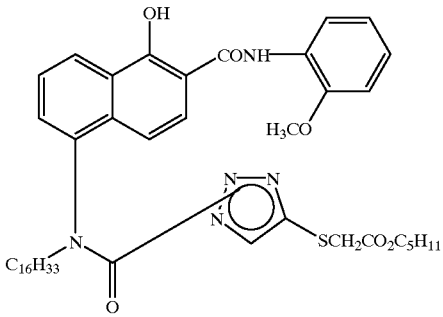

-continued
No.
(115)
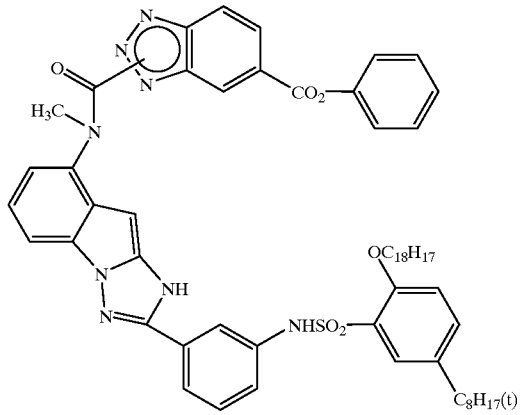
(116)
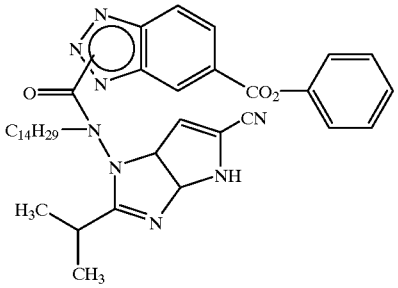
(117)
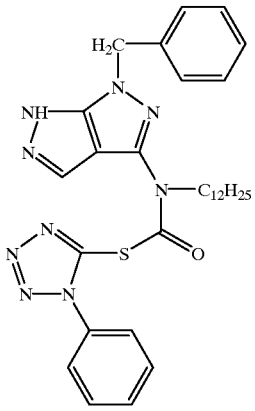
(118)
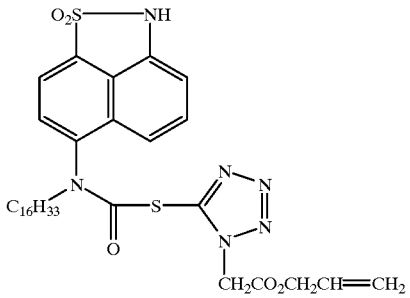

-continued
No.
(119)
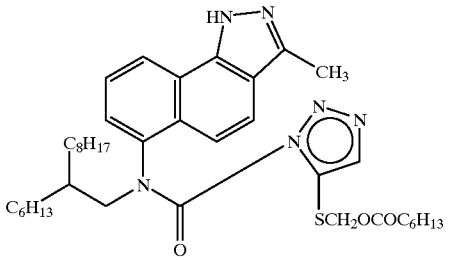
(120)
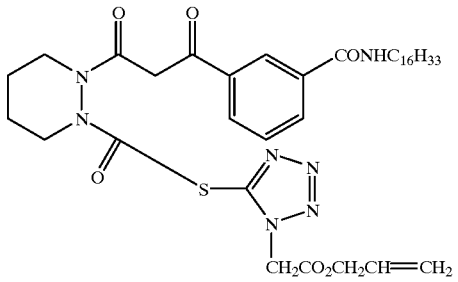
(121)
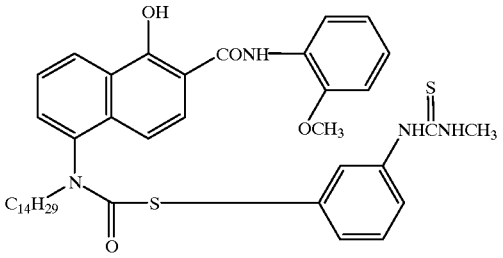
(122)
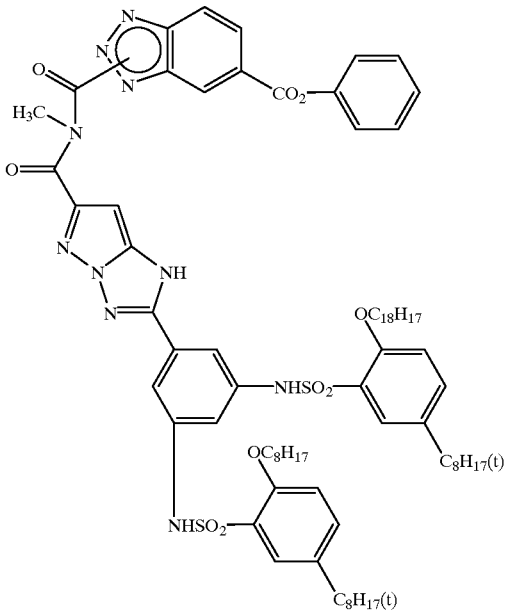

-continued
No.
(123)
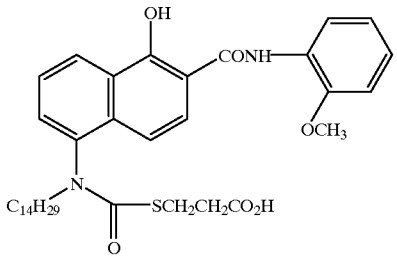
(124)
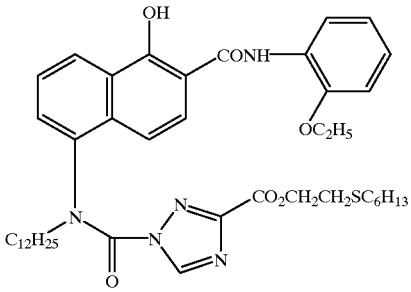
(125)
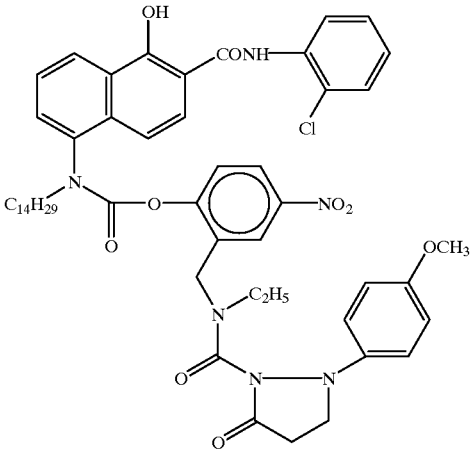
(126)
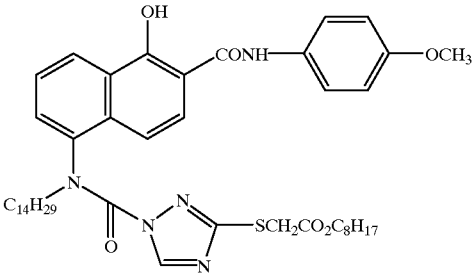

-continued
No.
(127)
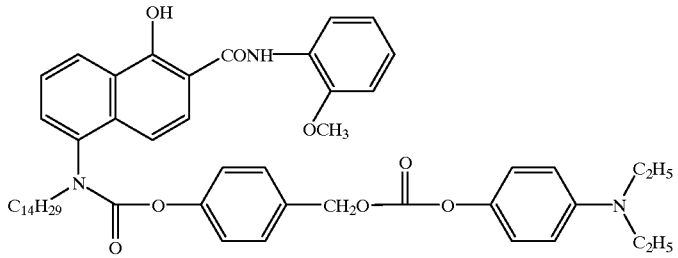
(128)
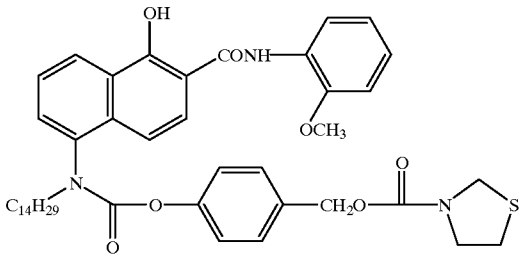
(129)
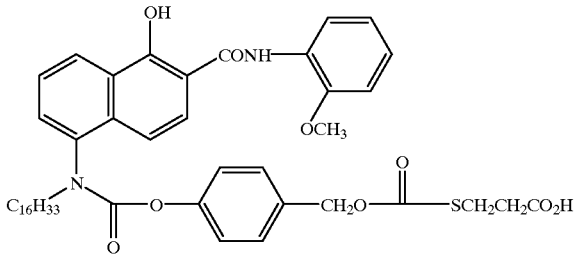
(130)
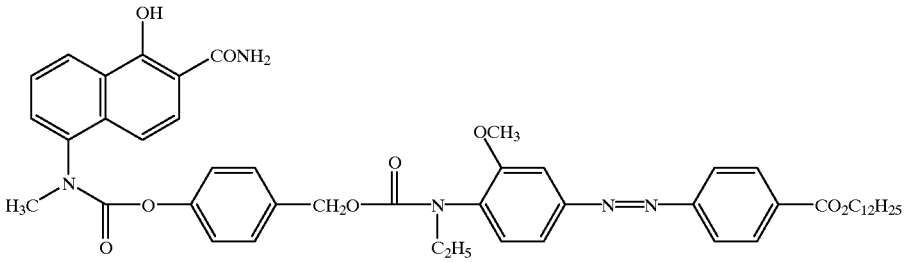
(131)
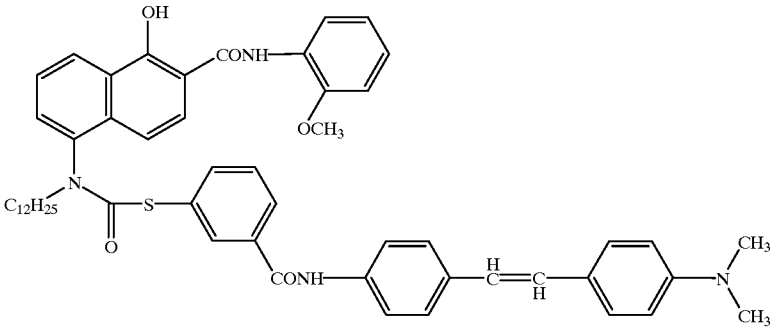

-continued
No.
(132)
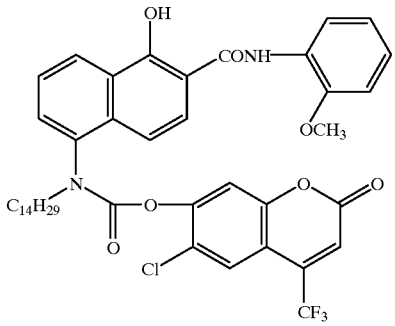
(133)
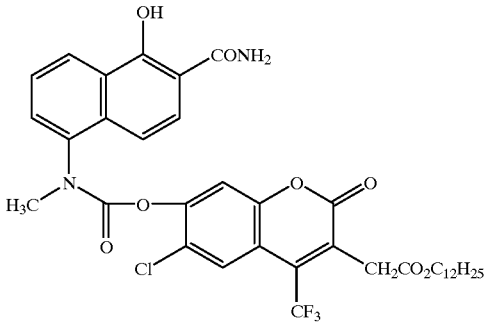
(134)
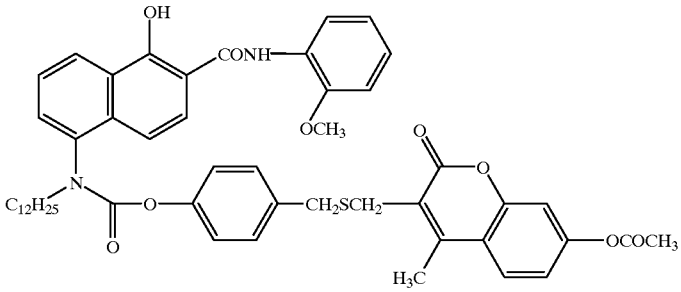
(135)
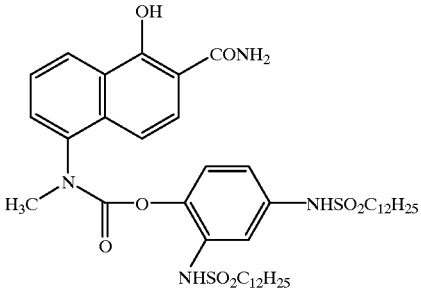

-continued

| No. | |
|---|---|
| (136) | 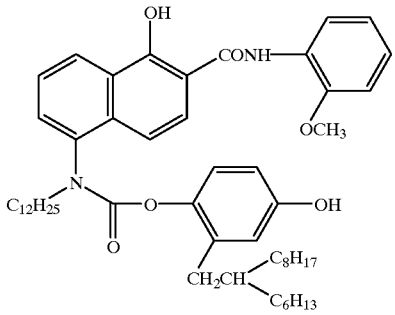 |

A silver halide emulsion having a previously fogged surface will be described below.

This silver halide emulsion having a previously fogged surface is a silver halide emulsion which will be developed evenly (non-imagewise) regardless of the exposure amounts in an unexposed and an exposed portion of a light-sensitive material. "Developed" means that at least 20% of the silver amount of a fogged silver halide emulsion is developed during standard color development.

This standard color development herein mentioned is the standard color development of a light-sensitive material to which the present invention is to be applied. That is, the processing is the CN-16 (of FUJI PHOTO FILM CO., LTD) or C-41 of Eastman Kodak Company color negative film processing for a color negative film and the CP-45 (of FUJI PHOTO FILM CO., LTD) or RA-4 of Eastman Kodak Company color paper processing for color paper.

A surface-fogged silver halide emulsion can be prepared by a method of adding a reducing agent or gold salt under appropriate pH and pAg conditions to a silver halide emulsion capable of forming a surface latent image, a method of heating at low pAg, or by giving even exposure.

As a reducing agent, it is possible to use thiourea dioxide, stannous chloride, a hydrazine-based compound, or ethanolamine.

As a surface-fogged silver halide emulsion, any of silver chloride, silver chlorobromide, silver iodobromide, or silver bromochloroiodide can be used, however, it is preferred that chloride content is 10 mol % or more, and the upper limit of the chloride content is 100 mol %.

The grain size of this surface-fogged silver halide emulsion is not particularly limited. However, the average grain size is preferably 0.01 to 0.75 $\mu$m, and most preferably, 0.05 to 0.6 $\mu$m.

The grain shape is also not particularly restricted. So, both regular grains and irregular grains can be used. The average aspect ratio is not particularly limited either.

Although polydisperse grains are also usable, grains are preferably monodisperse (95% in weight, or the number of grains, of silver halide grains have grain sizes within +40% of the average grain size).

In the present invention, a non-light-sensitive layer containing the surface-fogged silver halide emulsion can be arranged anywhere in a light-sensitive material. This non-light-sensitive layer can be arranged in an optimum position by the action of the photographically useful group released.

For example, this non-light-sensitive layer can be formed as a layer between a light-sensitive silver halide emulsion layer closest to a support and the support, as a so-called interlayer between photosensitive layers sensitive to different colors, as a so-called protective layer farther from a support than a light-sensitive silver halide emulsion layer farthest from the support, or as a layer between silver halide emulsion layers that are differing in sensitivity to each other but having the same color-sensitivity.

A surface-fogged silver halide emulsion is preferably contained in a layer containing black colloidal silver or in its adjacent layer. The coating amount of the black colloidal silver may be decided depending on the halation-preventing ability and light-shading ability of the light-sensitive material. Preferably, the coating amount is 0.01 to 1 g/m$^2$, and more preferably, 0.05 to 0.5 g/m$^2$.

A compound (to be referred to as a "PUG releasing compound" hereinafter) which releases a photographically useful group or its precursor can be added to the non-light-sensitive layer containing a surface-fogged silver halide emulsion, or to a layer adjacent to this non-light-sensitive layer. A PUG releasing compound is preferably added to the non-light-sensitive layer containing a surface-fogged silver halide emulsion.

When this "PUG releasing compound" is added to a layer adjacent to a non-light-sensitive layer containing a surface-fogged silver halide emulsion, the layer containing the "PUG releasing compound" preferably does not contain any light-sensitive silver halide emulsion.

Commonly, a photographically useful group directly acts on a light-sensitive material (during color development after being released). However, a photographically useful group released can also act on a light-sensitive material after being accumulated in a color developer by a running process. Furthermore, this photographically useful group can have a purpose of maintaining the performance of a color development running solution. For this purpose, a non-light-sensitive layer containing a surface-fogged silver halide emulsion can be arranged on the back surface (the surface of a support opposite to the surface coated with light-sensitive silver halide emulsion layers). If this is the case, a "PUG releasing compound" is, of course, also present on this back surface.

Additives commonly used in the manufacture of light-sensitive materials can be added to a non-light-sensitive layer containing a surface-fogged silver halide emulsion and a layer containing a "PUG releasing compound" (these layers are either the same or adjacent to each other). Examples are antihalation black colloidal silver, minimum-density controlling dyes, ultraviolet absorbents, and color-fading preventing agents. However, additives are not restricted to these examples.

The coating amount of a surface-fogged silver halide emulsion used in the present invention can take any value. However, a preferable range is determined by the coating amount of a "PUG releasing compound".

As a silver amount, this coating amount is preferably 0.5 to 200 mols, and more preferably, 1 to 50 mols per mol of a "PUG releasing compound".

This preferable range also changes in accordance with the type of photographically useful group released. As an example, if a photographically useful group released has a development inhibiting effect, the coating amount of a surface-fogged silver halide emulsion with respect to a "PUG releasing compound" must be relatively large compared to that when a photographically useful group having no development inhibiting effect is released.

The coating amount of a "PUG releasing compound" can take any value in accordance with the objective function for photographic properties. Usually, the coating amount of the PUG releasing compound is $5\times10^{-4}$ to 2 g/m$^2$, preferably $1\times10^{-3}$ to 1 g/m$^2$, and more preferably $5\times10^{-3}$ to $5\times10^{-1}$ g/m$^2$.

Also, two or more different types of "PUG releasing compounds" can be used. If this is the case, the chemical structures of photographically useful groups released can be the same or different. Likewise, the photographic functions of photographically useful groups released can be the same or different.

A non-light-sensitive layer containing a surface-fogged silver halide emulsion and a layer containing a "PUG releasing compound" described above (these layers can be the same or adjacent to each other) are collectively defined as one "PUG releasing unit".

This "PUG releasing unit" timely and rapidly releases a photographically useful group during color development. Also, a "PUG releasing unit" minimizes side effects on photographic properties (the storage stability of a light-sensitive material, the storage stability from exposure to development, and variations in photographic properties due to process variations).

Accordingly, this is different from a method of adding a fogged emulsion to a light-sensitive silver halide emulsion layer as described in JP-A-63-175850 as prior art.

Also, a fogged silver halide emulsion in JP-A-2-5042 is developed by first development (black-and-white development). Therefore, this emulsion forms developed silver (metal silver) in color development, i.e., cannot generate the oxidized form of a color developing agent unlike in the present invention. This prior art is basically different from the present invention in this respect.

The effect of the present invention can be obtained by forming at least one "PUG releasing unit". However, two or more units can also be formed. In this case, the chemical structures of photographically useful groups released from these units can be the same or different. Similarly, the photographic functions of photographically useful groups released can be the same or different.

A coupling product produced by the reaction of a "PUG releasing compound" of the present invention with the oxidized form of a developing agent can color, although it does not need to color. However, in a light-sensitive material such as color paper which is directly admired, a "PUG releasing compound" by which the coupling product is not colored, or is slightly colored, is preferable. Most preferably, the coupling product flows out from a light-sensitive material.

In a light-sensitive material such as a color negative film which is not directly admired, the coupling product of a "PUG releasing compound" can color to increase the optical density of the light-sensitive material. However, a large increase in the optical density is unpreferable for printing of color paper. The optical density of a light-sensitive material resulting from coloration of the coupling product of a "PUG releasing compound" is preferably 0.5 or less, more preferably, 0.3 or less, and most preferably, 0.1 or less.

A "PUG releasing compound" by which the coupling product is not colored is particularly preferable in respect of variations in the minimum density value due to variations in color development. Most preferably, the coupling product flows out from a light-sensitive material.

The silver halide photographic lightsensitive material of the present invention is only required that at least one lightsensitive layer be formed on a support. A typical example thereof is a silver halide photographic lightsensitive material having, on its support, at least one lightsensitive layer constituted by a plurality of silver halide emulsion layers which have substantially the same color sensitivity but have different light sensitivities. This lightsensitive layer includes a unit lightsensitive layer which is sensitive to any of blue light, green light and red light. In a multilayered silver halide color photographic lightsensitive material, these unit lightsensitive layers are generally arranged in the order of red-, green- and blue-sensitive layers from a support side. However, according to the intended use, this arrangement order may be reversed, or an arrangement order can be employed in which a different lightsensitive layer is interposed between the layers of the same color sensitivity. Nonlightsensitive layers can be formed between the silver halide lightsensitive layers and as the uppermost layer and the lowermost layer. These may contain, e.g., couplers, DIR compounds and color mixing inhibitors described later. As a plurality of silver halide emulsion layers constituting each unit lightsensitive layer, a two-layered structure of high- and low-speed emulsion layers is preferably arranged so that the sensitivity is sequentially decreased toward a support as described in DE No. 1,121,470 or GB No. 923,045, the disclosures of which are herein incorporated by reference. Also, as described in JP-A's-57-112751, 62-200350, 62-206541 and 62-206543, the disclosures of which are herein incorporated by reference, layers can be arranged so that a low-speed emulsion layer is formed on a side apart from a support while a high-speed emulsion layer is formed on a side closer to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is herein incorporated by reference, layers can be arranged, from the farthest side from a support, in the order of blue-sensitive layer/GH/RH/GL/RL. Furthermore, as described in JP-A-56-25738 and JP-A-62-63936, the disclosures of which are herein incorporated by reference, layers can be arranged, from the farthest side from a support, in the order of blue-sensitive layer/GL/RL/GH/RH.

As described in JP-B-49-15495, the disclosure of which is herein incorporated by reference, three layers can be arranged so that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged so that the sensitivity is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in a layer sensitive to one color as described in JP-A-59-202464, the disclosure of which is herein incorporated by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve the color reproducibility, a donor layer (CL) of an interlayer effect having a spectral sensitivity distribution different from the main lightsensitive layers BL, GL and RL as described in U.S. Pat. Nos. 4,663,271, 4,705,744, 4,707,436, JP-A-62-160448 and JP-A-63-89850, the disclosures of which are herein incorporated by reference, is preferably arranged adjacent to or close to the main lightsensitive layers.

A preferable silver halide used in the present invention other than the silver halide emulsion mentioned above is silver iodobromide, silver iodochloride or silver iodochlorobromide containing about 30 mol % or less of silver iodide. A particularly preferable silver halide is silver iodobromide or silver iodochlorobromide containing about 2 mol % to about 10 mol % of silver iodide.

Silver halide grains contained in the photographic emulsion used in the photographic material of the invention may those having regular crystals such as cubic, octahedral or tetradecahedral crystals, having irregular crystals such as spherical or tabular crystals or having crystal defects such as at least one twin face, or composite forms thereof.

With respect to the grain diameter, the silver halide can consist of fine grains having a grain size of about 0.2 $\mu$m or less or large grains having a projected area diameter of up to about 10 $\mu$m, and the emulsion may be either a polydisperse or monodisperse emulsion.

The silver halide photographic emulsion which can be used in the present invention can be prepared by methods described in, e.g., "I. Emulsion preparation and types," Research Disclosure (to be abbreviated as RD hereafter) No. 17643 (December, 1978), pp. 22 and 23, "I. Emulsion preparation and types"; and RD No. 18716 (November, 1979), page 648; RD No. 307105 (November, 1989), pp. 863 to 865; P. Glafkides, "Chemie et Phisique Photographiques", Paul Montel, 1967; G. F. Duffin, "Photographic Emulsion Chemistry", Focal Press, 1966; and V. L. Zelikman et al., "Making and Coating Photographic Emulsion", Focal Press, 1964, all the disclosures of which are herein incorporated by reference.

Monodisperse emulsions described in, for example, U.S. Pat. Nos. 3,574,628, and 3,655,394 and GB No. 1,413,748 are also preferable, the disclosures of which are herein incorporated by reference.

Also, tabular grains having an aspect ratio of about 3 or more can be used in the present invention.

Tabular grains can be easily prepared by methods described in, e.g., Gutoff, "Photographic Science and Engineering", Vol. 14, pp. 248 to 257 (1970), U.S. Pat. Nos. 4,434,226, 4,414,310, 4,433,048, and 4,439,520, and GB No. 2,112,157, the disclosures of which are herein incorporated by reference.

Also, tabular grains having an aspect ratio of about 3 or more can be particularly preferably used in the present invention. The major faces of tabular grains can be either (100) faces or (111) faces. Grains whose major faces are (100) can be prepared by methods described in U.S. Pat. Nos. 5,320,938, 5,264,337, and 5,292,632. Grains whose major faces are (111) can be prepared by methods described in JP-A-10-221827, page 38, line 14 to page 45, line 20. "Major faces are (100)" means that silver halide grains 50% or more of the outer surfaces of which are constructed of (100) account for 50% or more of the total projected area. Likewise, "major faces are (111)" means that silver halide grains 50% or more of the outer surfaces of which are constructed of (111) account for 50% or more of the total projected area.

The crystal structure can be uniform, can have halogen compositions which are different between the inner part and the outer part thereof, or can be a layered structure. Alternatively, the silver halide can be bonded with a silver halide having a different composition by an epitaxial junction, for example, can be bonded with a compound other than silver halide such as silver rhodanide or lead oxide. A mixture of grains having various crystal forms can also be used.

The above emulsion can be any of a surface latent image type emulsion which mainly forms a latent image on the surface of a grain, an internal latent image type emulsion which forms a latent image in the interior of a grain and an emulsion of another type which has latent images on the surface and in the interior of a grain. However, the emulsion must be a negative type emulsion. The internal latent image type emulsion can be a core/shell internal latent image type emulsion described in JP-A-63-264740, the disclosure of which is herein incorporated by reference. The method of preparing this core/shell internal latent image type emulsion is described in JP-A-59-133542, the disclosure of which is herein incorporated by reference. Although the thickness of a shell of this emulsion depends on, e.g., development conditions, it is preferably 3 to 40 nm, more preferably 5 to 20 nm.

The silver halide emulsion is generally subjected to physical ripening, chemical ripening and spectral sensitization before use. Additives used in these steps are listed in RD Nos. 17643, 18716 and 307105, the disclosures of which are herein incorporated by reference and relevant portions of which are summarized in a below given table.

In the lightsensitive material of the present invention, two or more lightsensitive silver halide emulsions which are different from each other in at least one property among the grain size, grain size distribution, halogen composition, grain morphology and sensitivity thereof can be mixed together and used in a single layer.

Silver halide grains having their surface fogged as described in U.S. Pat. No. 4,082,553, silver halide grains having their internal part fogged as described in U.S. Pat. No. 4,626,498 and JP-A-59-214852 and colloidal silver are preferably used in the lightsensitive silver halide emulsion layer and/or substantially nonlightsensitive hydrophilic colloid layer, all the disclosures of which are herein incorporated by reference. The silver halide grains having their internal part or surface fogged refers to the silver halide grains which can be developed uniformly (in nonimagewise manner), irrespective of the exposed or unexposed part of the lightsensitive material. The process for producing the same is described in U.S. Pat. No. 4,626,498 and JP-A-59-214852, the disclosures of which are herein incorporated by reference. Silver halides forming the internal nuclei of core/shell type silver halide grains having their internal part fogged may have different halogen compositions. The silver halide having its grain internal part or surface fogged can be any of silver chloride, silver chlorobromide, silver iodobromide and silver chloroiodobromide. The average grain size of these fogged silver halide grains is preferably 0.01 to 0.75 μm, more preferably 0.05 to 0.6 μm. With respect to grain morphology, use can be made of regular grains and a polydispersed emulsion indiscriminately. However, a monodispersed emulsion, i.e., at least 95% of the total weight or whole number of grains of the silver halide grains have a grain size which falls within ±40% of the average grain size, is preferred.

In the present invention, it is preferable to use a nonlightsensitive fine grain silver halide. The nonlightsensitive fine grain silver halide preferably consists of silver halide fine grains which are not sensitive during imagewise exposure for obtaining a dye image and are substantially not developed during a development step. These silver halide grains are preferably not fogged in advance. In the fine grain silver halide, the content of silver bromide is 0 to 100 mol %, and silver chloride and/or silver iodide can be contained if necessary. The fine grain silver halide preferably contains 0.5 to 10 mol % of silver iodide. The average grain size, i.e., the average value of equivalent circle diameters of projected areas, of the fine grain silver halide is preferably 0.01 to 0.5 μm, more preferably 0.02 to 0.2 μm.

The fine grain silver halide can be prepared in the same manner as that of common lightsensitive silver halide.

The surface of silver halide grains need not be optically sensitized nor spectrally sensitized. However, before the addition of silver halide grains to a coating solution, it is preferable to add thereto a generally known stabilizer such as a triazole compound, an azaindene compound, a benzothiazolium compound, a mercapto compound, or a zinc compound. Colloidal silver can be incorporated in this fine grain silver halide containing layer.

The silver coating amount of the lightsensitive material of the present invention is preferably 6.0 g/m$^2$ or less, most preferably 4.5 g/m$^2$ or less.

Photographic additives usable in the present invention are also described in RD's, and the relevant description portions are summarized in the following table.

| | Types of additives | RD17643 | RD18716 | RD307105 |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Light absorbents, filter dyes, ultraviolet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surfactants | pages 26–27 | page 650, right column | pages 875–876 |
| 9. | Antistatic agents | page 27 | page 650, right column | pages 876–877 |
| 10. | Matting agents | | | pages 878–879 |

Various dye forming couplers can be used in the lightsensitive material of the present invention, and the following couplers are particularly preferable.

Yellow couplers: couplers represented by formulas (I) and (II) in EP No. 502,424A; couplers represented by formulas (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18); couplers represented by formula (Y) on page 4 in EP No. 447,969A1 (particularly Y-1 (page 17) and Y-54 (page 41)); and couplers represented by formulas (II) to (IV) in column 7, lines 36 to 58, in U.S. Pat. No. 4,476,219 (particularly II-17, II-19 (column 17), and II-24 (column 19)), all the disclosures of which are herein incorporated by reference.

Magenta couplers: JP-A-3-39737 L-57 (page 11, lower right column), L-68 (page 12, lower right column), and L-77 (page 13, lower right column); [A-4]-63 (page 134), and [A-4]-73 and [A-4]-75 (page 139) in EP No. 456,257; M-4 and M-6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, all the disclosures of which are herein incorporated by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulas (Ia) and (Ib) in claim 1 of JP-A-6-67385, all the disclosures of which are herein incorporated by reference.

Polymer couplers: P-1 and P-5 (page 11) in JP-A-2-44345, the disclosure of which is herein incorporated by reference.

Couplers for forming a colored dye with a proper diffusibility are preferably those described in U.S. Pat. No. 4,366,237, GB No. 2,125,570, EP No. 96,873B, and DE No. 3,234,533, all the disclosures of which are herein incorporated by reference.

Couplers for correcting the unnecessary absorption of a colored dye are preferably yellow colored cyan couplers represented by formulas (CI), (CII), (CIII), and (CIV) described on page 5 in EP No. 456,257A1 (particularly YC-86 on page 84); yellow colored magenta couplers ExM-7 (page 202), Ex-l (page 249), and EX-7 (page 251) described in EP No. 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO No. 92/11575 (particularly compound examples on pages 36 to 45), all the disclosures of which are herein incorporated by reference.

Examples of compounds (including a coupler) which react with a developing agent in an oxidized for to thereby release a photographically useful compound residue are as follows and all the disclosures of the documents are herein incorporated by reference. Development inhibitor release compounds: compounds represented by formulas (I), (II), (III), and (IV) on page 11 of EP No. 378,236A1 (particularly T-101 (page 30), T-104 (page 31), T-113 (page 36), T-131 (page 45), T-144 (page 51), and T-158 (page 58)); a compound represented by formula (I) on page 7 of EP No. 436,938A2 (particularly D-49 (page 51)); a compound represented by formula (1) in EP No. 568,037A (particularly (23) (page 11)); and compounds represented by formulas (I), (II), and (III) on pages 5 and 6 of EP No. 440,195A2 (particularly I-(1) on page 29). Bleaching accelerator release compounds: compounds represented by formulas (I) and (I') on page 5 of EP No. 310,125A2 (particularly (60) and (61) on page 61); and compounds represented by formula (I) in claim 1 of JP-A-6-59411 (particularly (7) (page 7)). Ligand release compounds: compounds represented by LIG-X described in claim 1 of U.S. Pat. No. 4,555,478 (particularly compounds in column 12, lines 21 to 41). Leuco dye release compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator or fogging agent release compounds: compounds represented by formulas (1), (2), and (3) in column 3 of U.S. Pat. No. 4,656,123 (particularly (I-22) in column 25); and ExZK-2 on page 75, lines 36 to 38, in EP No. 450,637A2. Compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows and all the disclosures of the following documents are herein incorporated by reference.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: latexes described in U.S. Pat. No. 4,199,363. Developing agent oxidation product scavengers: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)). Stain inhibitors: formulas (I) to (III) on page 4, lines 30 to 33, particularly I-47, I-72, III-1, and III-27 (pages 24 to 48) in EP No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP No. 298,321A; II-1 to III-23, particularly III-10, in columns 25 to 38 of U.S. Pat. No. 5,122,444; I-1 to III-4, particularly II-2, on pages 8 to 12 in EP No. 471,347A; and A-1 to A-48, particularly A-39 and A-42, in columns 32 to 40 of U.S. Pat. No. 5,139,931. Materials which reduce the use amount of a color enhancer or a color-mixing inhibitor: I-1 to II-15, particularly I-46, on pages 5 to 24 in EP No. 411,324A. Formalin scavengers: SCV-1 to SCV-28, particularly SCV-8, on pages 24 to 29 in EP No. 477,932A. Film hardeners: H-1, H-4, H-6, H-8, and H-14 on page 17 in JP-A-1-214845; compounds (H-1 to H-54) represented by formulas (VII) to (XII) in columns 13 to 23 of U.S. Pat. No. 4,618,573;, compounds (H-1 to H-76), particularly H-14, represented by formula (6) on page 8, lower right column, in JP-A-2-214852; and compounds described in claim 1 of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18, and III-25, in columns 3 to 15 of U.S. Pat. No. 4,923,790. Stabilizers and antifoggants: I-1 to (14), particularly I-1, I-60, (2), and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine, selenide, and compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450; F-I-1 to F-II-43, particularly F-I-11 and F-II-8, on pages 33 to 55 in EP No. 445,627A; III-1 to III-36, particularly III-1 and III-3, on pages 17 to 28 in EP No. 457,153A; microcrystalline dispersions of Dye-i to Dye-124 on pages 8 to 26 in WO No. 88/04794; compounds 1 to 22, particularly compound 1, on pages 6 to 11 in EP No. 319,999A; compounds D-1 to D-87 (pages 3 to 28) represented by formulas (1) to (3) in EP No. 519,306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP No. 520,938A; and compounds (1) to (31) (columns 2 to 9) represented by formula (1) in EP No. 521,823A.

The photographic material of the present invention can be applied to various color lightsensitive materials such as color negative films for general purposes or cinemas, color reversal films for slides and TV, color paper, color positive films and color reversal paper. Moreover, the photographic material of the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

In the lightsensitive material of the present invention, the total of film thicknesses of all hydrophilic colloid layers on the side having emulsion layers is preferably 28 $\mu$m or less, more preferably 23 $\mu$m or less, still more preferably 18 $\mu$m or less, and most preferably 16 $\mu$m or less. Film swell speed $T_{1/2}$ is preferably 30 sec or less, more preferably 20 sec or less. The film swell speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swell speed $T_{1/2}$ can be measured by using a swellometer described in A. Green et al., Photogr. Sci. Eng., Vol. 19, No. 2, pp. 124 to 129. The film swell speed $T_{1/2}$ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

(maximum swollen film thickness−film thickness)/film thickness.

In the lightsensitive material of the present invention, hydrophilic colloid layers (called "back layers") having a total dried film thickness of 2 to 20 $\mu$m are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The lightsensitive material according to the present invention can be developed by conventional methods described in above mentioned RD. No. 17643, pp. 28 and 29; RD. No. 18716, page 651, left to right columns; and RD No. 307105, pp. 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are, for example, 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and most preferably 0.02 to 0.05 mol, per liter (hereinafter also referred to as "L") of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents such as alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl)hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the color developing agent in an oxidized form in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, more preferably from 10.0 to 10.5. That of the replenisher is preferably set at 0.1 to 1.0 higher than the above value. Common buffers such as carbonic salts, phosphoric salts, sulfosalicylic salts and boric salts are used for stabilizing the above pH value.

Although the amount of the replenisher of the color developing solution preferably ranges from 80 to 1300 milliliters (hereinafter also referred to as "mL") per $m^2$ of the lightsensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining sensitivity to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

Wherein

C: bromide ion concentration of the color developing replenisher (mol/L),

A: target bromide ion concentration of the color developing solution (mol/L),

W: amount of bromide ion leached from the lightsensitive material into the color developing solution when a color development of 1 $m^2$ of the lightsensitive material has been carried out (mol), and V: amount of color developing replenisher supplied per $m^2$ of the lightsensitive material (L).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-l,8-octanediol are preferably used for means for enhancing sensitivity when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A's-5-72694 and 5-173312, and especially suitable examples thereof are 1,3-diaminopropanetetraacetic acid and ferric complex salts of Example 1 compounds listed on page 7 of JP-A-5-173312.

For improving the biodegradability of the bleaching agent, it is preferred that ferric complex salts of compounds listed in JP-A-4-251845, JP-A-4-268552, EP No. 588,289, EP No. 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$CR=CT\times(V1+V2)/V1+CP$$

wherein

CR: concentration of each component in the replenisher,

CT: concentration of the component in the mother liquor (processing tank solution), CP: component concentration consumed during processing, V1: amount of replenisher having bleaching capability supplied per $m^2$ of lightsensitive material (mL), and V2: amount carried from previous bath by 1 $m^2$ of lightsensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and most preferably 100 to 300 mL, of a bleaching replenisher per $m^2$ of the lightsensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the bleach ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and more preferably 200 to 600 mL, per $m^2$ of the lightsensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP Nos. 504,609 and 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the lightsensitive material.

The replenishing amount of water washing and stabilizing solutions is preferably in the range of 80 to 1000 mL, more preferably 100 to 500 mL, and most preferably 150 to 300 mL, per $m^2$ of the lightsensitive material from the viewpoint that water washing and stabilizing functions are ensured and that the amount of waste solution is reduced to contribute to environment protection. In the processing with the above replenishing amount, known mildewproofing agents such as thiabenzazole, 1,2-benzoisothiazolin-3-one and 5-chloro-2-methylisothiazolin-3-one, antibiotics such as gentamicin and water deionized by the use of, for example, an ion exchange resin are preferably used for preventing the breeding of bacteria and mildew. The use of deionized water, a mildewproofing agent and an antibiotic in combination is more effective than individual uses.

With respect to the solution placed in the water washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used in the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably harvested from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out the present invention are described on page 5, right column, line 11 to page 7, right column, last line of the above journal of technical disclosure.

The processing agent used for the photographic material of the present invention may be supplied in any form, for example, a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A's-51-61837 and 6-102628 and a paste processing agent in PCT National Publication 57-500485. Although any of these can be suitably used, from the viewpoint of easiness in use, it is preferred to employ a liquid prepared in the same concentration as in use in advance.

The container for storing the above processing agent is composed of, for example, any one or a mixture of polyethylene, polypropylene, polyvinyl chloride, polyethylene terephthalate and nylon. A selection is made in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 $\mu$m so that the oxygen permeability therethrough is 20 mL/m$^2$·24 hrs·atm or less.

The processing solution for the color reversal film to which the present invention is applicable will be described below.

With respect to the processing of color reversal films, detailed descriptions are made in Public Technology No. 6 (April 1, 1991) issued by Aztek, page 1, line 5 to page 10, line 5 and page 15, line 8 to page 24, line 2, any of which can be preferably applied thereto. In the color reversal film processing, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment. Among the N-methylolazoles, N-methyloltriazole is especially preferred. The contents of descriptions on color developing solution, bleaching solution, fixing solution and washing water made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

The color photographic lightsensitive material to which the present invention has been applied is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series, e.g., Epion 300Z, produced by Fuji Film and put to practical use. Moreover, the color photographic lightsensitive material of the present invention is suitable to a lens equipped film, such as Fuji Color Uturundesu Super Slim produced by Fuji Film.

The thus photographed film is printed through the following steps in a minilabo system:

(1) acceptance (receiving an exposed cartridge film from a customer), (2) detaching (transferring the film from the above cartridge to an intermediate cartridge for development), (3) film development, (4) rear touching (returning the developed negative film to the original cartridge), (5) printing (continuous automatic printing of C/H/P three type print and index print on color paper (preferably, Super FA8 produced by Fuji Film)), and (6) collation and delivery (collating the cartridge and index print with ID number and delivering the same with prints).

The above system is preferably Fuji Film Minilao Champion Super FA-298/FA-278/FA-258/FA-238 or Fuji Film Digital Labo System Frontier. Film processor of the Minilabo Champion is, for example, FP922AL/FP562B/FP562B, AL/FP362B/FP3622B, AL, and recommended processing chemical is Fuji Color Just It CN-16L or CN-16Q. Printer processor is, for example, PP3008AR/PP3008A/PP1828AR/PP1828A/PP1258AR/PP1258A/PP72 8AR/PP728A, and recommended processing chemical thereof is Fuji Color Just It CP-47L or CP-40FAII. In the Frontier System, use is made of scanner & image processor SP-1000 and laser printer & paper processor LP-1000P or Laser Printer LP-1000W. Fuji Film DT200/DT100 and AT200/AT100 are preferably used as detacher in the detaching step and as rear toucher in the rear touching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictrography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high speed. Further, Photovision FV-10/FV-5 manufactured by Fuji Film can be utilized for inputting a film, print or three-dimensional object in the personal computer. Still further, image information recorded on a floppy disk, Zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

Fuji Color Pocket Album AP-5 Pop L, AP-1 Pop L or AP-1 Pop KG or Cartridge File 16 is preferably employed for storing the developed AP system cartridge film.

The present invention will be described in more detail below by way of its examples.

EXAMPLE 1

In Example 1, a case in which a compound released as a photographically useful group is a bleaching accelerator will be described.

(Manufacture of Sample 101)

A light-sensitive material described below was manufactured. Note that a fogged emulsion Z in the first layer was manufactured as follows.

<Manufacture of Fogged Emulsion Z>

Preparation of Emulsion Z 2.0 L of an aqueous 1% inert gelatin solution were held at 40° C., and 0.1 g of chloroauric acid was added and dissolved by stirring. 0.6 mol of potassium bromide, 0.006 mol of potassium iodide, and 0.6 mol of silver nitrate were added by the double jet method over 4 min at the same fixed flow rate. 0.1 g of chloroauric acid and 0.02 mol of sodium hydroxide were added, and the resultant material was stirred. After that, 0.1 mol of potassium bromide was added to obtain grains having an average grain size of 0.08 $\mu$m. After these grains were washed with water, 100 g of inert gelatin were added to disperse the grains, thereby preparing the emulsion Z having surface fog nuclei.

An undercoated cellulose triacetate film support was coated with multiple layers having the following compositions to manufacture a sample 101 as a multilayered color light-sensitive material.

(Compositions of Sensitive Layers)

The main materials used in the individual layers are classified as follows.

ExC: Cyan coupler

ExM: Magenta coupler

ExY: Yellow coupler

ExS: Sensitizing dye

UV: Ultraviolet absorbent

HBS: High-boiling organic solvent

H: Gelatin hardener

The number corresponding to each component indicates the coating amount in units of g/m$^2$. The coating amount of a silver halide is indicated by the amount of silver. The coating amount of each sensitizing dye is indicated in units of mols per mol of a silver halide in the same layer.

(Sample 101)

| | |
|---|---|
| 1st layer (1st antihalation layer) | |
| Black colloidal silver | silver 0.155 |
| Fogged emulsion Z | silver 0.2 |
| Gelatin | 0.87 |
| ExC-1 | 0.04 |
| ExC-3 | 0.04 |
| Cpd-2 | 0.001 |
| HBS-1 | 0.004 |
| HBS-2 | 0.002 |
| 2nd layer (2nd antihalation layer) | |
| Black colloidal silver | silver 0.066 |
| Gelatin | 0.407 |
| ExM-1 | 0.050 |
| ExF-1 | $2.0 \times 10^{-3}$ |
| HBS-1 | 0.074 |
| Solid disperse dye ExF-2 | 0.015 |
| Solid disperse dye ExF-3 | 0.020 |
| 3rd layer (Interlayer) | |
| Silver iodobromide emulsion O | 0.020 |
| ExC-2 | 0.022 |
| Polyethylacrylate latex | 0.085 |
| Gelatin | 0.294 |

-continued

| | |
|---|---|
| 4th layer (Low-speed red-sensitive emulsion layer) | |
| Silver iodobromide emulsion A | silver 0.40 |
| ExS-1 | $5.5 \times 10^{-4}$ |
| ExS-2 | $1.0 \times 10^{-5}$ |
| ExS-3 | $2.4 \times 10^{-4}$ |
| ExC-1 | 0.109 |
| ExC-3 | 0.044 |
| ExC-4 | 0.072 |
| ExC-5 | 0.011 |
| ExC-6 | 0.003 |
| Cpd-2 | 0.025 |
| Cpd-4 | 0.025 |
| HBS-1 | 0.17 |
| Gelatin | 0.80 |
| 5th layer (Medium-speed red-sensitive emulsion layer) | |
| Silver iodobromide emulsion B | silver 0.30 |
| Silver iodobromide emulsion C | silver 0.60 |
| ExS-1 | $5.0 \times 10^{-4}$ |
| ExS-2 | $1.0 \times 10^{-5}$ |
| ExS-3 | $2.0 \times 10^{-4}$ |
| ExC-1 | 0.15 |
| ExC-2 | 0.026 |
| ExC-3 | 0.025 |
| ExC-4 | 0.12 |
| ExC-5 | 0.016 |
| ExC-6 | 0.007 |
| Cpd-2 | 0.036 |
| Cpd-4 | 0.028 |
| HBS-1 | 0.16 |
| Gelatin | 1.18 |
| 6th layer (High-speed red-sensitive emulsion layer) | |
| Silver iodobromide emulsion D | silver 1.50 |
| ExS-1 | $3.7 \times 10^{-4}$ |
| ExS-2 | $1 \times 10^{-5}$ |
| ExS-3 | $1.8 \times 10^{-4}$ |
| ExC-1 | 0.18 |
| ExC-3 | 0.07 |
| ExC-6 | 0.029 |
| ExC-7 | 0.010 |
| ExY-5 | 0.008 |
| Cpd-2 | 0.046 |
| Cpd-4 | 0.077 |
| HBS-1 | 0.25 |
| HBS-2 | 0.12 |
| Gelatin | 2.12 |
| 7th layer (Interlayer) | |
| Cpd-1 | 0.012 |
| Solid disperse dye ExF-4 | 0.030 |
| HBS-1 | 0.050 |
| Polyethylacrylate latex | 0.83 |
| Gelatin | 0.84 |
| 8th layer (layer for donating interimage effect to red-sensitive layer) | |
| Silver iodobromide emulsion E | silver 0.59 |
| ExS-6 | $1.7 \times 10^{-4}$ |
| ExS-10 | $4.6 \times 10^{-4}$ |
| Cpd-4 | 0.030 |
| ExM-2 | 0.096 |
| ExM-3 | 0.028 |
| ExY-1 | 0.031 |
| HBS-1 | 0.085 |
| HBS-3 | 0.003 |
| Gelatin | 0.58 |
| 9th layer (Low-speed green-sensitive emulsion layer) | |
| Silver iodobromide emulsion F | silver 0.42 |
| Silver iodobromide emulsion G | silver 0.30 |

-continued

| | |
|---|---|
| Silver iodobromide emulsion H | silver 0.38 |
| ExS-4 | $2.4 \times 10^{-5}$ |
| ExS-5 | $1.0 \times 10^{-4}$ |
| ExS-6 | $3.9 \times 10^{-4}$ |
| ExS-7 | $7.7 \times 10^{-5}$ |
| ExS-8 | $3.3 \times 10^{-4}$ |
| ExM-2 | 0.36 |
| ExM-3 | 0.045 |
| HBS-1 | 0.28 |
| HBS-3 | 0.01 |
| HBS-4 | 0.27 |
| Gelatin | 1.39 |
| 10th layer (Medium-speed green-sensitive emulsion layer) | |
| Silver iodobromide emulsion I | silver 0.60 |
| ExS-4 | $5.3 \times 10^{-5}$ |
| ExS-7 | $1.5 \times 10^{-4}$ |
| ExS-8 | $6.3 \times 10^{-4}$ |
| ExC-6 | 0.009 |
| ExM-2 | 0.031 |
| ExM-3 | 0.029 |
| ExY-1 | 0.006 |
| ExM-4 | 0.028 |
| HBS-1 | 0.064 |
| HBS-3 | $2.1 \times 10^{-3}$ |
| Gelatin | 0.44 |
| 11th layer (High-speed green-sensitive emulsion layer) | |
| Silver iodobromide emulsion I | silver 0.20 |
| Silver iodobromide emulsion J | silver 0.75 |
| ExS-4 | $4.1 \times 10^{-5}$ |
| ExS-7 | $1.1 \times 10^{-4}$ |
| ExS-8 | $4.9 \times 10^{-4}$ |
| ExC-6 | 0.004 |
| ExM-1 | 0.016 |
| ExM-3 | 0.036 |
| ExM-4 | 0.020 |
| ExM-5 | 0.004 |
| ExY-5 | 0.003 |
| ExM-2 | 0.013 |
| Cpd-3 | 0.004 |
| Cpd-4 | 0.007 |
| HBS-1 | 0.18 |
| Polyethylacrylate latex | 0.099 |
| Gelatin | 1.11 |
| 12th layer (Yellow filter layer) | |
| Yellow colloidal silver | silver 0.05 |
| Cpd-1 | 0.16 |
| Solid disperse dye ExF-5 | 0.020 |
| Solid disperse dye ExF-6 | 0.020 |
| Oil-soluble dye ExF-7 | 0.010 |
| HBS-1 | 0.082 |
| Gelatin | 1.057 |
| 13th layer (Low-speed blue-sensitive emulsion layer) | |
| Silver iodobromide emulsion K | silver 0.18 |
| Silver iodobromide emulsion L | silver 0.20 |
| Silver iodobromide emulsion M | silver 0.07 |
| ExS-9 | $4.4 \times 10^{-4}$ |
| ExS-10 | $4.0 \times 10^{-4}$ |
| ExC-1 | 0.041 |
| ExC-8 | 0.012 |
| ExY-1 | 0.035 |
| ExY-2 | 0.71 |
| ExY-3 | 0.10 |

-continued

| | |
|---|---|
| ExY-4 | 0.005 |
| Cpd-2 | 0.10 |
| Cpd-3 | $4.0 \times 10^{-3}$ |
| HBS-1 | 0.24 |
| Gelatin | 1.41 |
| 14th layer (High-speed blue-sensitive emulsion layer) | |
| Silver iodobromide emulsion N | silver 0.81 |
| ExS-9 | $3.6 \times 10^{-4}$ |
| ExC-1 | 0.013 |
| ExY-2 | 0.31 |
| ExY-3 | 0.05 |
| ExY-6 | 0.062 |
| Cpd-2 | 0.075 |
| Cpd-3 | $1.0 \times 10^{-3}$ |
| HBS-1 | 0.10 |
| Gelatin | 0.91 |
| 15th layer (1st protective layer) | |
| Silver iodobromide emulsion O | silver 0.30 |
| UV-1 | 0.21 |
| UV-2 | 0.13 |
| UV-3 | 0.20 |
| UV-4 | 0.025 |
| F-18 | 0.009 |
| HBS-1 | 0.12 |
| HBS-4 | $5.0 \times 10^{-2}$ |
| Gelatin | 2.3 |
| 16th layer (2nd protective layer) | |
| H-1 | 0.40 |
| B-1 (diameter 1.7 $\mu$m) | $5.0 \times 10^{-2}$ |
| B-2 (diameter 1.7 $\mu$m) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

Table 1 below shows the AgI contents, grain sizes, surface iodide content and the like of emulsions indicated by abbreviations in this example. The surface iodide content can be checked as follows by using XPS. Each sample was cooled to −115° C. in a vacuum of 1×10 Torr or less, and MgK$\alpha$ was radiated at an X-ray source voltage of 8 kV and an X-ray current of 20 mA, thereby measuring Ag3d5/2, Br3d, and I3d5/2 electrons. The integral intensity of the measured peak was corrected by a sensitivity factor. From these intensity ratios, the surface iodide content was calculated.

TABLE 1

| Emulsion name | Average iodide content (mol %) | Variation coefficient concerning inter-grain iodide distribution | Average grain size (equivalent-sphere diameter; μm) | Variation coefficient (%) of equivalent-sphere diameter | Projected surface diameter (equivalent-circuit diameter; μm) | Diameter/thickness ratio | Surface iodide content (mol %) | Grain shape |
|---|---|---|---|---|---|---|---|---|
| Emulsion | | | | | | | | |
| A | 3.9 | 20 | 0.37 | 19 | 0.40 | 2.7 | 2.3 | Tabular grain |
| B | 5.1 | 17 | 0.52 | 21 | 0.67 | 5.2 | 3.5 | Tabular grain |
| C | 7.0 | 18 | 0.86 | 22 | 1.27 | 5.9 | 5.2 | Tabular grain |
| D | 4.2 | 17 | 1.00 | 18 | 1.53 | 6.5 | 2.8 | Tabular grain |
| E | 7.2 | 22 | 0.87 | 22 | 1.27 | 5.7 | 5.3 | Tabular grain |
| F | 2.6 | 18 | 0.28 | 19 | 0.28 | 1.3 | 1.7 | Tabular grain |
| G | 4.0 | 17 | 0.43 | 19 | 0.58 | 3.3 | 2.3 | Tabular grain |
| H | 5.3 | 18 | 0.52 | 17 | 0.79 | 6.5 | 4.7 | Tabular grain |
| I | 5.5 | 16 | 0.73 | 15 | 1.03 | 5.5 | 3.1 | Tabular grain |
| J | 7.2 | 19 | 0.93 | 18 | 1.45 | 5.5 | 5.4 | Tabular grain |
| K | 1.7 | 18 | 0.40 | 16 | 0.52 | 6.0 | 2.1 | Tabular grain |
| L | 8.7 | 22 | 0.64 | 18 | 0.86 | 6.3 | 5.8 | Tabular grain |
| M | 7.0 | 20 | 0.51 | 19 | 0.82 | 5.0 | 4.9 | Tabular grain |
| N | 6.5 | 22 | 1.07 | 24 | 1.52 | 7.3 | 3.2 | Tabular grain |
| O | 1.0 | — | 0.07 | — | 0.07 | 1.0 | — | Uniform structure |
| P | 0.9 | — | 0.07 | — | 0.07 | 1.0 | — | Uniform structure |

In Table 1, (1) The emulsions L to 0 were subjected to reduction sensitization during grain preparation by using thiourea dioxide and thiosulfonic acid in accordance with examples in JP-A-2-191938.

(2) The emulsions A to 0 were subjected to gold sensitization, sulfur sensitization, and selenium sensitization in the presence of the spectral sensitizing dyes described in the individual sensitive layers and sodium thiocyanate in accordance with examples in JP-A-3-237450.

(3) The tabular grains were prepared by using low-molecular-weight gelatin in accordance with examples in JP-A-1-158426.

(4) Dislocation lines as described in JP-A-3-237450 were observed in the tabular grains when a high-voltage electron microscope was used.

Preparation of Dispersions of Organic Solid Disperse Dyes

ExF-2 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-2 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of EP549,489A. The average grain size was found to be 0.06 μm.

A solid dispersion ExF-8 was dispersed by the following method.

70 g of water and W-2 were added to 1,400 g of a wet cake of ExF-8 containing 30% of water, and the resultant material was stirred to form a slurry of ExF-8 having a concentration of 30%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExC-1

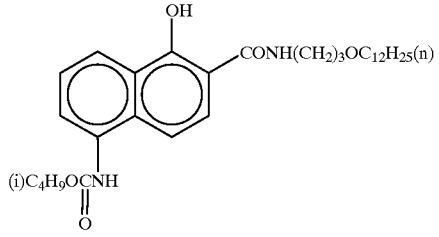

ExC-2

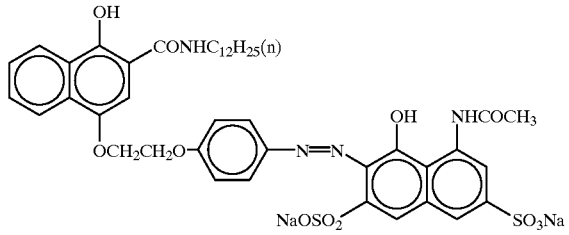

-continued
ExC-3
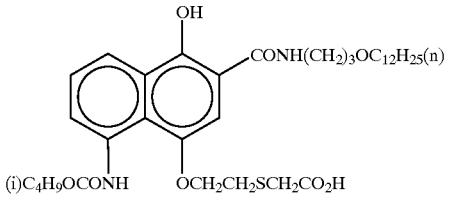
ExC-4
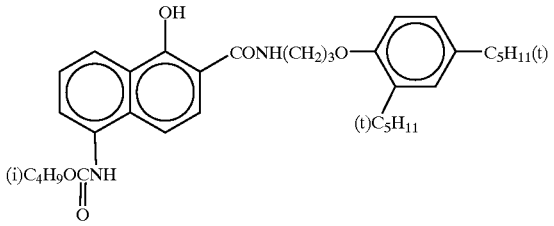
ExC-5
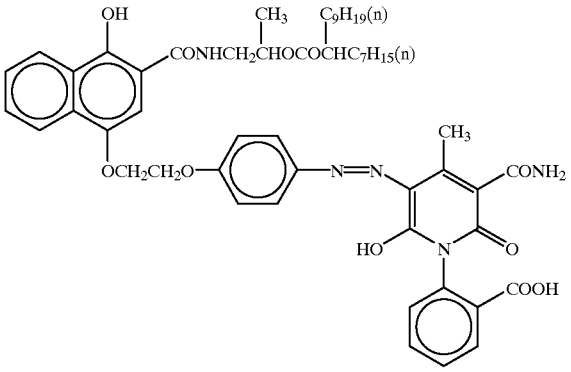
ExC-6
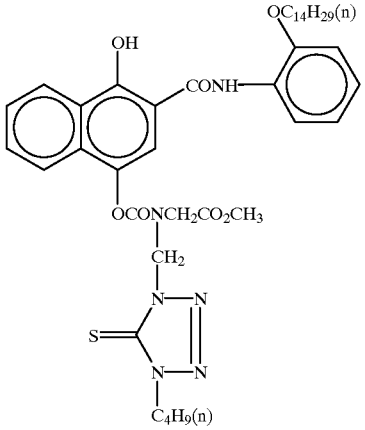
ExC-7
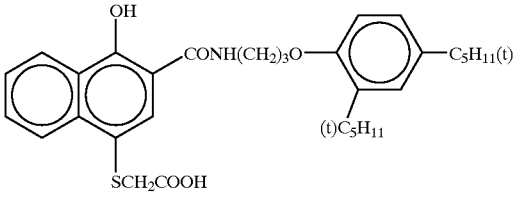
ExC-8
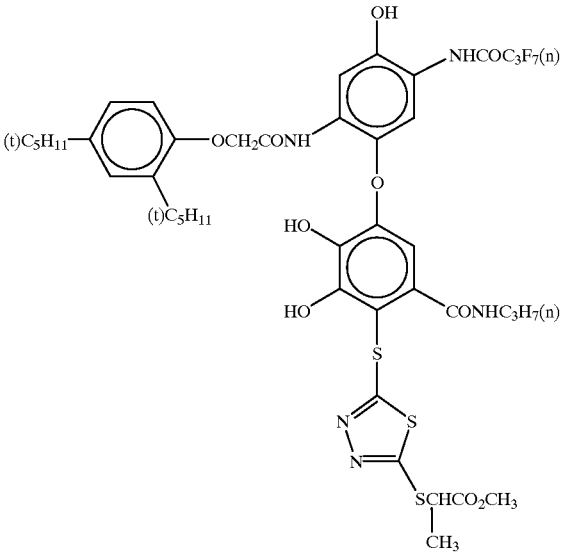

-continued
ExM-1
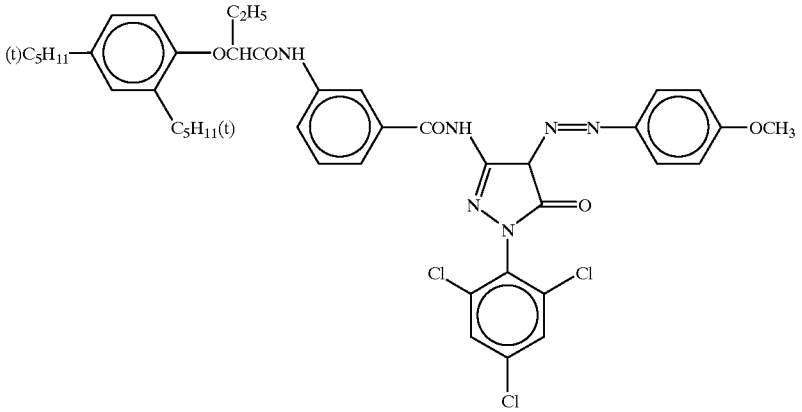
ExM-2
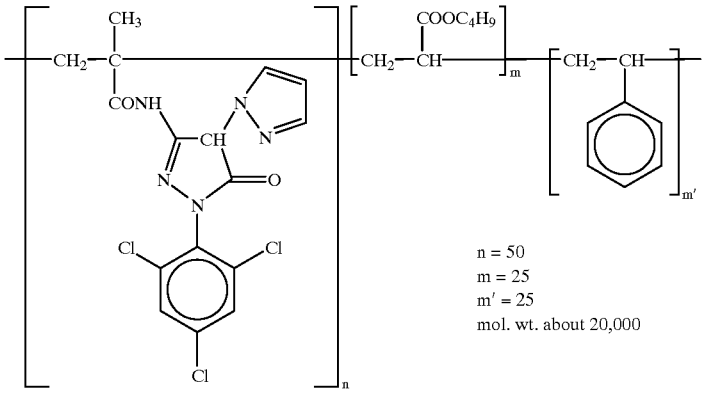
n = 50
m = 25
m′ = 25
mol. wt. about 20,000
ExM-3
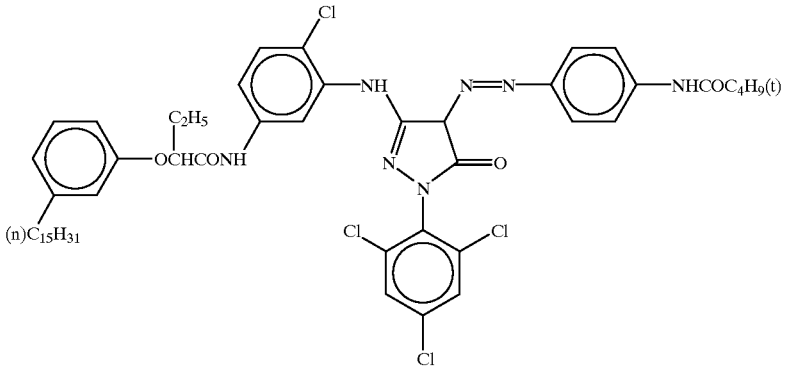
ExM-4
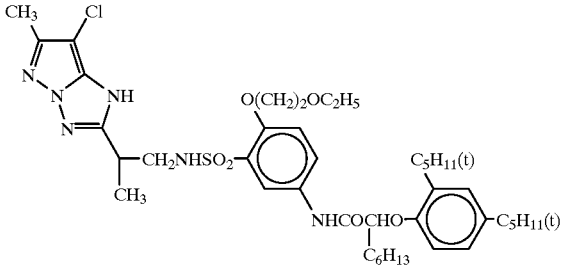
ExM-5
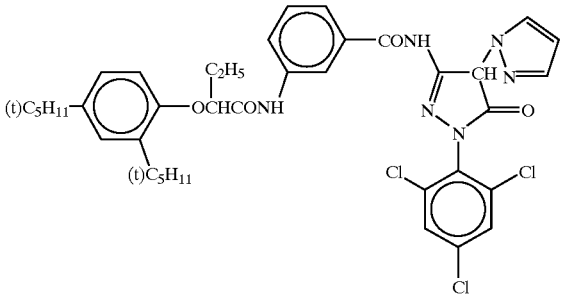

-continued
ExY-1
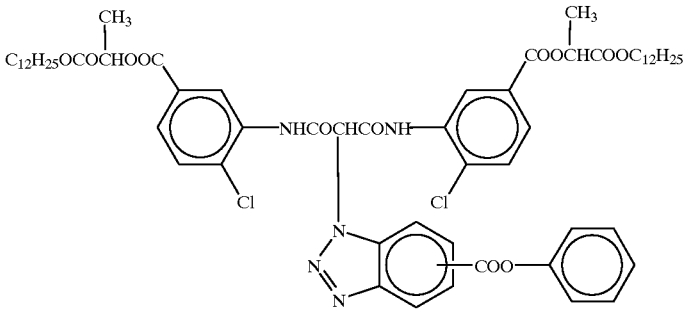
ExY-2
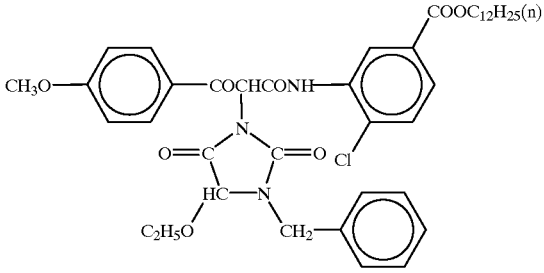
ExY-3
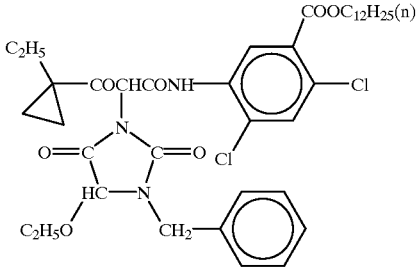
ExY-4
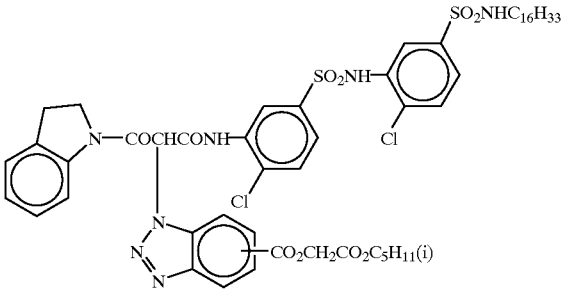
ExY-5
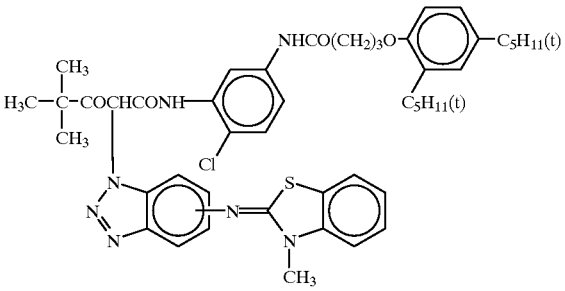
ExY-6
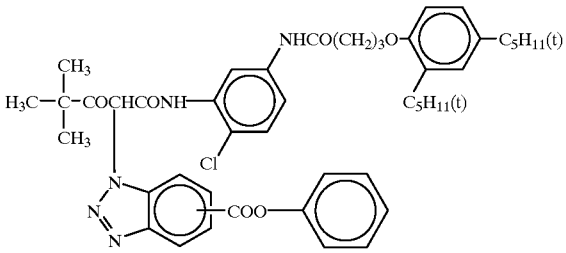
ExF-1
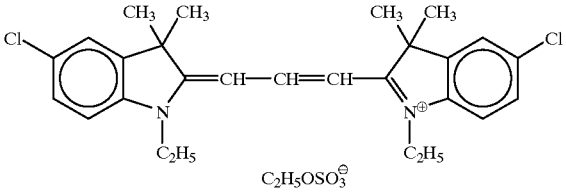
ExF-2
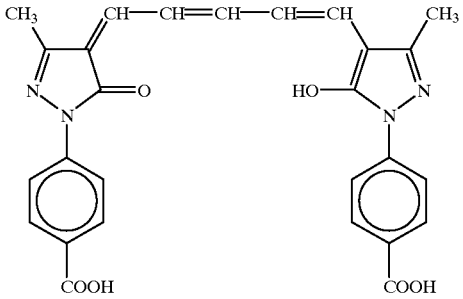
ExF-3
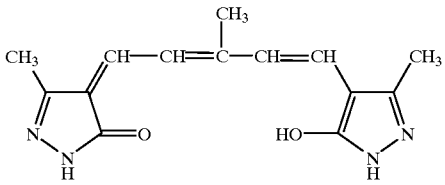

-continued
ExF-4
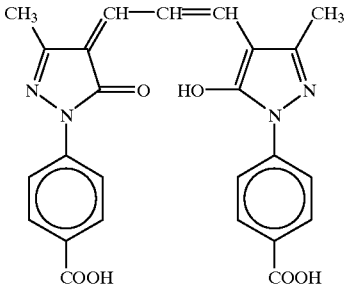
ExF-5
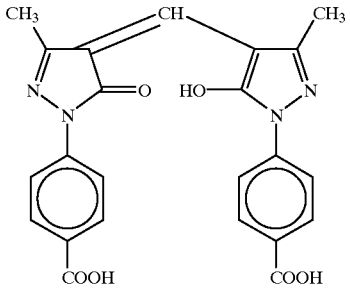
ExF-6
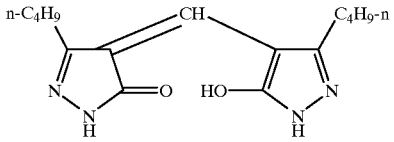
ExF-7
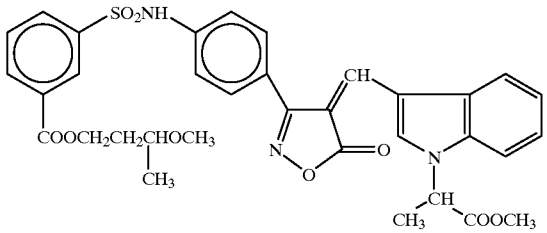
ExF-8
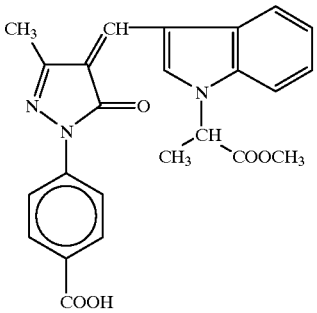
Cpd-1
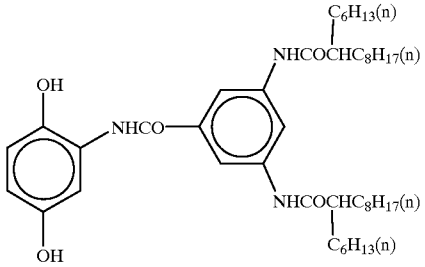
Cpd-2
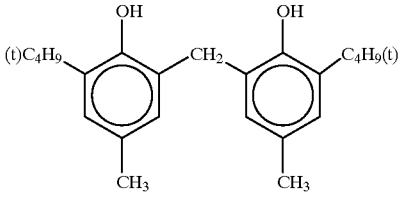
Cpd-3
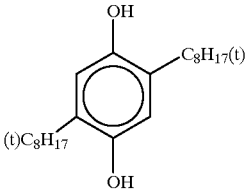
Cpd-4
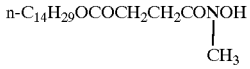
UV-1
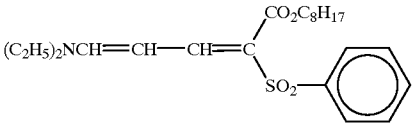
UV-2
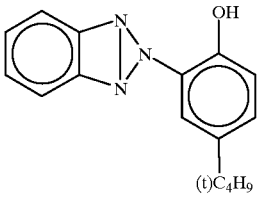
UV-3
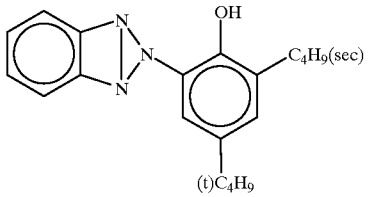

-continued
UV-4
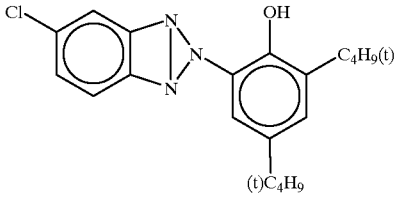
HBS-1
Tricresly phosphate
HBS-2
Di-n-butylphthalate
HBS-3
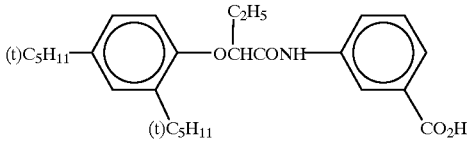
HBS-4
Tri(2-ethylhexyl)phosphate
ExS-1
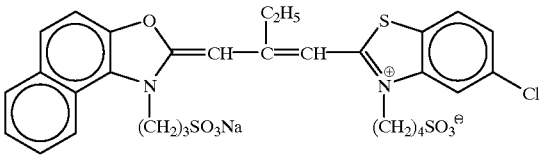
ExS-2
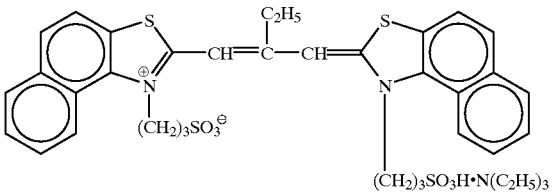
ExS-3
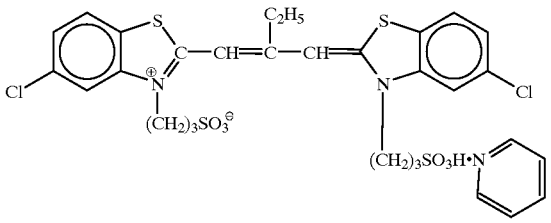
ExS-4
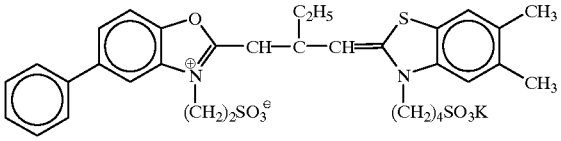
ExS-5
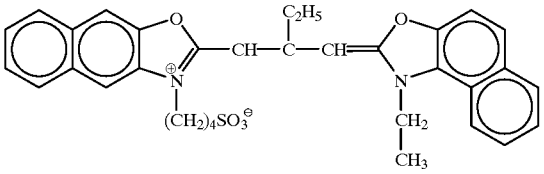
ExS-6
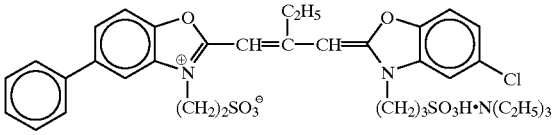
ExS-7
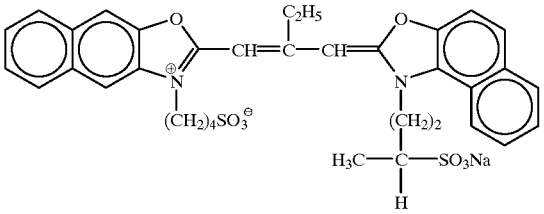
ExS-8
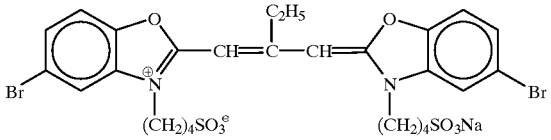
ExS-9
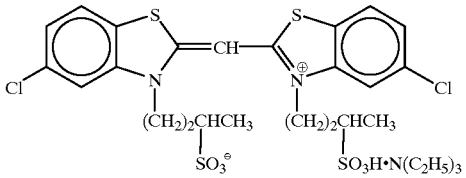

-continued
ExS-10
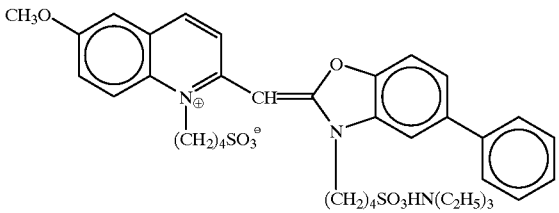
ExS-11
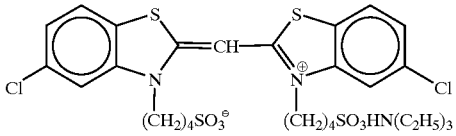
S-1
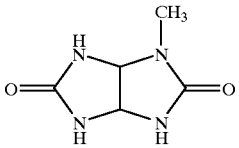
H-1
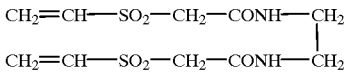
B-1
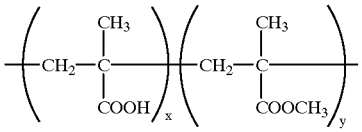
x/y = 10/90 (weight ratio) Av. mol. at.: about 35,000
B-2
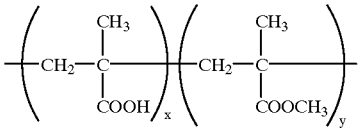
x/y = 40/60 (weight ratio) Av. mol. at.: about 20,000
B-3
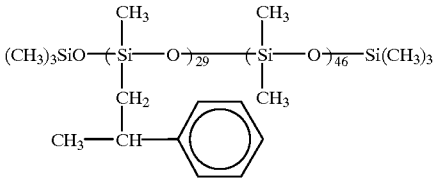
(molar ratio) Av. mol. at.: about 8,000
B-4
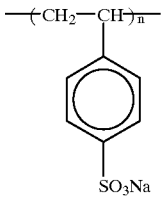
Av. mol. at.: about 750,000
B-5
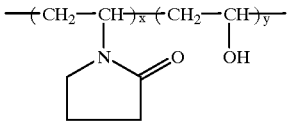
x/y = 70/30 (weight ratio) Av. mol. at.: about 17,000
B-6
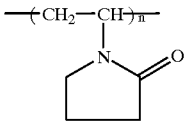
Av. mol. at.: about 10,000
W-1
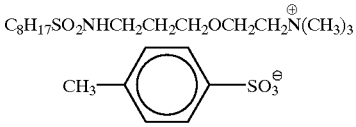
W-2
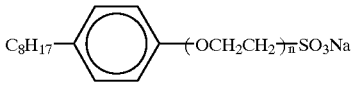
n = 2–4
W-3
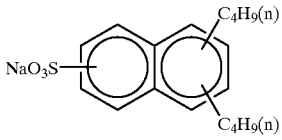
W-4
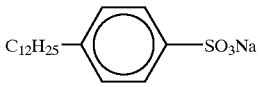
W-5
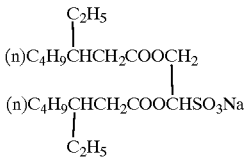
F-1
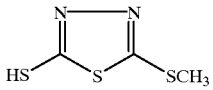

-continued
F-2
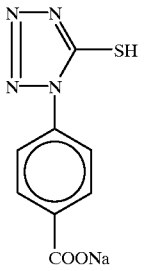
F-3
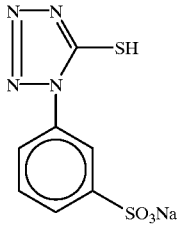
F-4
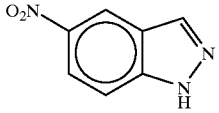
F-5
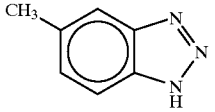
F-6
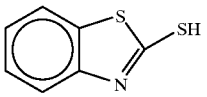
F-7
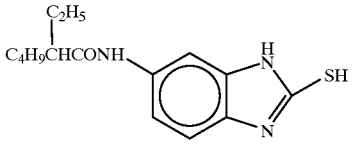
F-8
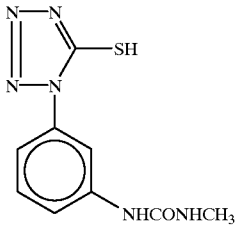
F-9
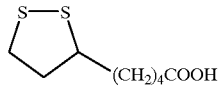
F-10
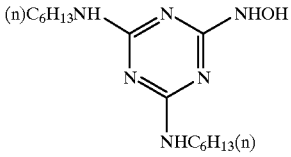
F-11
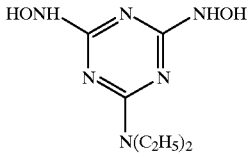
F-12
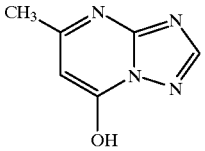
F-13
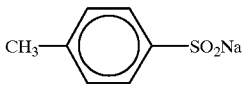
F-14
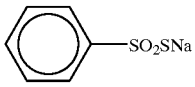
F-15
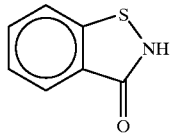
F-16
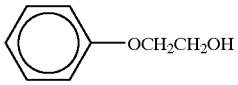
F-17
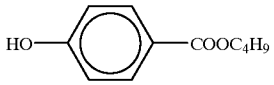
F-18
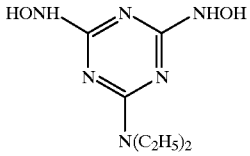

(Manufacture of Sample 102)

A sample 102 was manufactured following the same procedures as for the sample 101 in Example 1 except that ExC-1 and ExC-3 in the first layer were replaced with equal mols of a compound (A-21).

(Manufacture of Samples 103–105)

Samples 103 to 105 were manufactured following the same procedures as for the sample 102 except that the compound (A-21) was replaced with equal mols of compounds shown in Table 2.

(Manufacture of Sample 106)

A sample 106 was manufactured following the same procedures as for the sample 102 except that the compound (A-21) and the fogged emulsion Z in the first layer were moved to the fourth layer.

(Manufacture of Sample 107)

A sample 107 was manufactured following the same procedures as for the sample 103 except that the compound (A-24) and the fogged emulsion Z in the first layer were moved to the fourth layer.

(Manufacture of Sample 108)

A sample 108 was manufactured following the same procedures as for the sample 102 except that the compound (A-21) in the first layer was moved to the second layer. In this sample, a layer adjacent to the layer to which the fogged emulsion was added was coated with a "PUG releasing compound" (A-21).

(Evaluation of Desilvering Characteristics)

In this example, a bleaching accelerator was used as a photographically useful group. Hence, the releasing characteristics were evaluated by evaluating the desilvering characteristics of a light-sensitive material.

The above samples were wedge-exposed and developed by development process (1) below. At the same time, development process (2) by which an inferior solution was used only in a bleaching step in development process (1) was performed.

After the development, the density measurements were performed. The desilvering characteristics were evaluated in terms of an increase in the yellow density in development process (2) at an exposure amount by which a density of minimum yellow density+1.8 was given in development process (1). (Residual silver under inferior conditions was evaluated by optical density change).

The results are summarized in Table 2.

The methods of developing each sample will be described below.

Process (1)

| Step | Time | Temperature |
|---|---|---|
| Color development | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilization | 30 sec | 38° C. |
| Drying | 4 min 20 sec | 55° C. |

In process (2), the bleaching time was 2 min 30 sec.

The compositions of processing solutions were as follows.

| | (g) |
|---|---|
| (Color developer) | |
| Diethylenetriaminepentaacetic acid | 1.0 |
| 1-hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl) amino]-2-methylaniline sulfate | 4.5 |
| Water to make | 1.0 L |
| pH (controlled by potassium hydroxide and sulfuric acid) | 10.05 |
| (Bleach-fixing solution) | |
| Ferric sodium ethylenediamine tetraacetate trihydrate | 100.0 |
| Disodium ethylenediaminetetraacetate | 10.0 |
| 3-mercapto-1,2,4-triazole | 0.03 |
| Ammonium bromide | 140.0 |
| Ammonium nitrate | 30.0 |
| Ammonia water (27%) | 6.5 mL |
| Water to make | 1.0 L |
| pH (controlled by ammonia water and nitric acid) | 6.0 |
| (Fixer) | |
| Disodium ethylenediaminetetraacetate | 0.5 |
| Ammonium sulfite | 20.0 |
| Aqueous ammonium thiosulfate solution (700 g/L) | 295.0 mL |
| Acetic acid (90%) | 3.3 |
| Water to make | 1.0 L |
| pH (controlled by ammonia water and acetic acid) | 6.7 |
| (Stabilizer) | |
| p-Nonylphenoxypolyglycidol (glycidol average polymerization degree 10) | 0.2 |
| Ethylenediaminetetraacetate | 0.05 |
| 1,2,4-triazole | 1.3 |
| 1,4-bis(1,2,4-triazole-1-ylmethyl) piperazine | 0.75 |
| Hydroxyacetic acid | 0.02 |
| Hydroxyethylcellulose (DAISERU KAGAKU HEC SP-2000) | 0.1 |
| 1,2-benzoisothiazoline-3-one | 0.05 |
| Water to make | 1.0 L |
| pH | 8.5 |

(Evaluation of Storage Stability of Light-sensitive Materials)

In development process (1) in the evaluation of the desilvering characteristics described above, samples obtained by leaving the light-sensitive materials to stand at 50° C. and 55%RH for four days before exposure were simultaneously exposed and developed, thereby evaluating changes in the sensitivity of cyan image during storage. Sensitivity changes during storage were checked by using the sensitivity obtained by the logarithm of the reciprocal of an exposure amount by which minimum cyan density +1.2 was given.

The results are also summarized in Table 2.

(Evaluation of Color Development Process Fluctuation)

In development process (1) in the evaluation of the desilvering characteristics described above, similar evaluation was performed using a color developer in which the potassium bromide concentration was changed to 90% in the abovementioned color developer. In this manner, the value of a fog fluctuation in a cyan image was evaluated.

The process fluctuation is indicated by a relative value assuming that the density fluctuation of the sample 101 is 1.

The results are also summarized in Table 2.

TABLE 2

| Sample No. | Addition layer of fogged emulsion | Type and addition layer of PUG-releasing compound | Desilvering characteristics | Storage characteristics | Process fluctuation |
|---|---|---|---|---|---|
| 101 Comparative example | 1st layer | None | +0.27 | −0.03 | 1.0 (Control) |
| 102 Present invention | 1st layer | 1st layer A-21 | +0.03 | −0.03 | 1.0 |
| 103 Present invention | 1st layer | 1st layer A-24 | +0.03 | −0.03 | 1.0 |
| 104 Present invention | 1st layer | 1st layer (46) | +0.02 | −0.03 | 0.7 |
| 105 Present invention | 1st layer | 1st layer (123) | +0.02 | −0.03 | 0.7 |
| 106 Comparative example | 4th layer | 4th layer A-21 | +0.05 | −0.23 | 1.3 |
| 107 Comparative example | 4th layer | 4th layer A-24 | +0.05 | −0.24 | 1.3 |
| 108 Present invention | 1st layer | 2nd layer A-21 | +0.09 | −0.03 | 0.7 |

As shown in Table 2, each sample of the present invention increased the density little and exhibited good desilvering characteristics even when the inferior bleaching solution was used.

Table 2 also shows that the effect was decreased when a fogged emulsion and a "PUG releasing compound" were present in adjacent layers (the sample 108). In this respect, a fogged emulsion and a "PUG releasing compound" are preferably present in the same layer.

The samples 102 and 103 contained a "PUG releasing compound" which generated cyan. Although the desilvering characteristics and the storage stability were good, the fog fluctuations due to color development fluctuations were large. In this respect, it is more preferable that a "PUG releasing compound" is the compound that does not develop a color (does not generate any color-forming dye in a light-sensitive material).

In the samples 106 and 107, a fogged emulsion was added to light-sensitive silver halide emulsion layers. These samples are in the scope of JP-A-63-175850. However, the photographic property changes (sensitivity changes) due to storage were very large, so further improvements are necessary to put these light-sensitive materials into practical use.

EXAMPLE 2

In Example 2, a compound which releases a development inhibitor will be described below.

(Manufacture of Samples 201–204)

Samples 201 to 204 were manufactured following the same procedures as for the sample 102 in Example 1 except that the compound (A-21) in the first layer was changed to compounds shown in Table 3. Note that the coating amount was 0.1 times (mol) the coating amount of the compound in the first layer of the sample 102.

(Manufacture of Sample 205)

In the sample 101 of Example 1, the silver iodobromide emulsion O in the third layer was removed. Instead, the third layer was coated with 0.1 g/m$^2$ of the fogged emulsion Z formed in Example 1. The third layer was also coated with 0.01 g/m$^2$ of a compound (12).

(Manufacture of Sample 206)

In the sample 205, the fogged emulsion Z and the compound (12) in the third layer were removed. Instead, a comparative compound (a) was added in the same molar amount as that of the compound (12).

Comparative compound (a)

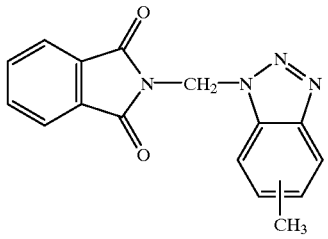

(A compound described in JP-B-4-73573)

(Minimum Density Fluctuations Due to Color Development)

Evaluation analogous to (evaluation of color development fluctuations) in Example 1 was performed.

Additionally, similar evaluation was performed by multiplying, by 0.7 times, the amount of hydroxylamine sulfate in development process (1) of Example 1.

(Evaluation of Storage Stability)

Evaluation similar to (evaluation of storage stability of light-sensitive materials) in Example 1 was performed.

TABLE 3

| Sample No. | Addition layer of fogged emulsion | Type and addition layer of PUG releasing compound | Fog fluctuation | Fog fluctuation | Storage characteristics |
|---|---|---|---|---|---|
| 101 Comparative example | 1st layer | None | 1.0 (Reference) | 1.0 (Reference) | −0.03 |
| 201 Present invention | 1st layer | 1st layer (12) | 0.50 | 0.8 | −0.03 |
| 202 Present invention | 1st layer | 1st layer (106) | 0.52 | 0.8 | −0.04 |
| 203 Present invention | 1st layer | 1st layer A-4 | 0.6 | 0.8 | −0.04 |
| 204 Comparative example | 1st layer | 1st layer Comparative compound (a) described in JP-B-4-73573 | 0.8 | 1.1 | −0.25 |
| 205 Present invention | 3rd layer | 3rd layer (12) | 0.7 | 0.8 | −0.03 |
| 206 Comparative example | (not added) | 3rd layer Comparative compound (a) described in JP-B-4-73573 | 0.9 | 1.1 | −0.27 |

The results of Example 2 indicate that each sample of the present invention had a small fog fluctuation and high storage stability.

By contrast, although the compound described in JP-B-4-73573 had an effect on the fog fluctuation (concentration fluctuation of potassium bromide), its effect of improving the dependence of hydroxylamine sulfate on density was not large. Also, the compound requires improvement in respect of storage stability.

EXAMPLE 3

Samples 301 and 302 (color papers) described below were manufactured.

Corona discharge was performed on the surfaces of a support formed by coating the two surfaces of a paper sheet with polyethylene resin. After that, a gelatin undercoating layer containing sodium dodecylbenzenesulfonate was formed. In addition, first to seventh photographic constituting layers were sequentially formed by coating, thereby manufacturing a sample (301) of a silver halide color light-sensitive material having the following layer arrangement. Coating solutions of the individual photographic constituting layers were prepared as follows. Preparation of 5th layer coating solution 300 g of a cyan coupler (ExC-1), 250 g of a color image stabilizer (Cpd-1), 10 g of a color image stabilizer (Cpd-10), 20 g of a color image stabilizer (Cpd-12), 14 g of an ultraviolet absorbent (UV-1), 50 g of an ultraviolet absorbent (Uv-2), 40 g of an ultraviolet absorbent (UV-3), and 60 g of an ultraviolet absorbent (UV-4) were dissolved in 230 g of a solvent (Solv-6) and 350 mL of ethyl acetate. The resultant solution was emulsion-dispersed in 6,500 g of an aqueous 10% gelatin solution containing 25 g of a surfactant (Cpd-20) to prepare an emulsion dispersion C.

Separately, a silver chlorobromide emulsion C (cubic, a 5:5 mixture (silver molar ratio) of a large-size emulsion C having an average grain size of 0.40 $\mu$m and a small-size emulsion C having that of 0.30 $\mu$m; variation coefficients of grain size distributions of the two emulsions were 0.09 and 0.11; in both of the two emulsions, 0.5 mol % of silver bromide was locally contained in a portion of the surface of a grain having silver chloride as a substrate) was prepared.

Each of red-sensitive sensitizing dyes G and H presented below was added in amounts of $9.0\times10^{-5}$ mol and $12.0\times10^{-5}$ mol, per mol of silver, to the large-size emulsion C and the small-size emulsion C, respectively. Chemical ripening of the emulsion was optimally performed by adding a sulfur sensitizer and a gold sensitizer.

The emulsion dispersion C and this silver chlorobromide emulsion C were mixed and dissolved to prepare a fifth layer coating solution having a composition presented later. The emulsion coating amount indicates the coating amount of silver.

Coating solutions of the first to fourth layers and the sixth and seventh layers were also prepared following the same procedures as for the fifth layer coating solution. As gelatin hardeners in the individual layers, H-1, H-2, and H-3 were used.

Also, Ab-1, Ab-2, Ab-3, and Ab-4 were added in total amounts of 15.0, 60.0, 5.0, and 10.0 mg/m$^2$, respectively, to each layer.

(H-1)Hardner

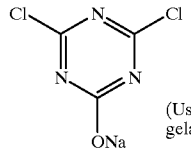

(Used in an amount of 0.50 wt.% of gelatin)

-continued (H-2)Hardner

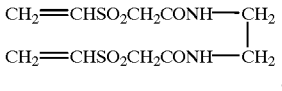

(Used in an amount of 1.20 wt.% of gelatin)

(H-3)Hardner

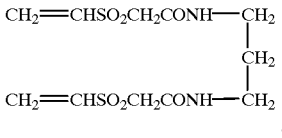

(Used in an amount of 0.40 wt.% of gelatin)

(Ab-1)Antiseptic

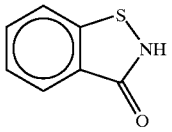

(Ab-2)Antiseptic

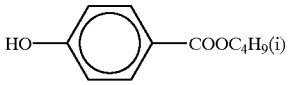

(Ab-3)Antiseptic

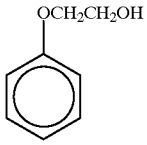

(Ab-4)Antiseptic

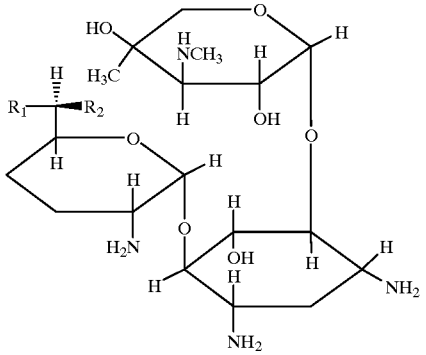

-continued

| | $R_1$ | $R_2$ |
|---|---|---|
| a | $-CH_3$ | $-NHCH_3$ |
| b | $-CH_3$ | $-NH_2$ |
| c | $-H$ | $-NH_2$ |
| d | $-H$ | $-NHCH_3$ |

A mixture of a:b:c:d in a molar ratio of 1:1:1:1

Spectral sensitizing dyes and a crystal phase controller 1 were used in the silver chlorobromide emulsion of each photosensitive emulsion layer.

<Blue-sensitive emulsion layer>

Sensitizing dye A

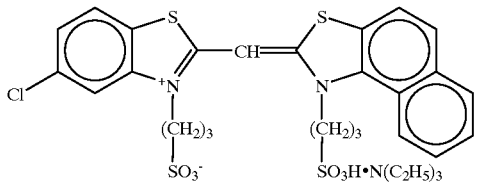

Sensitizing dye B

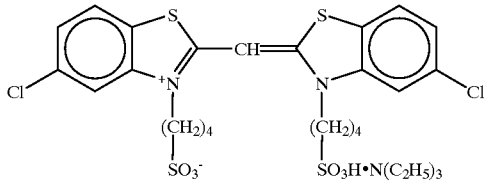

Sensitizing dye C

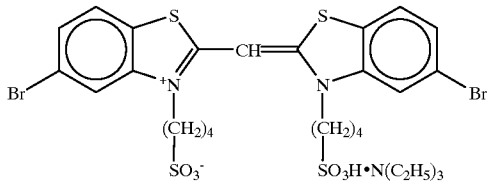

Crystal habit controler 1

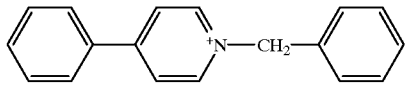

(Each of sensitizing dyes A and C was added in amounts of $0.42\times10^{-4}$ mol and $0.05\times10^{-4}$ mol, per mol of a silver halide, to the large-size emulsion and the small-size emulsion, respectively. A sensitizing dye B was added in amounts of $3.4\times10^{-4}$ mol and $4.1\times10^{-4}$ mol, per mol of a silver halide, to the large-size emulsion and the small-size emulsion, respectively.)

<Green-sensitive emulsion layer>

Sensitizing dye D

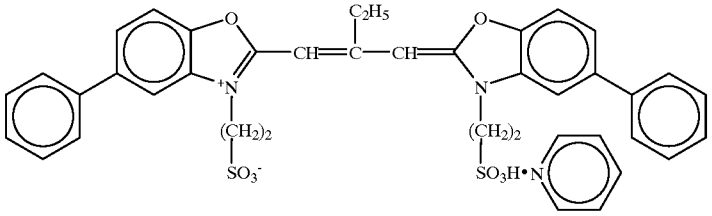

Sensitizing dye E

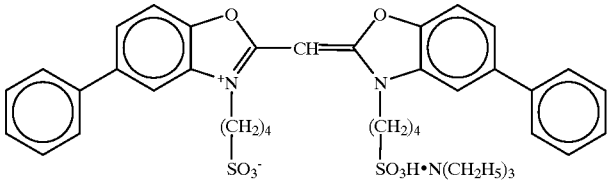

Sensitizing dye F

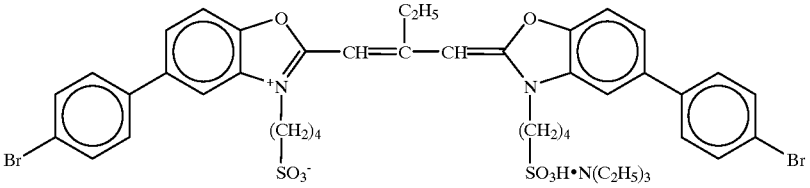

(A sensitizing dye D was added in amounts of $3.0\times10^{-4}$ mol and $3.6\times10^{-4}$ mol, per mol of a silver halide, to the large-size emulsion and the small-size emulsion, respectively. A sensitizing dye E was added in amounts of $4.0\times10^{-5}$ mol and $7.0\times10^{-5}$ mol, per mol of a silver halide, to the large-size emulsion and the small-size emulsion, respectively. A sensitizing dye F was added in amounts of $2.0\times10^{-4}$ mol and $2.8\times10^{-4}$ mol, per mol of a silver halide, to the large-size emulsion and the small-size emulsion, respectively.)

<Red-sensitive emulsion layer>

Sensitizing dye G

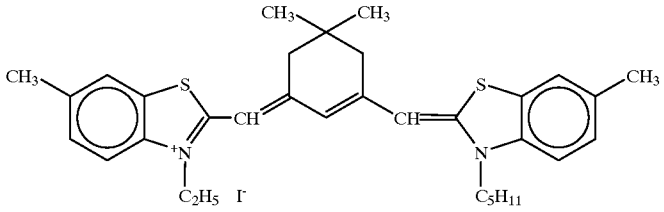

-continued

Sensitizing dye H

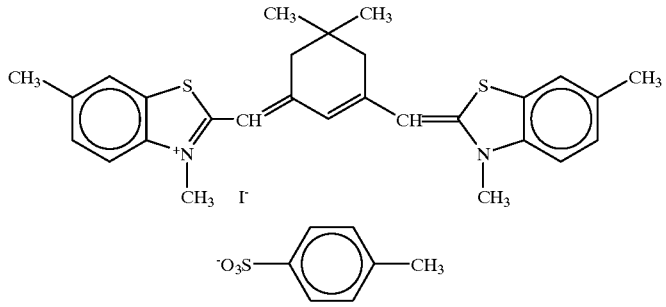

(Each of sensitizing dyes G and H was added in amounts of $8.0\times10^{-5}$ mol and $10.7\times10^{-5}$ mol, per mol of a silver halide, to the large-size emulsion and the small-size emulsion, respectively.)

In addition, a compound I presented below was added in an amount of $3.0\times10^{-3}$ mol, per mol of a silver halide, to the red-sensitive layer.

Compound I

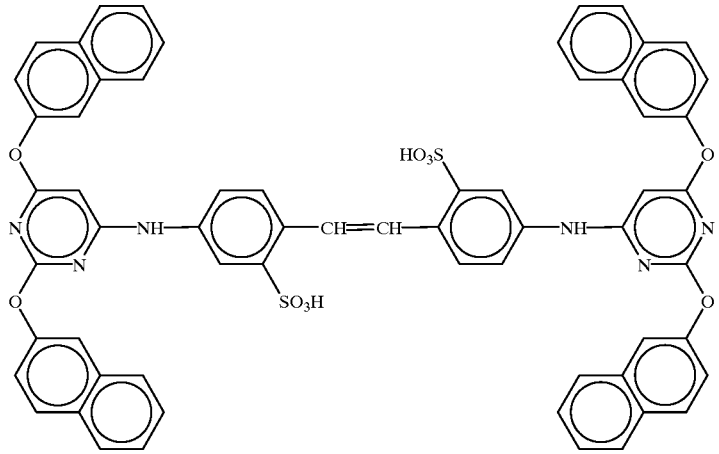

Also, to each of the blue-, green-, and red-sensitive emulsion layers, 1-(3-methylureidophenyl)-5-mercaptotetrazole was added in amounts of $3.3\times10^{-4}$ mol, $1.0\times10^{-3}$ mol, and $5.9\times10^{-4}$ mol, respectively, per mol of a silver halide.

Furthermore, 0.2, 0.2, 0.6, and 0.1 mg/m$^2$ of the same compound were added to the second, fourth, sixth, and seventh layers, respectively.

To the blue- and green-sensitive emulsion layers, $1\times10^{-4}$ mol and $2\times10^{-4}$ mol, respectively, of 4-hydroxy-6-methyl-1,3,3a,7-tetrazaindene were added per mol of a silver halide.

0.05 g/m$^2$ of a copolymer latex (weight ratio 1:1, average molecular weight 200,000 to 400,000) of methacrylic acid and butyl acrylate was added to the red-sensitive emulsion layer.

Disodium catechol-3,5-disulfonate was added in amounts of 6, 6, and 18 mg/m$^2$ to the second, fourth, and sixth layers, respectively.

To prevent irradiation, the following dyes were added (the numbers in parentheses indicate the coating amounts).

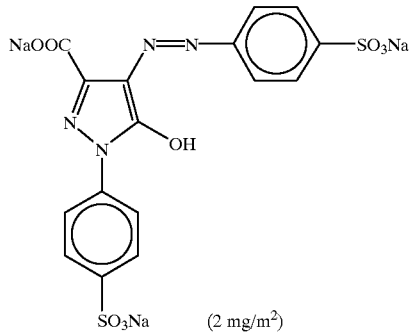

(2 mg/m$^2$)

-continued

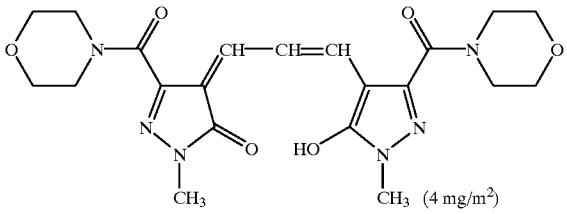

(4 mg/m²)

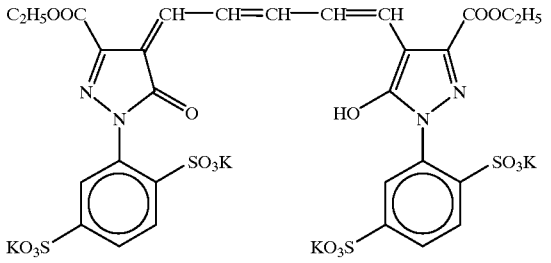

(9 mg/m²)

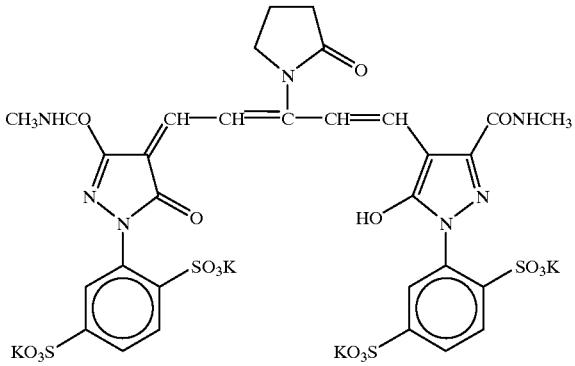

(9 mg/m²)

(Layer Arrangement)

The composition of each layer will be described below. The numbers represent coating amounts (g/m²). The coating amount of each silver halide emulsion is represented by the coating amount of silver.

Support

Polyethylene Resin Laminate Paper

{Polyethylene resin on the first layer side contained a white pigment ($TiO_2$; content 16 wt %, ZnO; content 4 wt %), a brightening agent (4,4'-bis-(5-methylbenzoxazolyl) stilbene; content 0.03 wt %), and a blue dye (ultramarine)}.

1st layer (Blue-sensitive emulsion layer)

Silver chlorobromide emulsion A (cubic, a 5:5 mixture (silver molar ratio) of a large-size emulsion A having an average grain size of 0.72 μm and a small-size emulsion A having that of 0.06 μm; variation coefficients of grain size distributions of the two emulsions were 0.08 and 0.10; in both of the two emulsions, 0.3 mol % of silver bromide was locally contained in a portion of the surface of a grain having silver chloride as a substrate) 0.24

| | |
|---|---|
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |

-continued

| | |
|---|---|
| 2nd layer (Color-mixing preventing layer) | |
| Gelatin | 0.99 |
| Color-mixing preventing agent (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| 3rd layer (Green-sensitive emulsion layer) | |
| Silver chlorobromide emulsion B (cubic, a 1:3 mixture (silver molar ratio) of a large-size emulsion B having an average grain size of 0.45 μm and a small-size emulsion B having that of 0.35 μm; variation coefficients of grain size distributions of the two emulsions were 0.10 and 0.08; in both of the two emulsions, 0.4 mol % of silver bromide was locally contained in a portion of the surface of a grain having silver chloride as a substrate) | 0.14 |
| Gelatin | 1.36 |
| Magenta coupler (ExM) | 0.15 |
| Ultraviolet absorbent (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| 4th layer (Color-mixing preventing layer) | |
| Gelatin | 0.71 |
| Color-mixing preventing agent (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| 5th layer (Red-sensitive emulsion layer) | |
| Silver chlorobromide emulsion C (cubic, a 5:5 mixture (silver molar ratio) of a large-size emulsion C having an average grain size of 0.40 μm and a small-size emulsion C having that of 0.30 μm; variation coefficients of grain size distributions of the two emulsions were 0.09 and 0.11; in both of the two emulsions, 0.5 mol % of silver bromide was locally contained in a portion of the surface of a grain having silver chloride as a substrate) | 0.20 |
| Gelatin | 1.11 |
| Cyan coupler (ExC-1) | 0.30 |
| Ultraviolet absorbent (UV-A) | 0.29 |
| Color image stabilizer (Cpd-1) | 0.25 |
| Color image stabilizer (Cpd-9) | 0.01 |
| Color image stabilizer (Cpd-10) | 0.01 |
| Color image stabilizer (Cpd-12) | 0.02 |
| Solvent (Solv-6) | 0.23 |
| 6th layer (Ultraviolet absorbing layer) | |
| Gelatin | 0.46 |
| Ultraviolet absorbent (UV-B) | 0.45 |
| Solvent (Solv-7) | 0.25 |
| 7th layer (Protective layer) | |
| Gelatin | 1.00 |
| Acryl-modified copolymer of polyvinyl alcohol (modification degree 17%) | 0.04 |
| Liquid paraffin | 0.02 |
| Surfactant (Cpd-13) | 0.01 |

<Manufacture of sample 302>

A sample 302 was manufactured by changing, as presented below, the composition of the fifth layer of the silver halide color light-sensitive material 301 manufactured as above.

| 5th layer (Red-sensitive emulsion layer) | |
|---|---|
| Silver chlorobromide emulsion C (cubic; a 5:5 mixture (silver molar ratio) of a large-size emulsion C having an average grain size of 0.40 μm and a small-size emulsion C having that of 0.30 μm; variation coefficients of grain size distributions of the two emulsions were 0.09 and 0.11; in both of the two emulsions, 0.8 mol % of silver bromide was locally contained in a portion of the surface of a grain having silver chloride as a substrate) | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |

The structures of the compounds in these samples 301 and 302 were as follows.

(ExY) Yellow couplers: A mixture of:

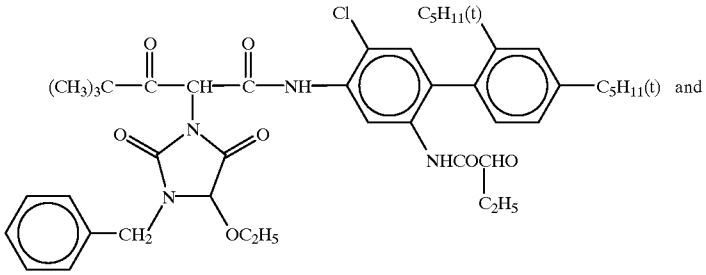

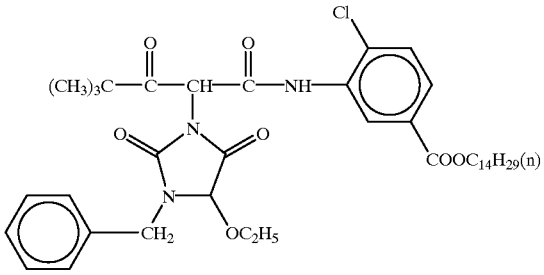

in a molar ratio of 70:30.

(ExM) Magenta couplers: A mixture of:

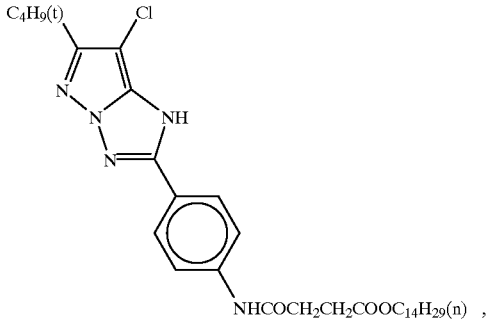

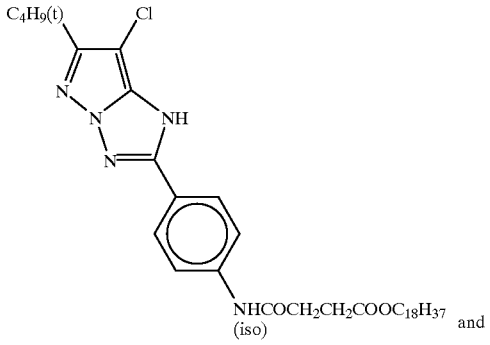

-continued
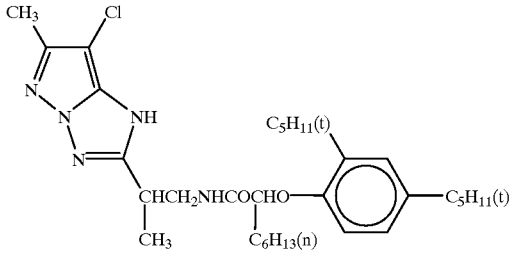
in a molar ratio of 40:40:20.
(ExC-1) Cyan couplers: A mixture of:
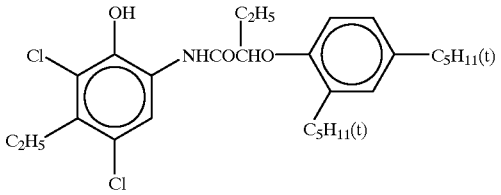
and
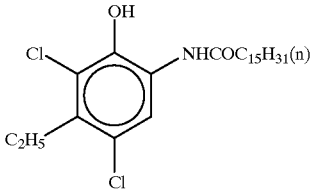
in a molar ratio of 15:85.
(EXC-2) Cyan coupler
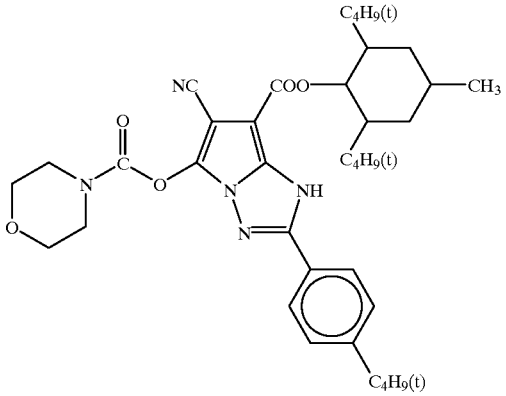
(ExC-3) Cyan couplers: A mixture of:
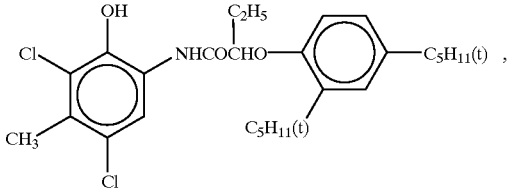
-continued
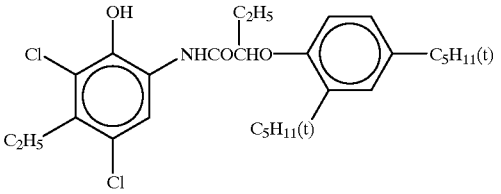
and
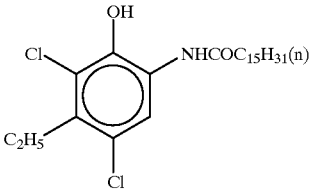
in a molar ratio of 50:25:25.
(Cpd-1) Color image stabilizer
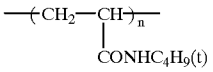
Number average molecular weight 60,000
(Cpd-2) Color image stabilizer
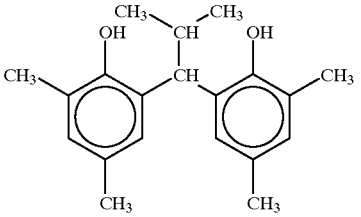
(Cpd-3) Color image stabilizer
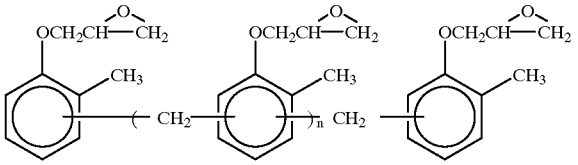
n = 7 - 8(average)
(Cpd-4) Color-mixing inhibitor
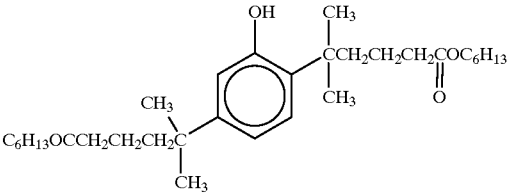
(Cpd-5) Color-mixing preventing agent
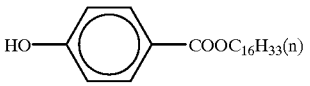

-continued
(Cpd-6) Stabilizer
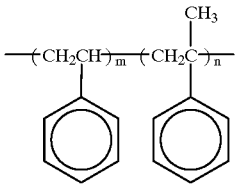
Number average molecular weight 600
m / n = 10 / 90
(Cpd-7) Color-mixing inhibitor
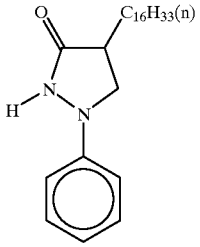
(Cpd-8) Color image stabilizer
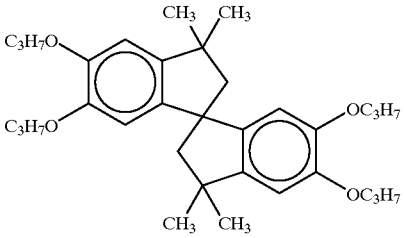
(Cpd-9) Color image stabilizer
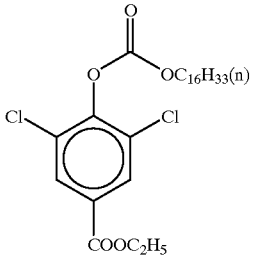
(Cpd-10) Color image stabilizer
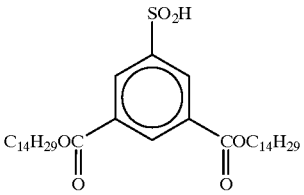
(Cpd-11)
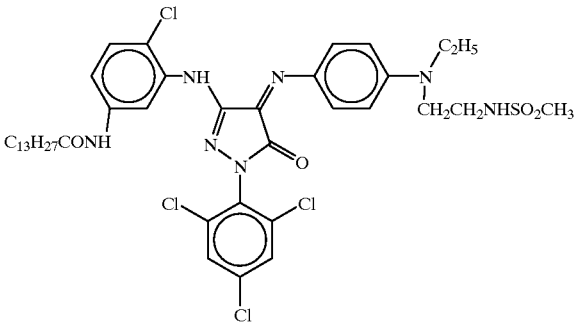
-continued
(Cpd-12) Color image stabilizer
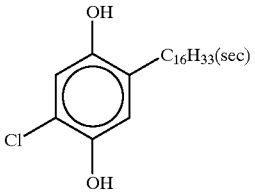
(Cpd-13) Surfactants: A 7:3 mixture of:
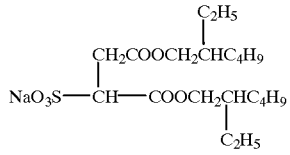
and
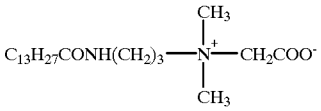
(Cpd-14)
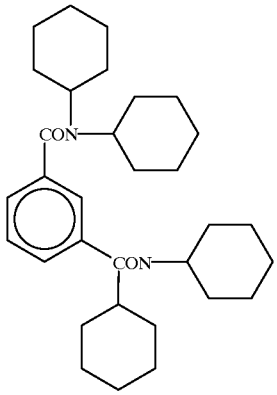
(Cpd-15)
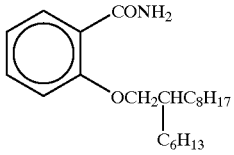
(Cpd-16)
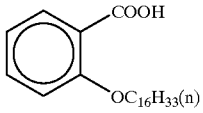
(Cpd-17)
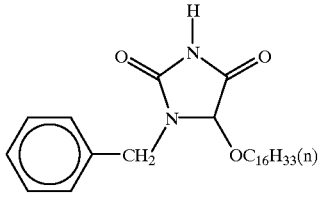
(Cpd-18)
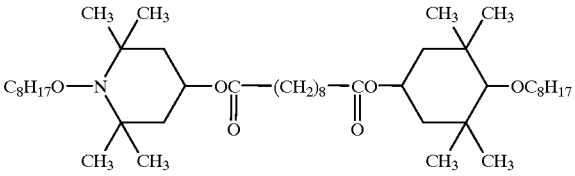

-continued (Cpd-19) Color-mixing inhibitor

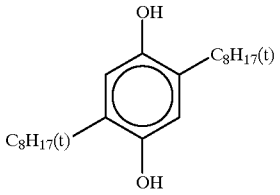

(Cpd-20) Surfactants: A mixture of

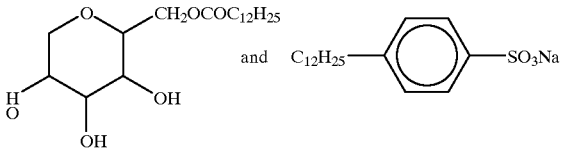

in a molar ratio of 1: 4.

(UV - 1) UV absorber

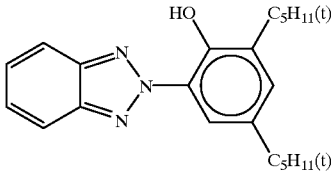

(UV - 2) UV absorber

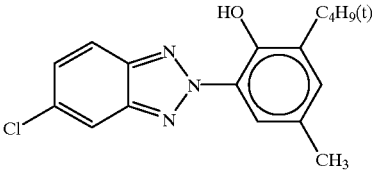

(UV - 3) UV absorber

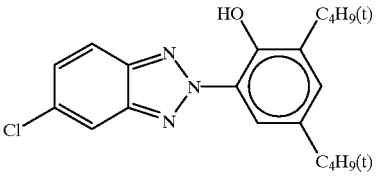

(UV - 4) UV absorber

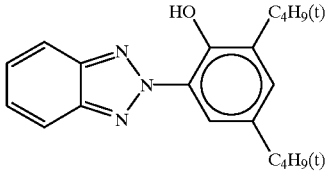

(UV - 5) UV absorber

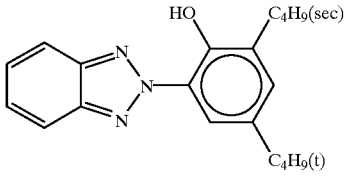

(UV - 6) UV absorber

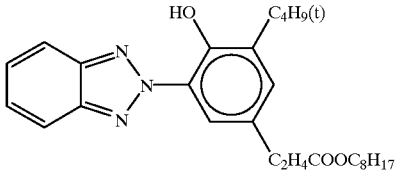

-continued (UV - 7) UV absorber

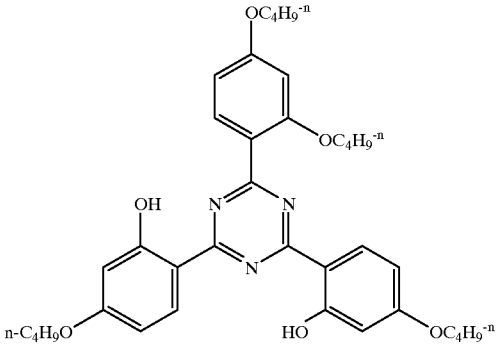

UV-A: A mixture in a weight ratio of UV-1/UV-2/UV-3/UV-4=4/2/2/3

UV-B :A mixture in a weight ratio of UV-1/UV-21UV-3/UV-4/UV-5/UV-6=9/3/3/41513

UV-C : A mixture in a weight ratio of UV-2/UV-31UV-6/UV-7=1/1/1/2

(Solv -1)

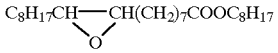

(Solv -2)

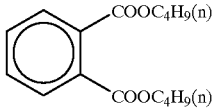

(Solv -3)

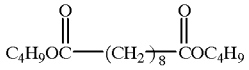

(Solv -4)

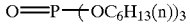

(Solv -5)

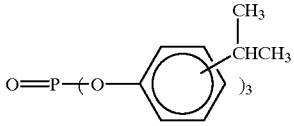

(Solv -6) A mixture of

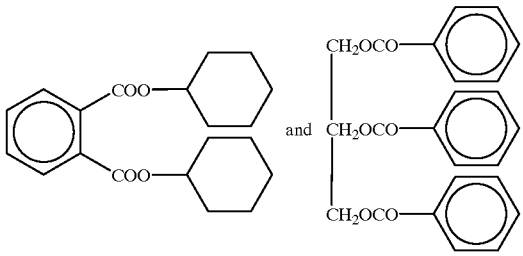

in a weight ratio of 1:1.

(Solv -7)

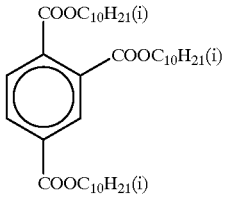

-continued (Solv -8)

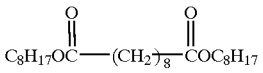

A sample 303 was manufactured following the same procedures as for the sample 301 except that a layer (PUG releasing unit) containing 0.6 g/m$^2$ of gelatin, 0.06 g/m$^2$ (in terms of silver amount) of a fogged emulsion Y, and 0.01 g/m$^2$ of the compound (12) was formed between the support and the first layer.

A sample 304 was manufactured following the same procedures as for the sample 302 except that a layer (PUG releasing unit) containing 0.6 g/m$^2$ of gelatin, 0.06 g/m$^2$ (in terms of silver amount) of the fogged emulsion Y, and 0.01 g/m$^2$ of the compound (12) was formed between the support and the first layer. A method of preparing the fogged emulsion Y will be described later.

A sample 305 was manufactured following the same procedures as for the sample 301 except that 0.06 g/m$^2$ (in terms of silver amount) of the fogged emulsion Y and 0.01 g/m$^2$ of a compound (106) were added to the seventh layer.

A sample 306 was manufactured following the same procedures as for the sample 302 except that 0.06 g/m$^2$ (in terms of silver amount) of the fogged emulsion Y and 0.01 g/m$^2$ of the compound (106) were added to the seventh layer.

These samples manufactured as above were evenly exposed and subjected to development in which stirring in the color developing step was intentionally weakened. Variations in the process were visually observed and evaluated.

As a result, process fluctuations in the light-sensitive materials of the present invention were obviously small.

<Preparation of emulsion Y>

2.0 of an aqueous 1% inert gelatin solution were stirred and dissolved at 35° C. 0.66 mol of sodium chloride and 0.6 mol of silver nitrate were added by the double jet method over 4 min at the same fixed flow rate. 0.1 g of chloroauric acid and 0.02 mol of sodium hydroxide were added, and the resultant material was stirred for 10 min. After that, 0.4 mol of sodium chloride was added to obtain grains having an average grain size of 0.1 $\mu$m. After these grains were washed with water, 100 g of inert gelatin were added to disperse the grains, thereby preparing the emulsion Y having surface fog nuclei.

Processing A

This light-sensitive material 305 was formed into a 127-mm wide roll and imagewise exposed by using the PP1258AR mini-lab printer processor available from Fuji Photo Film Co., Ltd. After that, continuous processing (running test) was performed by the following processing steps until a replenisher twice the color developing tank volume was replenished. Processing using this running solution was processing A.

| Step | Temperature | Time | Replenishment rate* |
|---|---|---|---|
| Color development | 38.5° C. | 45 sec | 45 mL |
| Bleach-fixing | 38.0° C. | 45 sec | 35 mL |
| Rinsing (1) | 38.0° C. | 20 sec | — |
| Rinsing (2) | 38.0° C. | 20 sec | — |
| Rinsing (3) | **38.0° C. | 20 sec | — |
| Rinsing (4) | **38.0° C. | 30 sec | 121 mL |

*The replenishment rate per m$^2$ of a light-sensitive material.

**The RC50D rinse cleaning system manufactured by Fuji Photo Film Co., Ltd. was used in rinsing (3) to extract a rinsing solution from rinsing (3), and the solution was supplied to a reverse osmotic membrane module (RC50D) by a pump. Transmitted water obtained in this tank was supplied to rinsing (4), and concentrated water was returned to rinsing (3). The pump pressure was so adjusted that the transmitted water amount to the reverse osmotic module was kept at 50 to 300 mL/min. The water was circulated at controlled temperature ten hours a day (rinsing was performed by a tank counterflow system from (1) to (4)).

The compositions of the individual processing solutions were as follows.

| | (tank solution) | (replenisher) |
|---|---|---|
| (Color developer) | | |
| Water | 800 mL | 800 mL |
| Dimethylpolysiloxane-based surfactant (SILICONE KF351A/Shin-Etsu Chemical Co., Ltd.) | 0.1 g | 0.1 g |
| Tri(isopropanol)amine | 8.8 g | 8.8 g |
| Ethylenediaminetetraacetic acid | 4.0 g | 4.0 g |
| Polyethyleneglycol (molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-based brightening agent (HAKKOL FWA-SF/Showa Chemical Industry Co., Ltd.) | 2.5 g | 5.0 g |
| Sodium sulfite | 0.1 g | 0.1 g |
| Disodium-N,N-bis(sulfonatoester)hydroxylamine | 8.5 g | 11.1 g |
| N-ethyl-N-(β-methanesufoneamindoethyl)-3-methyl-4-amino-4-aminoaniline.3/2sulfuric acid.monohydrate | 5.0 g | 15.7 g |
| Potassium carbonate | 26.3 g | 26.3 g |
| Water to make | 1,000 mL | 1,000 mL |
| pH (25° C./adjusted by potassium hydroxide and sulfuric acid) | 10.15 | 12.50 |
| Bleach-fixing solution | | |
| Water | 700 mL | 600 mL |
| Iron (III) ethylenediaminetetraacetate ammonium | 47.0 g | 94.0 g |
| Ethylenediaminetetraacetic acid | 1.4 g | 2.8 g |
| m-Carboxybenzenesulfinic acid | 8.3 g | 16.5 g |
| Acetic acid (67%) | 16.5 g | 33.0 g |
| Imidazole | 14.6 g | 29.2 g |
| Ammonium thiosulfate (750 g/L) | 107.0 mL | 214.0 mL |
| Ammonium sulfite | 16.0 g | 32.0 g |
| Ammonium bisulfite | 23.1 g | 46.2 g |
| Water to make | 1,000 mL | 1,000 mL |
| pH (25° C./adjusted by acetic acid and ammonia) | 6.0 | 6.0 |
| Rinsing solution | | |
| Chlorinated sodium isocyanurate | 0.02 g | 0.02 g |
| Deionized water (conductivity 5 $\mu$s/cm or less) | 1,000 mL | 1,000 mL |
| pH | 6.5 | 6.5 |

EXAMPLE 4

An undercoated cellulose triacetate film support was coated with multiple layers having the following compositions to manufacture a sample 401 as a multilayered color sensitive material.

(Compositions of Sensitive Layers)

The number corresponding to each component indicates the coating amount in units of g/m$^2$. The coating amount of a silver halide is indicated by the amount of silver. The coating amount of each sensitizing dye is indicated in units of mols per mol of a silver halide in the same layer.

(Sample 401)

| | | |
|---|---|---|
| 1st layer (1st antihalation layer) | | |
| Silver iodobromide emulsion P | silver | 0.01 |
| Black colloidal silver | silver | 0.05 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (2nd antihalation layer) | | |
| Black colloidal silver | silver | 0.04 |
| Gelatin | | 0.407 |
| ExM-1 | | 0.050 |
| ExF-1 | | $2.0 \times 10^{-3}$ |
| HBS-1 | | 0.074 |
| Solid disperse dye ExF-2 | | 0.030 |
| 3rd layer (Interlayer) | | |
| Polyethylacrylate latex | | 0.085 |
| Gelatin | | 0.294 |
| 4th layer (Low-speed red-sensitive emulsion layer) | | |
| Silver iodobromide emulsion A | silver | 0.300 |
| ExS-1 | | $3.8 \times 10^{-4}$ |
| ExS-2 | | $1.0 \times 10^{-5}$ |
| ExS-3 | | $2.4 \times 10^{-4}$ |
| ExS-4 | | $1.0 \times 10^{-4}$ |
| ExS-12 | | $2.7 \times 10^{-4}$ |
| ExC-1 | | 0.109 |
| ExC-3 | | 0.044 |
| ExC-4 | | 0.72 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion B | silver | 0.24 |
| Silver iodobromide emulsion C | silver | 0.60 |
| ExS-1 | | $4.8 \times 10^{-4}$ |
| ExS-2 | | $1.8 \times 10^{-5}$ |
| ExS-3 | | $2.8 \times 10^{-4}$ |
| ExS-4 | | $0.7 \times 10^{-4}$ |
| ExS-12 | | $1.8 \times 10^{-4}$ |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodobromide emulsion D | silver | 1.20 |
| ExS-1 | | $3.4 \times 10^{-4}$ |
| ExS-2 | | $1.4 \times 10^{-5}$ |
| ExS-3 | | $2.2 \times 10^{-4}$ |
| ExS-4 | | $0.5 \times 10^{-4}$ |
| ExS-12 | | $1.8 \times 10^{-4}$ |
| ExC-3 | | 0.07 |
| ExC-6 | | 0.029 |

-continued

| | | |
|---|---|---|
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (layer for donating interlayer effect to red-sensitive layer) | | |
| Silver iodobromide emulsion E | silver | 0.560 |
| ExS-6 | | $2.8 \times 10^{-4}$ |
| ExS-10 | | $5.9 \times 10^{-4}$ |
| Cpd-4 | | 0.030 |
| ExM-2 | | 0.096 |
| ExM-3 | | 0.028 |
| ExC-9 | | 0.020 |
| ExY-1 | | 0.020 |
| HBS-1 | | 0.085 |
| HBS-3 | | 0.003 |
| Gelatin | | 0.58 |
| 9th layer (Low-speed green-sensitive emulsion layer) | | |
| Silver bromochloroiodide emulsion F | silver | 0.45 |
| Silver bromochloroiodide emulsion G | silver | 0.30 |
| Silver bromochloroiodide emulsion H | silver | 0.38 |
| ExS-4 | | $1.4 \times 10^{-5}$ |
| ExS-5 | | $1.0 \times 10^{-4}$ |
| ExS-6 | | $1.9 \times 10^{-4}$ |
| ExS-7 | | $3.7 \times 10^{-5}$ |
| ExS-8 | | $1.0 \times 10^{-4}$ |
| ExS-12 | | $1.0 \times 10^{-4}$ |
| ExS-13 | | $6.2 \times 10^{-4}$ |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver bromochloroiodide emulsion I | silver | 0.45 |
| ExS-4 | | $2.3 \times 10^{-5}$ |
| ExS-7 | | $1.0 \times 10^{-4}$ |
| ExS-8 | | $2.3 \times 10^{-4}$ |
| ExS-12 | | $1.0 \times 10^{-4}$ |
| ExS-13 | | $8.2 \times 10^{-4}$ |
| ExC-9 | | 0.02 |
| ExM-2 | | 0.031 |
| ExM-3 | | 0.029 |
| ExY-1 | | 0.002 |
| ExM-4 | | 0.028 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Silver bromochloroiodide emulsion I | silver | 0.19 |
| Silver bromochloroiodide emulsion J | silver | 0.80 |
| ExS-4 | | $2.1 \times 10^{-5}$ |
| ExS-7 | | $1.0 \times 10^{-4}$ |
| ExS-8 | | $1.9 \times 10^{-4}$ |
| ExS-12 | | $1.0 \times 10^{-4}$ |
| ExS-13 | | $5.2 \times 10^{-4}$ |

-continued

| | |
|---|---|
| ExC-6 | 0.004 |
| ExC-9 | 0.030 |
| ExM-1 | 0.016 |
| ExM-3 | 0.036 |
| ExM-4 | 0.020 |
| ExM-5 | 0.004 |
| ExY-5 | 0.001 |
| ExM-2 | 0.013 |
| Cpd-3 | 0.004 |
| Cpd-4 | 0.007 |
| HBS-1 | 0.18 |
| Polyethylacrylate latex | 0.099 |
| Gelatin | 1.11 |
| 12th layer (Interlayer) | |
| Cpd-1 | 0.016 |
| HBS-1 | 0.082 |
| Gelatin | 1.057 |
| 13th layer (Low-speed blue-sensitive emulsion layer) | |
| Silver bromochloroiodide emulsion K | silver 0.28 |
| Silver bromochloroiodide emulsion L | silver 0.30 |
| Silver bromochloroiodide emulsion M | silver 0.10 |
| ExS-9 | $1.0 \times 10^{-4}$ |
| ExS-11 | $1.2 \times 10^{-4}$ |
| ExS-14 | $4.2 \times 10^{-4}$ |
| ExC-8 | 0.012 |
| ExY-1 | 0.035 |
| ExY-2 | 0.71 |
| ExY-3 | 0.10 |
| ExY-4 | 0.005 |
| Cpd-2 | 0.10 |
| Cpd-3 | $4.0 \times 10^{-3}$ |
| HBS-1 | 0.24 |
| Gelatin | 1.41 |
| 14th layer (High-speed blue-sensitive emulsion layer) | |
| Silver bromochloroiodide emulsion N | silver 1.05 |
| ExS-9 | $1.6 \times 10^{-4}$ |

-continued

| | |
|---|---|
| ExS-14 | $4.5 \times 10^{-4}$ |
| ExY-2 | 0.31 |
| ExY-3 | 0.05 |

-continued

| | |
|---|---|
| ExY-6 | 0.062 |
| Cpd-2 | 0.075 |
| Cpd-3 | $1.0 \times 10^{-3}$ |
| HBS-1 | 0.10 |
| Gelatin | 0.91 |
| 15th layer (1st protective layer) | |
| UV-1 | 0.21 |
| UV-2 | 0.13 |
| UV-3 | 0.20 |
| UV-4 | 0.025 |
| F-18 | 0.009 |
| HBS-1 | 0.12 |
| HBS-4 | $5.0 \times 10^{-2}$ |
| Gelatin | 2.3 |
| 16th layer (2nd protective layer) | |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, A. antistatic properties, and coating properties, the individual layers contained W-1 to W-3, B-4 to B-6, F-1 to F-19, iron salt, lead salt, gold salt, platinum salt, palladium salt, iridium salt, ruthenium salt, rhodium salt, and calcium salt.

Table 4 below shows the Br contents, I contents, grain sizes, and the like of emulsions indicated by abbreviations in the above description.

TABLE 4

| Emulsion name | Variation coefficient concerning inter-grain bromide distribution | Br content (mol %) | I content (mol %) | Average grain size (equivalent-sphere diameter; μm) | Variation coefficient (%) of equivalent-sphere diameter | Projected surface diameter (equivalent-circuit diameter; μm) | Projected area diameter/thickness ratio | Grain shape |
|---|---|---|---|---|---|---|---|---|
| Emulsion | | | | | | | | |
| A | 20 | 3.0 | 0.02 | 0.40 | 19 | 0.55 | 4.0 | Tabular grain |
| B | 17 | 2.0 | 0.01 | 0.54 | 21 | 0.86 | 6.0 | Tabular grain |
| C | 18 | 3.0 | 0.01 | 0.90 | 22 | 1.50 | 7.0 | Tabular grain |
| D | 17 | 2.0 | 0.03 | 1.10 | 18 | 2.07 | 10.0 | Tabular grain |
| E | 22 | 2.0 | 0.03 | 0.90 | 22 | 1.50 | 7.0 | Tabular grain |
| F | 18 | 3.0 | 0.02 | 0.30 | 19 | 0.38 | 3.0 | Tabular grain |
| G | 17 | 2.0 | 0.02 | 0.50 | 19 | 0.70 | 4.2 | Tabular grain |
| H | 18 | 1.0 | 0.02 | 0.60 | 17 | 1.00 | 7.0 | Tabular grain |
| I | 16 | 3.0 | 0.02 | 0.78 | 15 | 1.30 | 7.0 | Tabular grain |
| J | 19 | 3.0 | 0.02 | 0.97 | 18 | 1.88 | 11.0 | Tabular grain |
| K | 18 | 4.0 | 0.02 | 0.40 | 16 | 0.55 | 4.0 | Tabular grain |
| L | 22 | 4.0 | 0.03 | 0.60 | 18 | 1.05 | 8.0 | Tabular grain |
| M | 20 | 5.0 | 0.02 | 0.80 | 19 | 1.34 | 7.0 | Tabular grain |
| N | 22 | 6.0 | 0.04 | 1.40 | 24 | 2.80 | 12.0 | Tabular grain |
| P | — | 1.0 | 0 | 0.07 | — | 0.07 | 1.0 | Uniform structure |

In Table 4, (2) Gold sensitization, sulfur sensitization, and selenium sensitization were optimally performed for the emulsions A to N in accordance with Example 6 in JP-A-10-221827.

(3) The major faces of tabular grains were (111) faces, and the tabular grains were prepared by changing the addition conditions, addition amounts, and the like in Example 4 of JP-A-10-221827. The spectral sensitizing dyes added were compounds described in the individual photosensitive layers.

(4) Dislocation lines as described in JP-A-3-237450 were observed in the tabular grains when a high-voltage electron microscope was used. Preparation of dispersions of organic solid disperse dyes ExF-2 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.Og of the dye ExF-2 and 500 mL of zirconium oxide beads (diameter 1 mm) were added to the mill. The contents were dispersed for 2 hrs. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 $\mu$m.

Following the same procedure as above, a solid dispersion ExF-4 was obtained. The average grain size of the fine dye grains was 0.45 $\mu$m.

Compounds used in the formation of the individual layers described above were as follows.

ExC-1

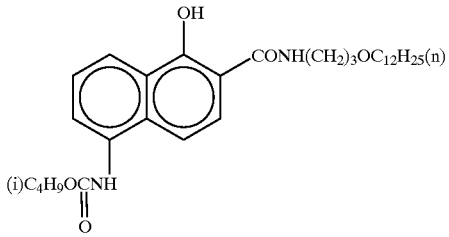

ExC-2

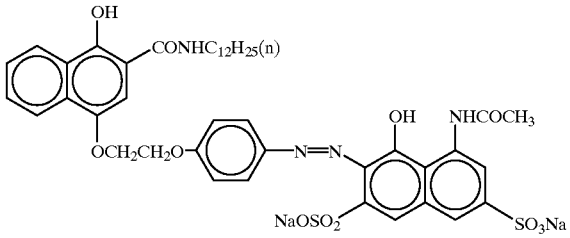

ExC-3

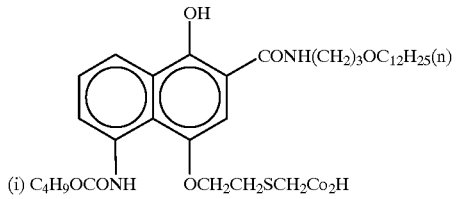

ExC-4

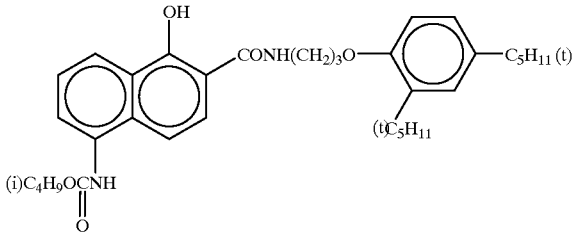

-continued

ExC-5

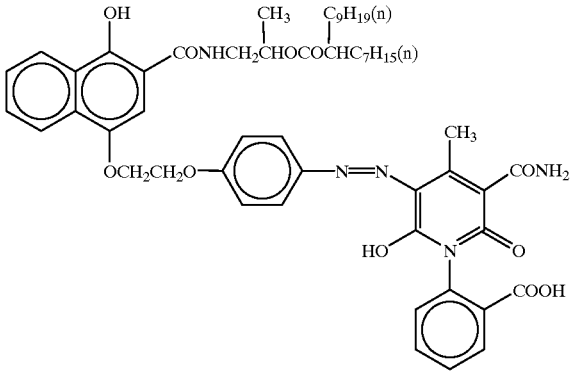

ExC-6

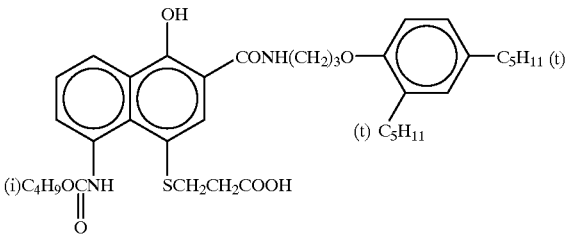

ExC-8

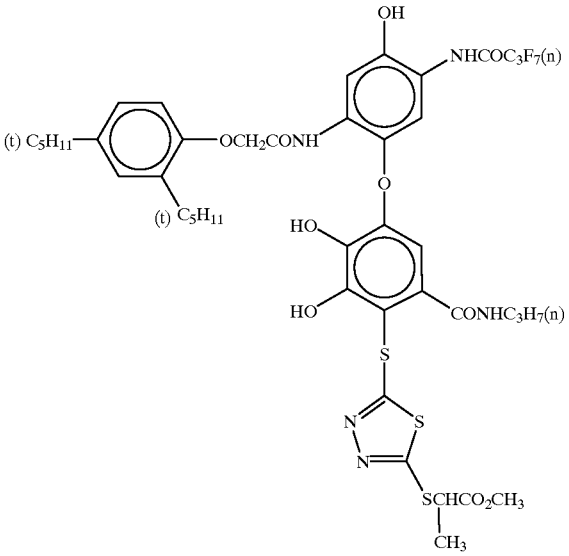

ExC-9

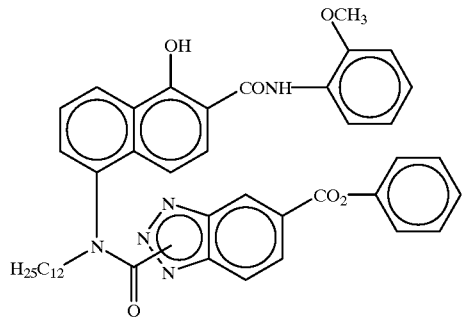

-continued
ExM-1
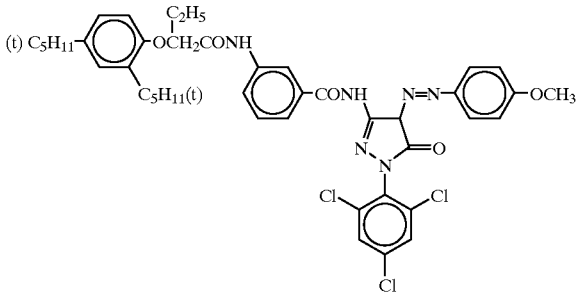
ExM-2
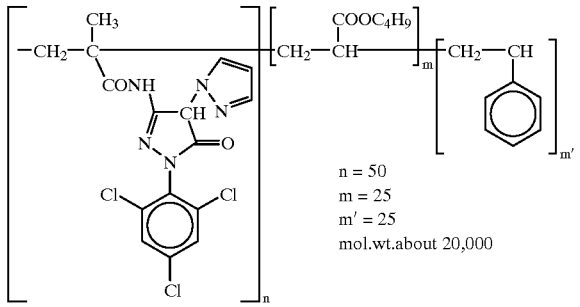
n = 50
m = 25
m′ = 25
mol.wt.about 20,000
ExM-3
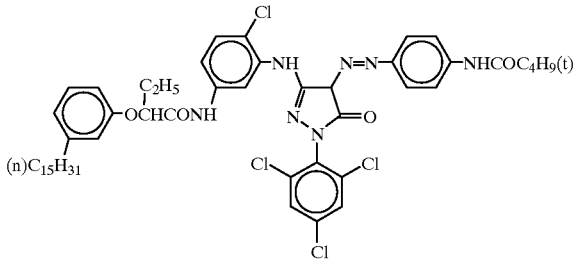
ExM-4
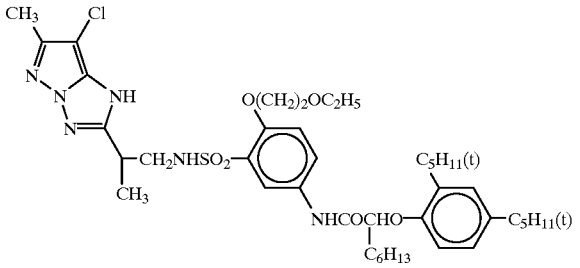
ExM-5
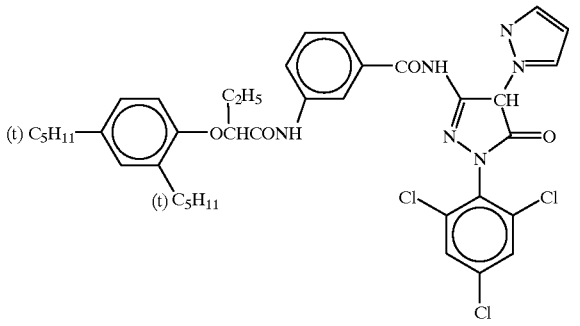
-continued
ExY-1
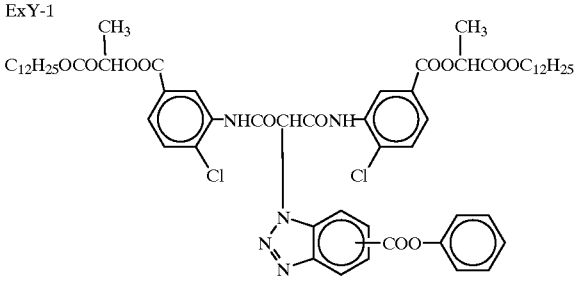
ExY-2
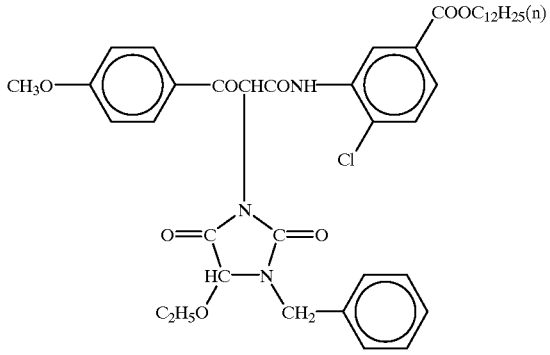
ExY-4
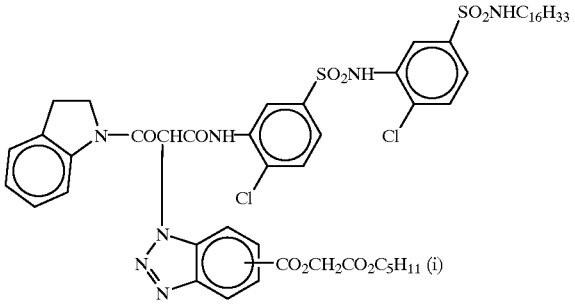
ExY-5
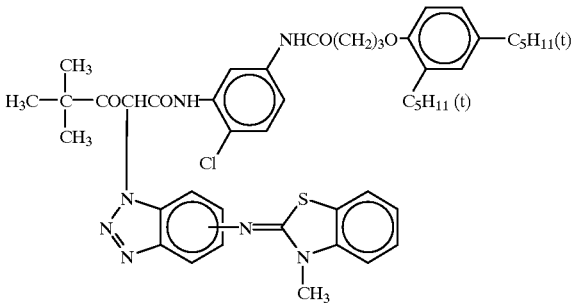
ExY-6
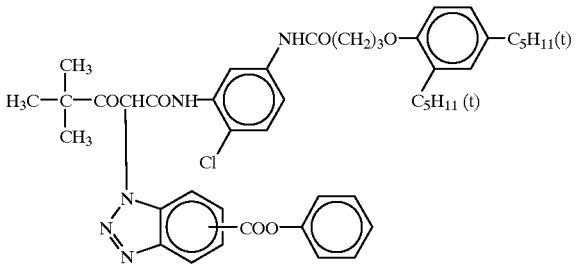
ExF-1

-continued
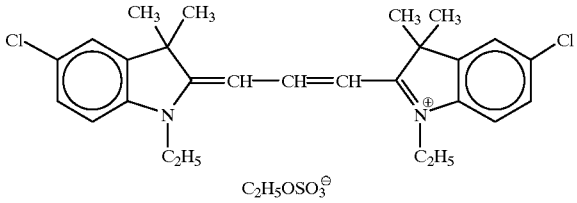
ExF-2
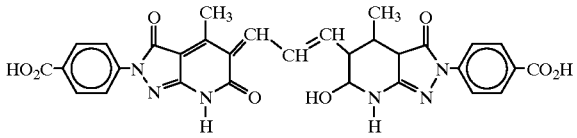
ExF-4
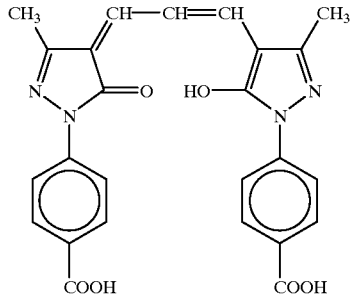
Cpd-1
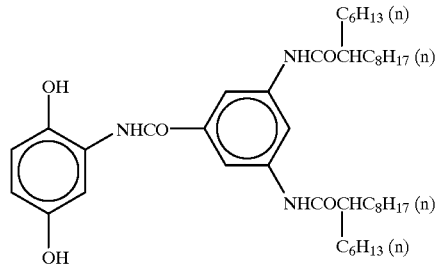
Cpd-2
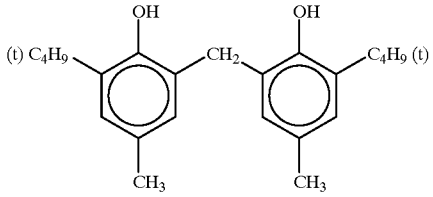
Cpd-3
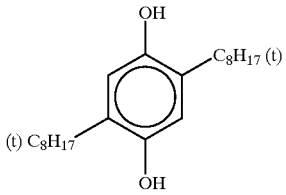
Cpd-4
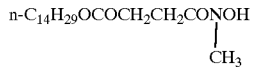
UV-1
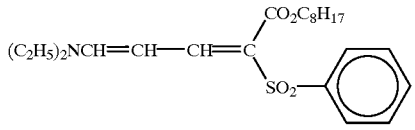
-continued
UV-2
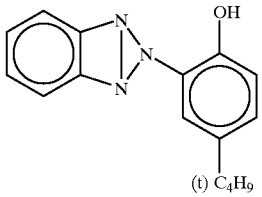
UV-3
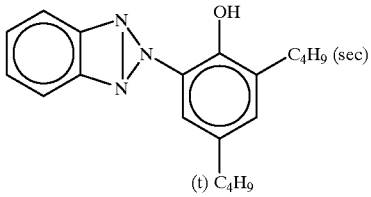
UV-4
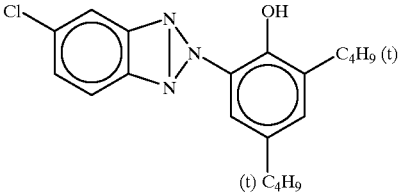
HBS-1
Tricresyl phosphate
HBS-2
Di-u-butylphthalate
HBS-3
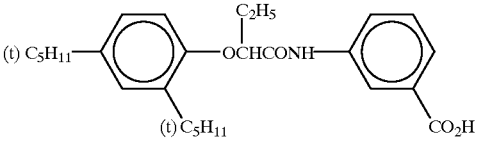
HBS-4
Tri(2-ethylhexyl)phosphate
ExS-1
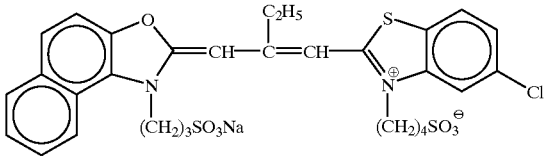
ExS-2
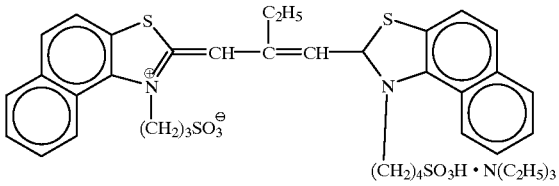
ExS-3
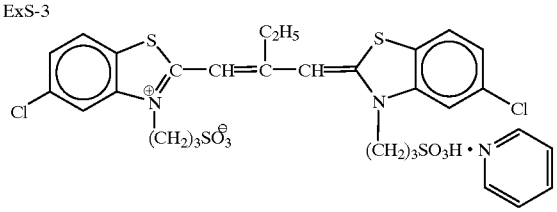

-continued
ExS-4
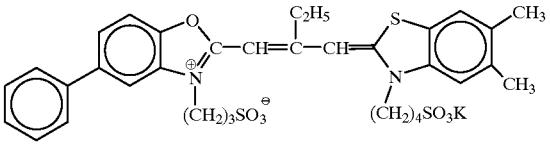
ExS-5
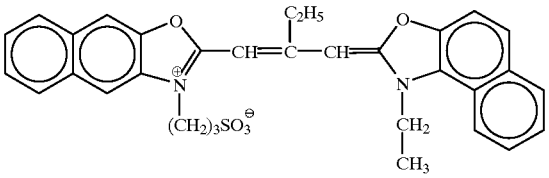
ExS-6
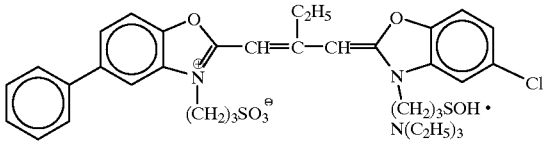
ExS-7
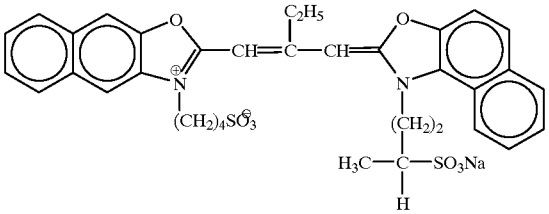
ExS-8
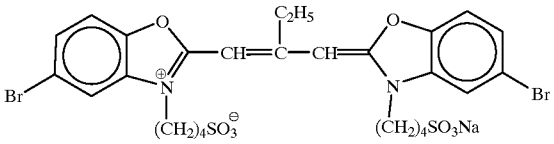
ExS-9
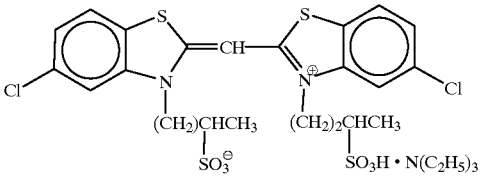
ExS-10
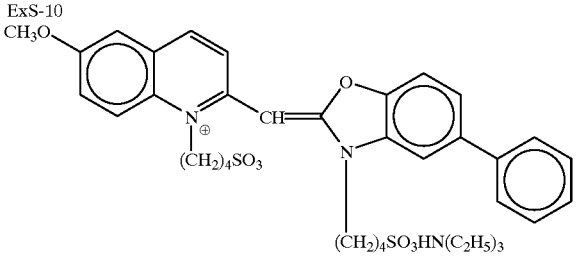
S-1
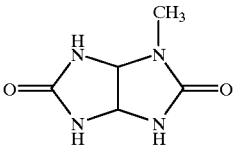
-continued
ExS-11
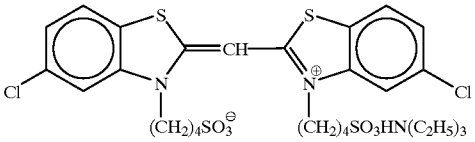
ExS-12
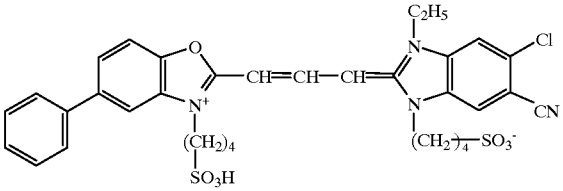
ExS-13
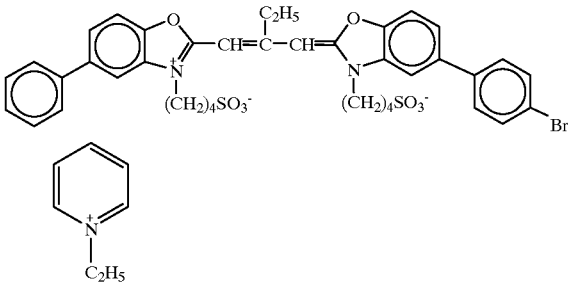
ExS-14
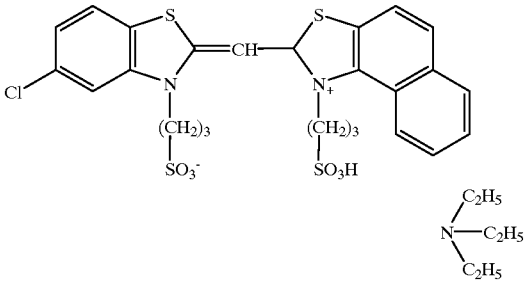
H-1
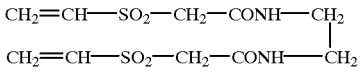
B-1
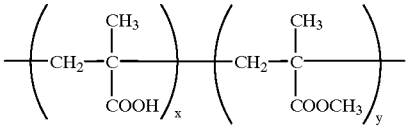
x/y = 10/90(weight ratio)
Average mol. wt.: about 35,000
B-2
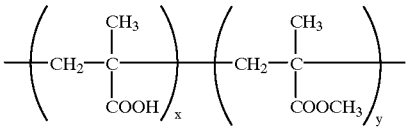
x/y = 40/60(weight ratio)
Average mol. wt.: about 20,000
B-3
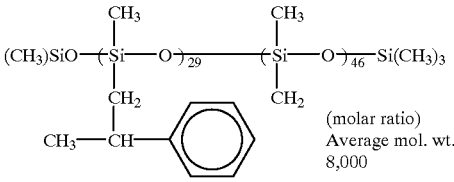
(molar ratio)
Average mol. wt.: about 8,000

-continued
B-4
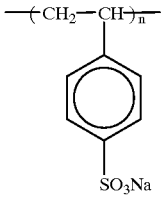
Average mol. wt.: about 750,000
B-5
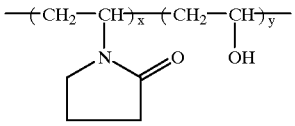
x/y = 70/30(weight ratio)
Average mol. wt.: about 17,000.00
B-6
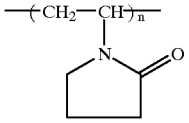
Average mol. wt.: about 10,000
W-1
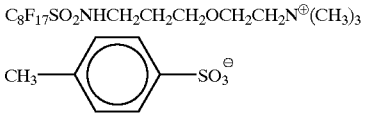
W-2
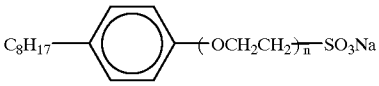
n = 2-4
W-3
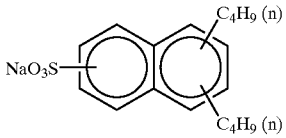
W-4
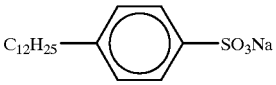
W-5
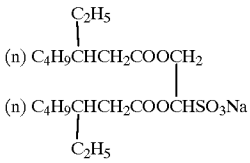
F-1
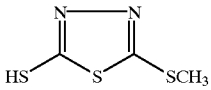
F-2
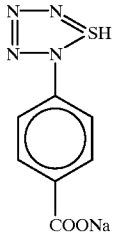
F-3
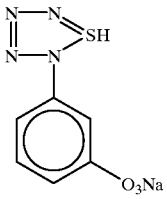
F-4
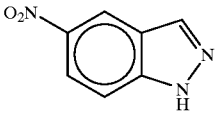
F-5
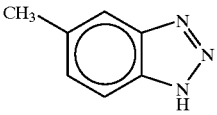
F-6
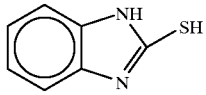
F-7
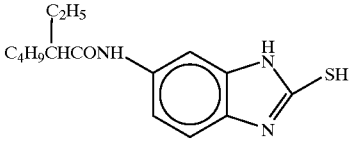
F-8
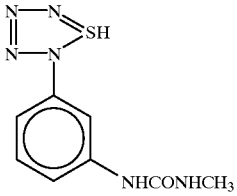
F-9
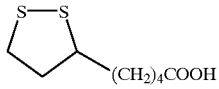
F-10
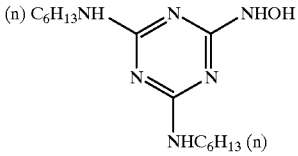
F-11
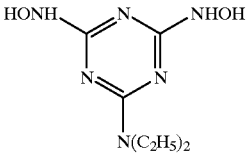
F-12
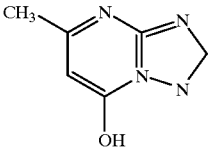

-continued

F-13

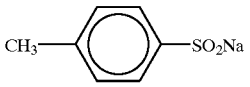

F-14

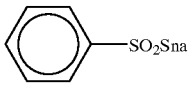

Manufacture of (Sample 402)

A sample 402 was manufactured following the same procedures as for the sample 401 except that 0.08 g/m$^2$ of the previously fogged emulsion Y in Example 3 and 0.02 g/m$^2$ of compound (12) were added to the third layer.

The compound (12) of the sample 401 was added as an emulsion dispersion by using a high-boiling organic solvent (HBS-1) and a surfactant (W-4) in weights 0.5 times that of the coupler.

Manufacture of (Samples 403–405)

Samples 403 to 405 were manufactured following the same procedures as for the sample 402 except that the compound in the third layer was changed to compounds shown in Table 5 below.

(Evaluation of Fog Density Fluctuations Due to Processing)

The samples 401 to 405 were wedge-exposed to white light and developed by processes A and B below. The fog density fluctuation (the difference between the fog density in the process A and the fog density in the process B) of a magenta image was evaluated.

The process B is identical with the process A except that the time and temperature of the color development step were changed to 2 min 10 sec and 44° C., respectively.

The smaller this value, the fog fluctuation due to the process fluctuation is small and preferable.

The results are summarized in Table 5. Table 5 reveals that the samples having the PUG releasing unit of the present invention had small fog fluctuations and were preferable.

TABLE 5

| Sample No. | Coupler in 3rd layer | Fog fluctuation | Remarks |
|---|---|---|---|
| 401 | None | 0.20 | Comparative example |
| 402 | Compound (12) | 0.07 | Present invention |
| 403 | Compound (13) | 0.09 | Present invention |
| 404 | Compound (10) | 0.11 | Present invention |
| 405 | Compound (106) | 0.12 | Present invention |
| 406 | ExC-6 | 0.10 | Present invention |

The processes and the processing solution compositions are presented below.

(Process A)

| Step | Time | Temperature | Replenishment rate* | Tank volume |
|---|---|---|---|---|
| Color development | 1 min 30 sec | 41° C. | 10 mL | 10.3 L |
| Bleaching | 20 sec | 41° C. | 5 mL | 3.6 L |
| Fixing (1) | 20 sec | 41° C. | — | 3.6 L |
| Fixing (2) | 20 sec | 41° C. | 7.5 mL | 3.6 L |
| Stabilization (1) | 10 sec | 41° C. | — | 1.9 L |
| Stabilization (2) | 10 sec | 41° C. | — | 1.9 L |
| Stabilization (3) | 10 sec | 41° C. | 30 mL | 1.9 L |
| Drying | 30 sec | 60° C. | | |

*The replenishment rate was per 1.1 m of a 35-mm wide light-sensitive material (equivalent to one 24 Ex. 1)

The stabilizer was counterflowed in the order of (3)→(2)→(1), and the fixer was also connected from (2) to (1) by counterflow piping. Also, the tank solution of stabilizer (2) was supplied to fixer (2) in an amount of 15 mL as a replenishment rate. Note that all of the amounts of the developer, bleaching solution, and fixer carried over to the bleaching step, fixing step, and washing step, respectively, were 2.0 mL per 1.1 m of a 35-mm wide light-sensitive material. Note also that each crossover time was 6 sec, and this time was included in the processing time of each preceding step.

The compositions of the processing solutions are presented below.

| (Color developer) | [Tank solution] | [Replenisher] |
|---|---|---|
| Diethylenetriamine pentaacetic acid | 3.0 g | 5.0 g |
| Sodium 4,5-dihydroxy benzene-1,3-disulfonate | 0.5 g | 0.5 g |
| Disodium-N,N-bis(2-sulfonatoethyl) hydroxylamine | 10.0 g | 15.0 g |
| Sodium sulfite | 4.0 g | 10.0 g |
| Hydroxylamine sulfate | 1.5 g | 3.0 g |
| Potassium chloride | 2.0 g | — |
| Diethyleneglycol | 10.0 g | 10.0 g |
| Ethyleneurea | 3.0 g | 3.0 g |
| 2-methyl-4-[N-ethyl-N-(β-hydroxyethyl)amino] aniline sulfate | 6.0 g | 11.4 g |
| Potassium carbonate | 35 g | 35 g |
| Water to make | 1.0 L | 1.0 L |
| pH (controlled by sulfuric acid and KOH) | 10.10 | 10.60 |
| (Bleaching solution) | [Tank solution] | [Replenisher] |
| Ferric ammonium 1,3-diaminopropanetetra acetate monohydrate | 140 g | 200 g |
| Ammonium bromide | 50 g | 70 g |
| Succinic acid | 10 g | 15 g |
| Maleic acid | 40 g | 60 g |
| Imidazole | 60 g | 90 g |
| Water to make | 1.0 L | 1.0 L |
| pH (controlled by ammonia water and nitric acid) | 4.2 | 3.8 |
| (Fixer) | [Tank solution] | [Replenisher] |
| Ammonium thiosulfate (750 g/L) | 280 mL | 750 mL |
| Aqueous ammonium | 20 g | 80 g |

-continued

| | | |
|---|---|---|
| bisulfite solution (72%) | | |
| Imidazole | 10 g | 45 g |
| 1-mercapto-2-(N,N-dimethylaminoethyl)-tetrazole | 1 g | 3 g |
| Ethylenediamine tetraacetic acid | 3 g | 9 g |
| Water to make | 1.0 L | 1.0 L |
| pH (controlled by ammonia water and nitric acid) | 7.0 | 7.0 |
| (Stabilizer) [Common to tank solution and replenisher] | | |
| Sodium p-toluenesulfinate | | 0.03 g |
| p-Nonylphenoxypolyglycidol (glycidol average polymerization degree 10) | | 0.4 g |
| Disodium ethylenediaminetetraacetate | | 0.05 g |
| 1,2,4-triazole | | 1.3 g |
| 1,4-bis(1,2,4-triazole-1-isomethyl) piperazine | | 0.75 g |
| 1,2-benzoisothiazoline-3-one | | 0.10 g |
| Water to make | | 1.0 L |
| pH | | 8.5 |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color light-sensitive photographic material comprising at least one light-sensitive silver halide emulsion layer and at least one non-light-sensitive layer on a support, wherein at least one of the non-light-sensitive layers contains a previously fogged silver halide emulsion containing grains each having a previously fogged surface, and the non-light-sensitive layer containing the previously fogged emulsion or its adjacent layer contains a compound capable of releasing a photographically useful group or its precursor by a coupling reaction with the oxidized form of a developing agent; and the previously fogged emulsion is developed during color development to evenly form the oxidized form of a color developing agent, and the photographically useful group or its precursor is released non-imagewise by the coupling reaction.

2. The light-sensitive material according to claim 1, wherein the compound capable of releasing a photographically useful group or its precursor, does not substantially form an image by the coupling reaction with the oxidized form of a developing agent.

3. The light-sensitive material according to claim 2, wherein the compound capable of releasing a photographically useful group or its precursor, is represented by a formula: A-B, wherein A represents a coupler moiety, and B represents a photographically useful group or its precursor.

4. The light-sensitive material according to claim 3, wherein the compound represented by the formula A-B, is represented by formula (II) below:

COUP1-B1 (II)

wherein COUP1 represents a coupler moiety which releases B1 by the coupling reaction with the oxidized form of a developing agent and also forms a water-soluble or alkali-soluble compound; and B1 represents a photographically useful group or its precursor which connects at the coupling position of COUP1.

5. The light-sensitive material according to claim 4, wherein the compound represented by formula (II) is a compound represented by formula (III) below:

COUP2-A-E-B2 (II)

wherein COUP2 represents a coupler moiety capable of coupling with the oxidized form of a developing agent; E represents an electrophilic portion; A represents a connecting group capable of releasing B2 with ring formation by an intramolecular nucleophilic substitution reaction of a nitrogen atom, which arises from the developing agent in the product of coupling between COUP2 and the oxidized form of the developing agent and which directly bonds to the coupling position, with the nucleophilic portion E; and B2 represents a photographically useful group or its precursor.

6. The light-sensitive material according to claim 1, wherein the previously fogged silver halide emulsion and the compound are contained in the same layer.

7. The light-sensitive material according to claim 1, wherein the non-light-sensitive layer containing the previously fogged silver halide emulsion contains black colloidal silver.

8. The light-sensitive material according to claim 6, wherein the non-light-sensitive layer containing the previously fogged silver halide emulsion, contains black colloidal silver.

9. The light-sensitive material according to claim 7, wherein the layer adjacent to the non-light-sensitive layer containing the previously fogged silver halide emulsion, contains black colloidal silver.

10. The light-sensitive material according to claim 8, wherein the layer adjacent to the non-light-sensitive layer containing the previously fogged silver halide emulsion, contains black colloidal silver.

11. The light-sensitive material according to claim 1, wherein the photographically useful group is a bleaching accelerator.

12. The light-sensitive material according to claim 1, wherein the photographically useful group is a development inhibitor.

13. The light-sensitive material according to claim 1, wherein at least one of light-sensitive silver halide emulsions contained in the at least one light-sensitive silver halide emulsion layer is an emulsion having a silver chloride content of at least 10 mol %.

14. The light-sensitive material according to claim 13, wherein at least one of the previously fogged silver halide emulsions contained in the at least one non-light-sensitive layer, is an emulsion having a silver chloride content of at least 10 mol %.

* * * * *